US011330838B2

(12) United States Patent
Cox et al.

(10) Patent No.: US 11,330,838 B2
(45) Date of Patent: May 17, 2022

(54) HOLDER FOR AEROSOL DELIVERY DEVICE WITH DETACHABLE CARTRIDGE

(71) Applicant: R.J. REYNOLDS TOBACCO COMPANY, Winston-Salem, NC (US)

(72) Inventors: Keri Meggan Cox, Pleasant Garden, NC (US); Edmond Strother Smith, III, Rural Hall, NC (US); Zachary Kevin Francis, Winston-Salem, NC (US); Thaddeus Jackson, Summerfield, NC (US); Billy T Conner, Clemmons, NC (US); Taylor Leigh, Alpharetta, GA (US); Randall M. Bachtel, Lawrenceville, GA (US); Frank Bascas, Montezuma, GA (US); Hannah Tam, San Francisco, CA (US); Moises Araya, Atlanta, GA (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 389 days.

(21) Appl. No.: 16/516,573

(22) Filed: Jul. 19, 2019

(65) Prior Publication Data

US 2021/0015174 A1 Jan. 21, 2021

(51) Int. Cl.
*A24F 7/00* (2006.01)

(52) U.S. Cl.
CPC ..... *A24F 7/00* (2013.01)

(58) Field of Classification Search
None
See application file for complete search history.

(56) References Cited

U.S. PATENT DOCUMENTS 1,464,300 A 8/1923 Taff
1,505,655 A 8/1924 Marek
(Continued)

FOREIGN PATENT DOCUMENTS

JP 2002034543 A 2/2002
WO WO1995034226 12/1995
(Continued)

OTHER PUBLICATIONS

Stephenson, "A 'Safer' Cigarette? Prove It, Say Critics," JAMA, 2000, 283(19), pp. 2507-2508. doi:10.1001/jama.283.19.2507.
(Continued)

*Primary Examiner* — Timothy Kennedy
*Assistant Examiner* — Guy F Mongelli
(74) *Attorney, Agent, or Firm* — Womble Bond Dickinson (US) LLP

(57) ABSTRACT

The present disclosure is directed to a holder of a smoking article comprising a receiving end and a mouth end opposite the receiving end. The holder defines a socket that is configured to receive a proximal section of a cartridge. The holder has a lighting configuration in which the holder is configured to secure a proximal section of the cartridge to the holder with a heat source of the cartridge opposite the proximal section disposed beyond the receiving end of the holder. The holder has a received configuration in which the holder is configured to secure the proximal section of the cartridge in the socket with the heat source disposed proximate the receiving end of the holder. The receiving end comprises a substantially solid outer wall.

31 Claims, 20 Drawing Sheets

(56) References Cited

U.S. PATENT DOCUMENTS 1,541,891 A 6/1925 Becker
1,607,132 A 11/1926 Shichigoro
1,613,545 A 1/1927 Teigen
1,721,438 A 7/1929 Easton
1,941,531 A 1/1934 Blankenship
2,008,433 A 7/1935 Ashour
2,373,629 A 4/1945 Kilgore
2,455,492 A 12/1948 Jackson
2,502,831 A 4/1950 Daze
2,541,837 A 2/1951 Schroff
2,701,571 A 2/1955 Dittrich
2,711,176 A 6/1955 Vakilian
2,779,340 A 1/1957 Lee
2,953,136 A 9/1960 Dahly
3,155,099 A 11/1964 Minchin
3,181,538 A 5/1965 Piliego
3,685,520 A 8/1972 Chernack
4,708,151 A 11/1987 Shelar
4,714,082 A 12/1987 Banerjee et al.
4,966,171 A 10/1990 Serrano et al.
4,991,606 A 2/1991 Serrano et al.
5,040,552 A 8/1991 Schleich et al.
5,060,676 A 10/1991 Hearn et al.
5,076,296 A 12/1991 Nystrom et al.
5,159,940 A 11/1992 Hayward et al.
5,178,165 A 1/1993 DeFelice
5,240,012 A 8/1993 Ehrman et al.
5,592,955 A 1/1997 Keritsis
5,595,577 A 1/1997 Bensalem et al.
5,692,525 A 12/1997 Counts et al.
5,845,649 A 12/1998 Saito et al.
6,006,757 A 12/1999 Lichtenberg
6,053,176 A 4/2000 Adams et al.
6,164,287 A 12/2000 White
6,311,694 B1 11/2001 Nichols et al.
6,345,625 B1 2/2002 Chew
6,371,127 B1 4/2002 Snaidr et al.
6,431,177 B1 8/2002 Sieggen et al.
6,532,965 B1 3/2003 Abhulimen et al.
6,615,843 B2 9/2003 Pera
6,748,955 B2 6/2004 Snaidr et al.
7,080,649 B2 7/2006 Hcu
7,503,330 B2 3/2009 Borschke et al.
7,600,517 B1 10/2009 Holzrichter
7,624,739 B2 12/2009 Snaidr et al.
8,061,361 B2 11/2011 Maeder et al.
8,151,803 B2 4/2012 Inagaki
8,302,611 B2 11/2012 Rowley
8,528,567 B2 9/2013 Hajaligol
8,616,217 B2 12/2013 Tsurizumi et al.
8,776,803 B2 7/2014 Tarora et al.
8,863,754 B2 10/2014 Renaud et al.
8,915,255 B2 12/2014 Poget et al.
9,078,473 B2 7/2015 Worm et al.
9,149,072 B2 10/2015 Conner et al.
9,220,301 B2 12/2015 Banerjee et al.
9,282,769 B2 3/2016 Mishra et al.
9,301,546 B2 4/2016 Thomas et al.
9,332,784 B2 5/2016 Banerjee et al.
9,439,453 B2 9/2016 Conner et al.
9,532,591 B2 1/2017 Mironov
9,549,572 B2 1/2017 Dincer et al.
9,609,893 B2 4/2017 Novak, III et al.
9,629,393 B2 4/2017 Stolz et al.
9,693,587 B2 7/2017 Plojoux
9,717,273 B2 8/2017 Poget et al.
9,730,468 B2 8/2017 Poget et al.
9,801,412 B2 10/2017 Grant
9,894,930 B2 2/2018 Bonici et al.
9,918,494 B2 3/2018 Mironov et al.
9,930,915 B2 4/2018 Worm et al.
9,943,114 B2 4/2018 Batista
9,961,939 B2 5/2018 Reevell
10,034,493 B2 7/2018 Akiyama et al.
10,064,428 B2 9/2018 Swepston et al.
10,064,478 B2 9/2018 Brooks
10,111,463 B2 10/2018 Batista
10,159,277 B2 12/2018 Bonnely
10,212,968 B2 2/2019 Mironov et al.
10,398,168 B2 9/2019 Maiwald et al.
10,470,491 B2 11/2019 Sutton et al.
10,492,526 B2 12/2019 Sampson et al.
10,524,503 B2 1/2020 Florack et al.
10,638,792 B2 * 5/2020 Christensen ..... H05B 1/0227
10,827,780 B2 11/2020 Swepston et al.
2008/0047570 A1 2/2008 Plank
2009/0065011 A1 3/2009 Maeder et al.
2009/0302019 A1 * 12/2009 Selenski ..... A24F 40/485 219/201
2011/0083674 A1 4/2011 Karpinsky
2011/0240047 A1 * 10/2011 Adamic ..... A24F 3/00 131/328
2013/0133675 A1 5/2013 Shinozaki et al.
2013/0167850 A1 7/2013 Al-Aawar
2013/0228190 A1 9/2013 Weiss et al.
2014/0048085 A1 2/2014 Cox
2014/0270726 A1 * 9/2014 Egoyants ..... F16L 59/065 392/386
2015/0034100 A1 2/2015 Park et al.
2015/0040924 A1 2/2015 Mironov et al.
2015/0173417 A1 * 6/2015 Gennrich ..... A24F 40/49 131/329
2015/0181927 A1 * 7/2015 Swepston ..... A24F 13/08 131/88
2015/0272211 A1 * 10/2015 Chung ..... A24F 40/40 206/242
2015/0296882 A1 10/2015 Mironov et al.
2015/0342254 A1 12/2015 Mironov et al.
2016/0007648 A1 1/2016 Sutton et al.
2016/0007649 A1 1/2016 Sampson et al.
2016/0120216 A1 5/2016 Mironov et al.
2016/0135495 A1 5/2016 Poget et al.
2016/0174609 A1 6/2016 Mironov
2016/0192704 A1 7/2016 Bonnely
2016/0316816 A1 11/2016 Lavanchy et al.
2016/0360785 A1 12/2016 Bless et al.
2017/0000189 A1 1/2017 Mironov et al.
2017/0055577 A1 3/2017 Batista
2017/0055578 A1 3/2017 Oda et al.
2017/0164654 A1 6/2017 Ademe
2017/0196261 A1 7/2017 Borges De Couraca et al.
2017/0303585 A1 10/2017 Florack et al.
2017/0318859 A1 11/2017 Batista
2018/0000165 A1 1/2018 Liu
2018/0014571 A1 1/2018 Nakano
2018/0070640 A1 3/2018 Bessant et al.
2018/0116280 A1 5/2018 Maiwald et al.
2018/0192692 A1 7/2018 Richmond et al.
2018/0192707 A1 7/2018 Worm et al.
2018/0317560 A1 11/2018 Shinozaki et al.
2018/0325167 A1 11/2018 Grant
2018/0339118 A1 * 11/2018 Ouyang ..... A61M 11/042
2018/0360116 A1 * 12/2018 Schmidt ..... A24F 40/46
2018/0368468 A1 12/2018 Mishra et al.
2019/0000135 A1 1/2019 Lavanant et al.
2019/0000141 A1 1/2019 Rojo-Calderon et al.
2019/0000142 A1 1/2019 Lavanchy et al.
2019/0014818 A1 1/2019 Saygili
2019/0014820 A1 1/2019 Malgat
2019/0014821 A1 1/2019 Batista et al.
2019/0059449 A1 2/2019 Akiyama et al.
2019/0059450 A1 2/2019 Akiyama et al.
2019/0075848 A1 3/2019 Worm et al.
2019/0090539 A1 * 3/2019 Rostami ..... A61M 15/06
2019/0124972 A1 5/2019 Nakano
2019/0124973 A1 5/2019 Nakano et al.
2019/0133176 A1 5/2019 Nakano et al.
2019/0150505 A1 5/2019 Ceppi et al.
2019/0274358 A1 9/2019 Reevell
2020/0015519 A1 1/2020 Conner et al.
2020/0022411 A1 * 1/2020 Krietzman ..... A61M 15/08
2020/0060333 A1 2/2020 Sutton et al.
2020/0146349 A1 5/2020 Phillips et al.
2020/0268044 A1 8/2020 Wilson

(56) References Cited

U.S. PATENT DOCUMENTS

| | | | | |
|---|---|---|---|---|
| 2020/0288780 | A1* | 9/2020 | Martin | A24F 13/00 |
| 2021/0015172 | A1 | 1/2021 | Conner et al. | |
| 2021/0015174 | A1 | 1/2021 | Cox et al. | |
| 2021/0015175 | A1 | 1/2021 | Jackson et al. | |
| 2021/0145054 | A1* | 5/2021 | Kane | A24F 40/42 |

FOREIGN PATENT DOCUMENTS

| | | | |
|---|---|---|---|
| WO | WO1998054989 | | 12/1998 |
| WO | WO2009022232 | | 2/2009 |
| WO | WO2013072336 | | 5/2013 |
| WO | 2013083963 | A1 | 6/2013 |
| WO | WO2013149810 | | 10/2013 |
| WO | WO2013189836 | | 12/2013 |
| WO | WO2014037270 | | 3/2014 |
| WO | WO2014156838 | | 10/2014 |
| WO | 2014180893 | A1 | 11/2014 |
| WO | WO2015097005 | | 7/2015 |
| WO | WO2015128384 | | 9/2015 |
| WO | WO2015151158 | | 10/2015 |
| WO | WO2015184744 | | 12/2015 |
| WO | WO2015197850 | | 12/2015 |
| WO | WO2017042297 | | 3/2017 |
| WO | WO2017108912 | | 6/2017 |
| WO | WO2017114760 | | 7/2017 |
| WO | WO2017115181 | | 7/2017 |
| WO | WO2017115182 | | 7/2017 |
| WO | WO2017115183 | | 7/2017 |
| WO | WO2017115184 | | 7/2017 |
| WO | WO2017115185 | | 7/2017 |
| WO | WO2017115188 | | 7/2017 |
| WO | WO2017115196 | | 7/2017 |
| WO | WO2017207442 | | 12/2017 |
| WO | WO2017212284 | | 12/2017 |
| WO | WO2018170800 | | 9/2018 |
| WO | WO2018201655 | | 11/2018 |
| WO | WO2019010680 | | 1/2019 |
| WO | 2020216762 | A1 | 10/2020 |

OTHER PUBLICATIONS

"Chemical and Biological Studies on New Cigarette Prototypes That Heat Instead of Bum Tobacco," R. J. Reynolds Tobacco Company, 1988.

International Search Report from the corresponding International Application No. PCT/IB2020/056769, dated Sep. 29, 2020.

* cited by examiner

HOLDER FOR AEROSOL DELIVERY DEVICE WITH DETACHABLE CARTRIDGE

FIELD OF THE DISCLOSURE

The present disclosure relates to aerosol delivery devices and systems, such as smoking articles; and more particularly, holders for securing a detachable cartridge thereto. The smoking articles may be aerosol delivery devices and systems that utilize heat sources, such as combustible carbon-based ignition sources, for the production of aerosol (e.g., smoking articles for purposes of yielding components of tobacco, tobacco extracts, nicotine, synthetic nicotine, non-nicotine flavoring, and other materials in an inhalable form, commonly referred to as heat-not-burn systems or electronic cigarettes). Components of such articles can be made or derived from tobacco, or those articles can be characterized as otherwise incorporating tobacco for human consumption, and which are capable of vaporizing components of tobacco and/or other tobacco related materials to form an inhalable aerosol for human consumption.

BACKGROUND

Many smoking articles have been proposed through the years as improvements upon, or alternatives to, smoking products based upon combusting tobacco. Example alternatives have included devices wherein a solid or liquid fuel is combusted to transfer heat to tobacco or wherein a chemical reaction is used to provide such heat source. Examples include the smoking articles described in U.S. Pat. No. 9,078,473 to Worm et al., which is incorporated herein by reference.

The point of the improvements or alternatives to smoking articles typically has been to provide the sensations associated with cigarette, cigar, or pipe smoking, without delivering considerable quantities of incomplete combustion and pyrolysis products. To this end, there have been proposed numerous smoking products, flavor generators, and medicinal inhalers that utilize electrical energy to vaporize or heat a volatile material, or attempt to provide the sensations of cigarette, cigar, or pipe smoking without burning tobacco to a significant degree. See, for example, the various alternative smoking articles, aerosol delivery devices, and heat generating sources set forth in the background art described in U.S. Pat. No. 7,726,320 to Robinson et al.; and U.S. Patent Publication Nos. 2013/0255702 to Griffith, Jr. et al.; and 2014/0096781 to Sears et al., which are incorporated herein by reference. See also, for example, the various types of smoking articles, aerosol delivery devices and electrically powered heat generating sources referenced by brand name and commercial source in U.S. Patent Publication No. 2015/0220232 to Bless et al., which is incorporated herein by reference. Additional types of smoking articles, aerosol delivery devices and electrically powered heat generating sources referenced by brand name and commercial source are listed in U.S. Patent Publication No. 2015/0245659 to DePiano et al., which is also incorporated herein by reference in its entirety. Other representative cigarettes or smoking articles that have been described and, in some instances, been made commercially available include those described in U.S. Pat. No. 6,735,217 to Gerth et al.; U.S. Pat. Nos. 6,922,901, 6,947,874, and 6,947,875 to Brooks et al.; U.S. Pat. No. 5,060,671 to Counts et al.; U.S. Pat. No. 5,249,586 to Morgan et al.; U.S. Pat. No. 5,388,594 to Counts et al.; U.S. Pat. No. 5,666,977 to Higgins et al.; U.S. Pat. No. 6,053,176 to Adams et al.; U.S. Pat. No. 6,164,287 to White; U.S. Pat. No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,726,320 to Robinson et al.; U.S. Pat. No. 7,896,006 to Hamano; U.S. Pat. No. 6,772,756 to Shayan; U.S. Patent Publication No. 2009/0095311 to Hon; U.S. Patent Publication Nos. 2006/0196518, 2009/0126745, and 2009/0188490 to Hon; U.S. Patent Publication No. 2009/0272379 to Thorens et al.; U.S. Patent Publication Nos. 2009/0260641 and 2009/0260642 to Monsees et al.; U.S. Patent Publication Nos. 2008/0149118 and 2010/0024834 to Oglesby et al.; U.S. Patent Publication No. 2010/0307518 to Wang; and WO 2010/091593 to Hon, which are incorporated herein by reference.

Various manners and methods for assembling smoking articles that possess a plurality of sequentially arranged segmented components have been proposed. See, for example, the various types of assembly techniques and methodologies set forth in U.S. Pat. No. 5,469,871 to Barnes et al. and U.S. Pat. No. 7,647,932 to Crooks et al.; and U.S. Patent Publication Nos. 2010/0186757 to Crooks et al.; 2012/0042885 to Stone et al., and 2012/00673620 to Conner et al.; each of which is incorporated by reference herein in its entirety.

Certain types of cigarettes that employ carbonaceous fuel elements have been commercially marketed under the brand names "Premier," "Eclipse" and "Revo" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000). Additionally, a similar type of cigarette has been marketed in Japan by Japan Tobacco Inc. under the brand name "Steam Hot One."

In some instances, some smoking articles, particularly those that employ a traditional paper wrapping material, are also prone to scorching of the paper wrapping material overlying an ignitable fuel source, due to the high temperature attained by the fuel source in proximity to the paper wrapping material. This can reduce enjoyment of the smoking experience for some consumers and can mask or undesirably alter the flavors delivered to the consumer by the aerosol delivery components of the smoking articles. In further instances, traditional types of smoking articles can produce relatively significant levels of gasses, such as carbon monoxide and/or carbon dioxide, during use (e.g., as products of carbon combustion). In still further instances, traditional types of smoking articles may suffer from poor performance with respect to aerosolizing the aerosol forming component(s).

As such, it would be desirable to provide smoking articles that address one or more of the technical problems sometimes associated with traditional types of smoking articles. In particular, it would be desirable to provide a smoking article that is easy to use and that provides reusable components.

BRIEF SUMMARY

In various implementations, the present disclosure provides a holder of a smoking article comprising a receiving end and a mouth end opposite the receiving end. The holder defines a socket that is configured to receive a proximal section of a cartridge. The holder has a lighting configuration in which the holder is configured to secure a proximal section of the cartridge to the holder with a heat source of the cartridge opposite the proximal section disposed beyond the receiving end of the holder. The holder has a received configuration in which the holder is configured to secure the proximal section of the cartridge in the socket with the heat source disposed proximate the receiving end of the holder. The receiving end of the holder comprises a substantially solid peripheral wall.

In some implementations, the holder comprises a main body portion that extends from the mouth end. The main body portion may include a mouthpiece at the mouth end. The mouthpiece may define a portion of a bore that extends through the main body portion.

In certain implementations, the holder includes an outer barrel comprising the receiving end, the outer barrel having a distal section. The outer barrel may be slidably received over the main body portion. The outer barrel may have a lighting position that corresponds to the lighting configuration of the holder and an extended position corresponding to the received configuration of the holder. The outer barrel may have a retracted position proximal of the lighting position in which the socket is in an expanded configuration. In the expanded configuration, the socket may be configured to have a diameter greater than the proximal section of the cartridge. The main body portion may include an inner barrel that defines the socket and includes an outer wall. The outer barrel may be slidably received about the outer wall. The outer barrel may include an inner wall that is configured to engage the outer wall of the inner barrel as the outer barrel slides towards the received position to compress the socket towards a compressed configuration in which the socket is configured to secure the proximal section of the cartridge therein. The main body portion may include a divider cavity disposed within the inner barrel. The divider cavity may separate the bore from the socket and define a passageway that interconnects the bore and the socket. In the retracted position of the holder, an outer surface of the outer barrel may be flush with an outer wall of the main body portion.

In some implementations, the holder may include a cap comprising the receiving end that is configured to releasably coupled the main body portion. The cap and main body portion may be configured to encapsulate a cartridge received within the socket. The main body portion may comprise a connector that defines a distal portion of the socket and a distal end of the main body portion. The socket may be configured to releasably couple to the cap. The cap may define a receiver and a distal wall opposite the receiver. The receiver may be configured to receive the connecter therein to releasably couple the cap to the main body portion. The connector may include a nub that extends from an outer surface of the connector. The nub may define a gap with an outer wall of the main body portion. The cap may include a retainer that extends inward in the receiver. The retainer may be configured to be received within the gap to secure the cap to the main body portion. The cap may be configured to receive the connector in a first radial position and to rotate to a second radial position with the connector disposed within the receiver to position the retainer within the gap. The cap may comprise a cap wall defining an outer surface of the cap. The cap wall may be flush with the outer wall of the main body portion when the cap is secured to the main body portion. The distal wall of the cap may comprise a vent hole that is defined therethrough.

In certain implementations, the main body portion comprises an outer wall and a sleeve and defines a chamber and a slot. The chamber may be positioned between and in communication with the bore and the socket. The slot may extend through the outer wall and be in communication with the chamber. The sleeve may be slidably disposed within the chamber and include a slide that extends through the slot. The slide may be coupled to the sleeve to translate the sleeve within the chamber as the slide translates within the slot. The sleeve may include a shaft that extends towards the receiving end of the holder. The sleeve may have a loading position in which the shaft is disposed proximal of the socket and an ejecting position in which a portion of the shaft extends into the socket. The shaft may include a cleat at a distal end thereof. The cleat may be configured to directly engage a cartridge. The sleeve may be configured to eject a cartridge from within the socket. The sleeve may define a vapor passageway therethrough. The vapor passageway may interconnect the socket and the bore through the sleeve.

In some implementations, the holder includes a mouthpiece that defines a portion of a bore, a main body portion that defines a chamber, and a sleeve that is slidably disposed within the chamber. The sleeve may include fingers that extend towards the receiving end of the holder and define a socket therebetween. The finger may have an expanded configuration in which the socket is configured to accept a proximal section of a cartridge and a compressed configuration in which the fingers are configured to engage the proximal section of the cartridge to secure the cartridge to the holder.

In certain implementations, the sleeve has a loading position in which the fingers are in the expanded configuration and a lighting position proximal of the loading position in which the fingers are in the compressed configuration. In the loading position of the sleeve, the fingers may extends distally from the chamber and in the lighting position of the sleeve, the fingers may be are disposed at least partially within the chamber with a wall defining the chamber urging the fingers inward from the expanded configuration. The fingers may be configured to draw the cartridge proximally as the sleeve slides from the loading position to the lighting position. In the lighting position of the sleeve, the fingers may be configured to secure the cartridge to the holder with a heat source of the cartridge extending beyond a receiving end of the holder.

In particular implementations, the main body portion defines a slot that extends through an outer wall thereof and is in communication with the chamber. The slot may have a first leg, a second leg, and a transverse leg. The first and second legs may extend in a direction parallel to one another and parallel to a longitudinal axis of the holder. The first and second legs may be radially offset relative to one another about the outer wall of the main body portion. The second leg may be longitudinally offset proximal of the first leg. The transverse leg may extend in a direction about the outer wall that is perpendicular to the first and second legs to interconnect the first and second legs.

In some implementations, the holder includes a slide that extends through the slot and is coupled to the sleeve. The sleeve may be configured to slide and rotate within the chamber in cooperation with the slide. In the loading configuration of the holder, the slide may be at a distal end of the first leg and the sleeve may be in a distal loading position with the fingers in the expanded configuration. In the lighting configuration of the holder, the slide may be longitudinally aligned with a proximal end of the first leg or a distal end of the second leg and the sleeve may be in a lighting position proximal of the loading position with the finger in the compressed configuration. In a received configuration of the holder, the slide may be at a proximal end of the second leg and the sleeve may be in a received position proximal of the lighting position with the fingers in the compressed configuration. The sleeve may be rotated about the longitudinal axis of the holder between the loading and received positions thereof. In the lighting configuration, the slide may be positioned within the transverse leg.

In particular implementations, the mouthpiece is releasably coupled to the main body portion. The holder may have a snub configuration in which the mouthpiece is secured to a distal section of the main body portion. In the snub configuration, the mouthpiece may be configured to be disposed over a heat source of a cartridge secured within the socket.

In certain implementations, the main body portion includes an inner barrel that forms a distal section thereof. The holder may include an outer barrel that is rotatably disposed over the inner barrel. The main body portion may define a slot that extends through the inner barrel and is in communication with the chamber. The slot may extend in a direction parallel to a longitudinal axis of the holder. The outer barrel may define a longitudinal chase that extends therethrough and in a direction parallel to the longitudinal axis of the holder. The outer barrel may also define a transverse chase that extends therethrough from a proximal end of the longitudinal chase in a direction about the outer barrel perpendicular to the longitudinal chase. The holder may include a slide that is secured to the sleeve and extends through the slot and the longitudinal chase or the transverse chase.

In some implementations, in a loading configuration of the holder, the slide is positioned at a distal end of the slot and a distal end of the longitudinal chase with the sleeve in a distal position such that the fingers are in the expanded configuration. In the lighting configuration of the holder, the slide may be positioned at a proximal end of the slot and a proximal end of the longitudinal chase with the sleeve in a proximal position such that the fingers are in the compressed configuration. In the received configuration of the holder, the slide may be positioned at a proximal end of the slot and within the transverse chase radially spaced apart from the longitudinal chase with the sleeve in the proximal position such that the fingers are in the compressed configuration.

In particular implementations, the inner barrel includes an inner cover at a distal end thereof and the outer barrel includes an outer cover at a distal end thereof. One or more of the inner cover or the outer cover comprises the receiving end. The inner cover may enclose a radial portion of a channel that is configured to receive a cartridge therein and the outer cover may enclose a radial portion of the channel. In the lighting configuration of the holder, the inner cover may be nested within the outer cover such that a radial portion of the channel is enclosed by the inner and outer covers and a radial portion of the channel opposite the inner and outer covers is open. In the received configuration of the holder, the inner and outer covers may oppose one another to radially enclose the channel. In the lighting and received configuration of the holder, the outer wall of the outer barrel may be flush within an outer wall of the main body portion.

In some implementations, the main body portion includes an inner barrel and a fixed cover. The inner barrel may define a distal portion of a channel that is positioned distal of the chamber. The fixed cover may extend distally from the inner barrel and enclose a radial portion of the channel. The channel may be configured to receive a cartridge therein. The fixed cover may radially enclose between 45 degrees and 315 degrees of the channel. The holder may include a movable cover that is opposed to the fixed cover. One or more of the fixed cover or the movable cover comprises the receiving end. The movable cover may enclose a radial portion of the channel. The movable cover may have an extend position in which the movable cover and the fixed cover radially enclose the channel therebetween. The movable cover may have a retracted position proximal of the extended position in which a portion of the channel is opposite the fixed cover and beyond a distal end of the movable cover is open. The holder may include a slide mechanism that is configured to translate the movable cover between the retracted and extended positions.

In particular implementations, in a loading configuration of the holder, the sleeve is in a loading position with the fingers in the expanded configuration and the movable cover is in the retracted position. In the lighting configuration of the holder, the sleeve may be in a lighting position proximal of the loading position with the fingers in the compressed configuration and the movable cover in the retracted position. In the received configuration of the holder, the sleeve may be in a received position proximal of the lighting position with the fingers in the compressed configuration and the movable cover in the extended position. The sleeve may engage the slide mechanism between the lighting position and the received position to transition the movable cover between the retracted position and the extended position. The slide mechanism may be configured to bias the movable cover to the retracted position when the movable cover is between the retracted position and the extended position and to maintain the movable cover in the extended position.

These and other features, aspects, and advantages of the disclosure will be apparent from a reading of the following detailed description together with the accompanying drawings, which are briefly described below.

BRIEF DESCRIPTION OF THE DRAWINGS

Figure 1:
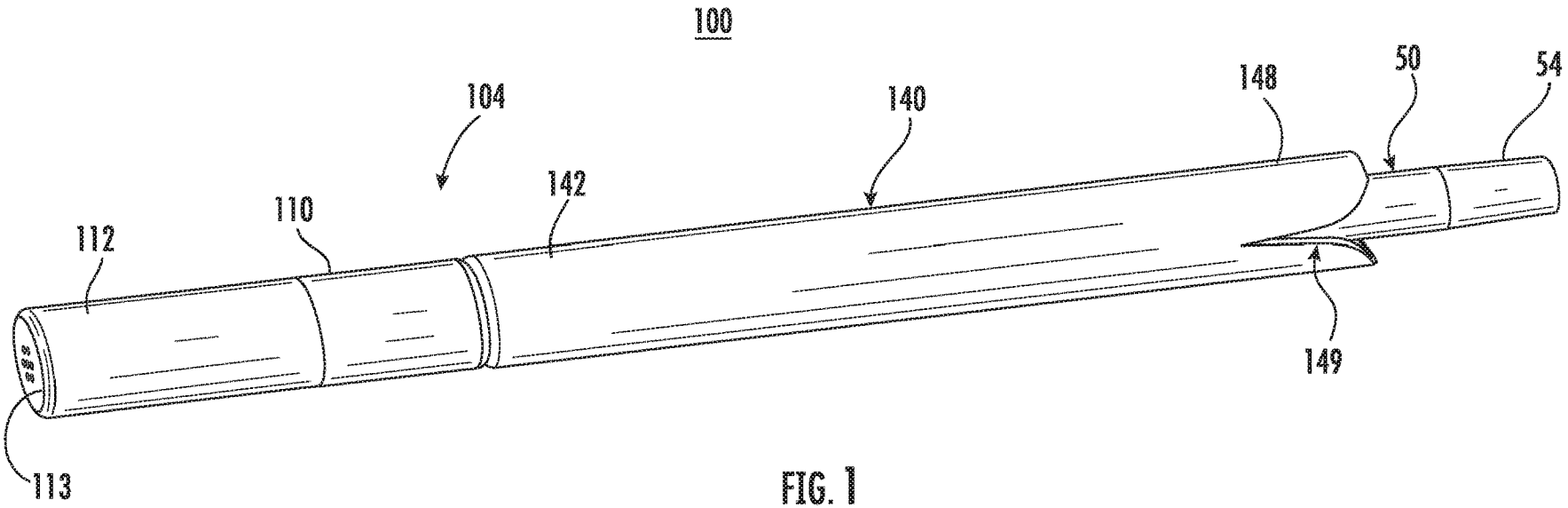
Figure 2:
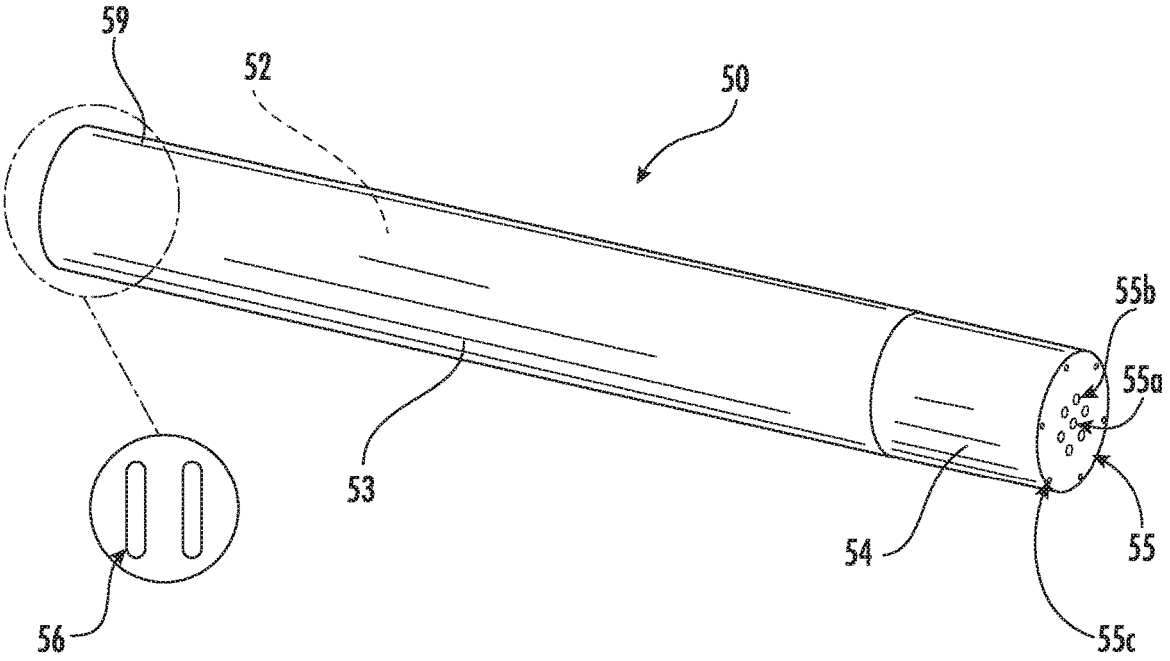
Figure 3:
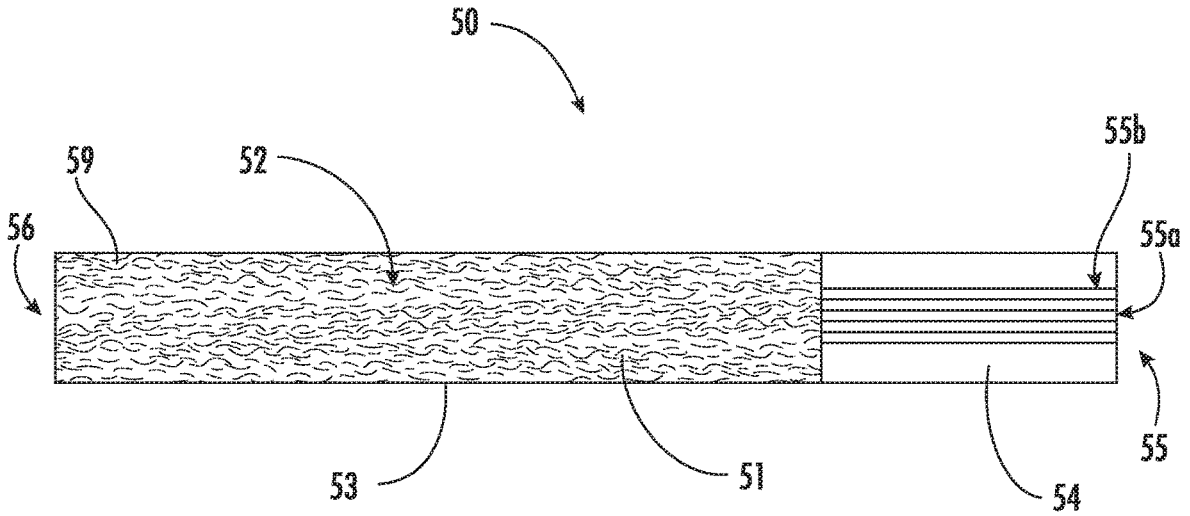
Figure 4:
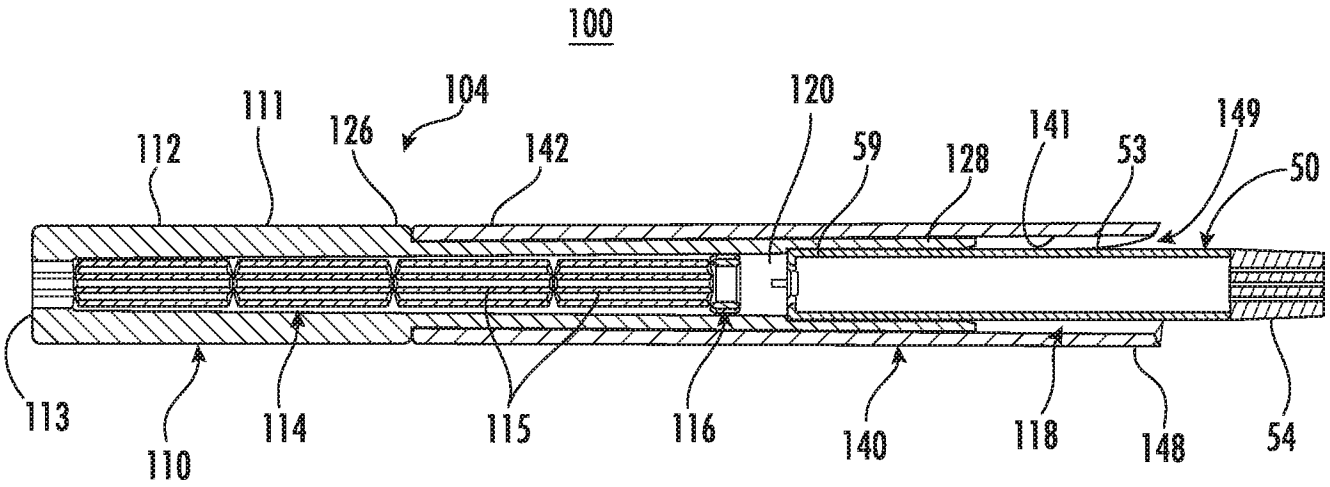
Figure 5:
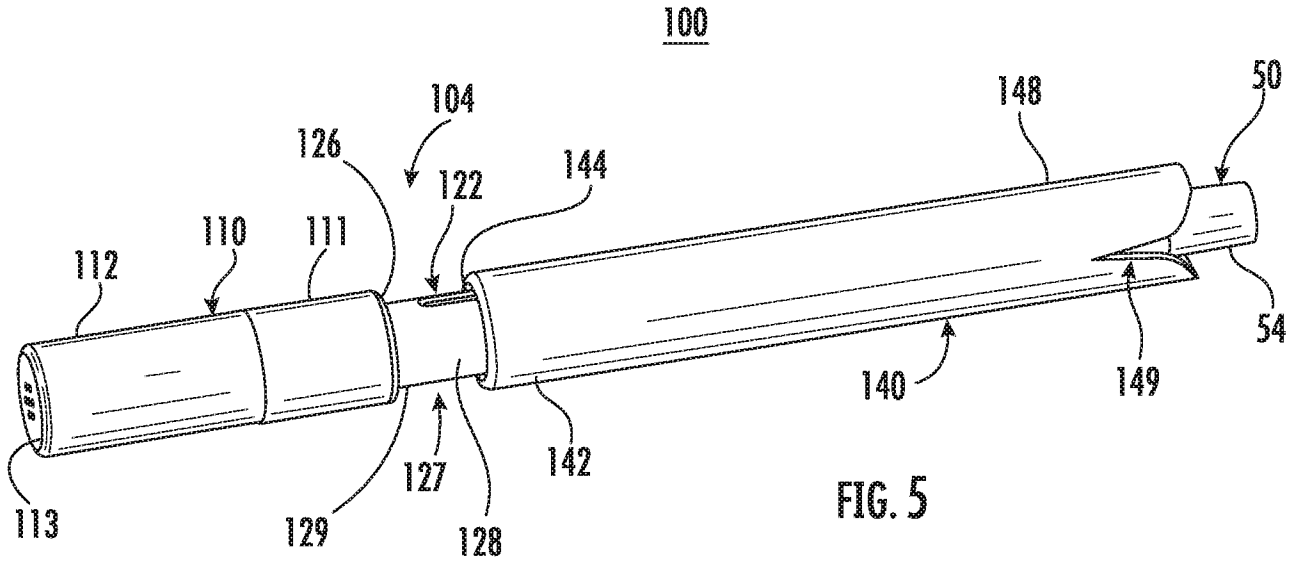
Figure 6:
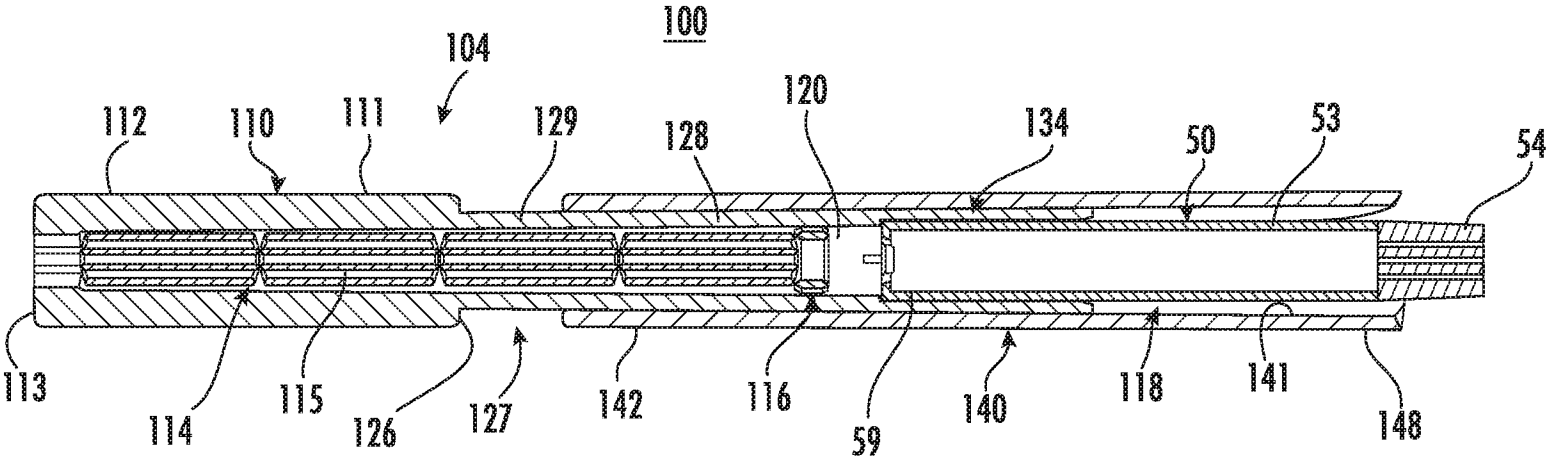
Figure 7:
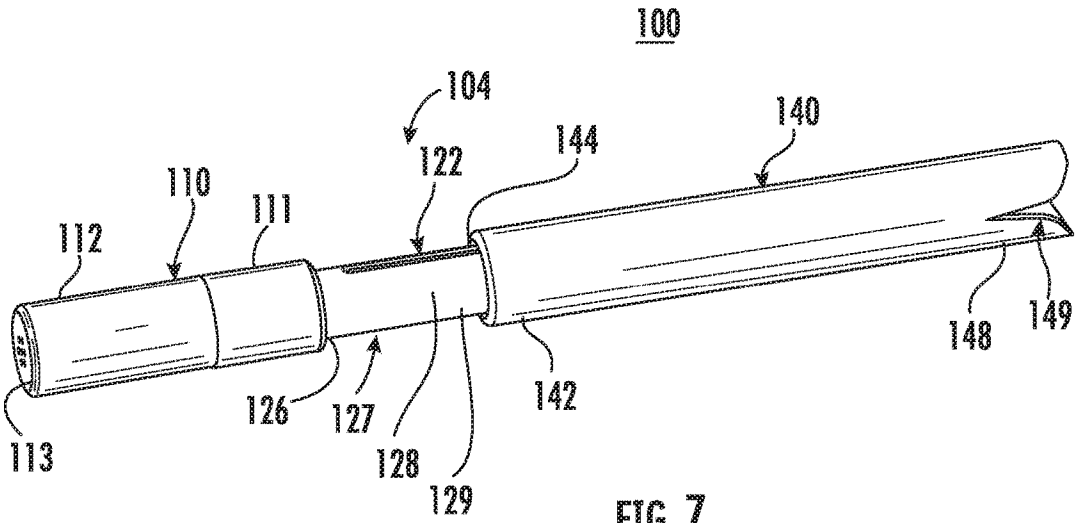
Figure 8:
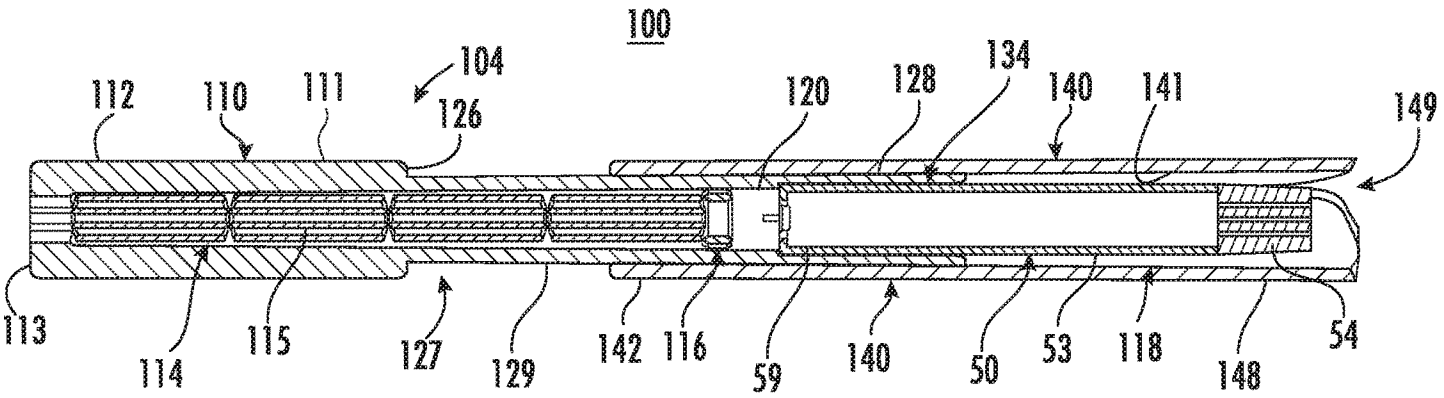
Figure 9:
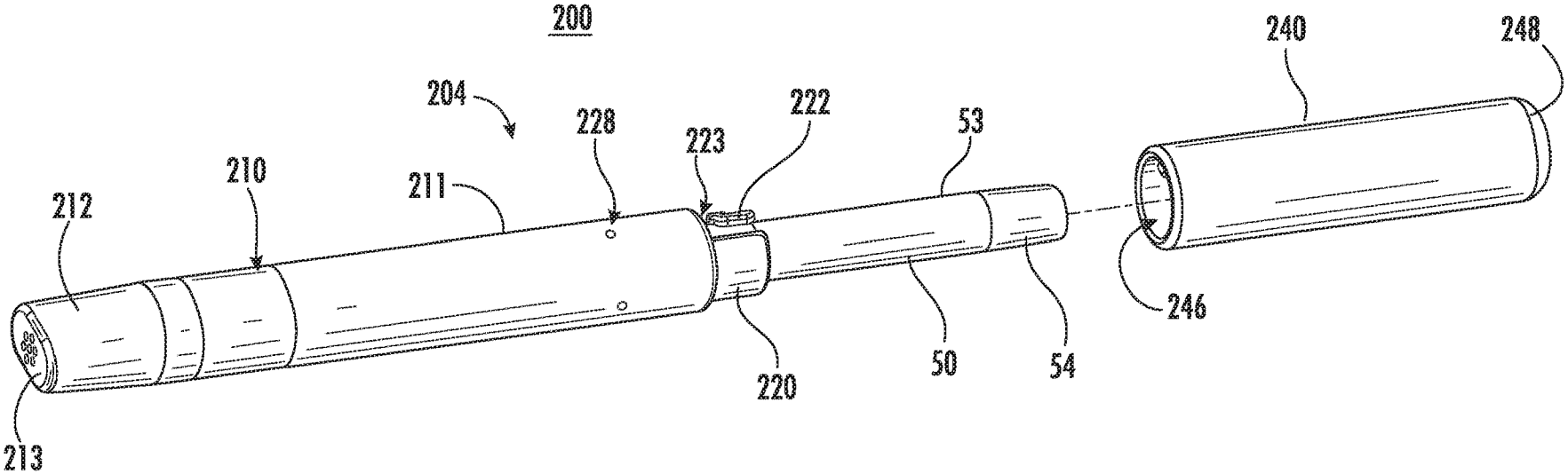
Figure 10:
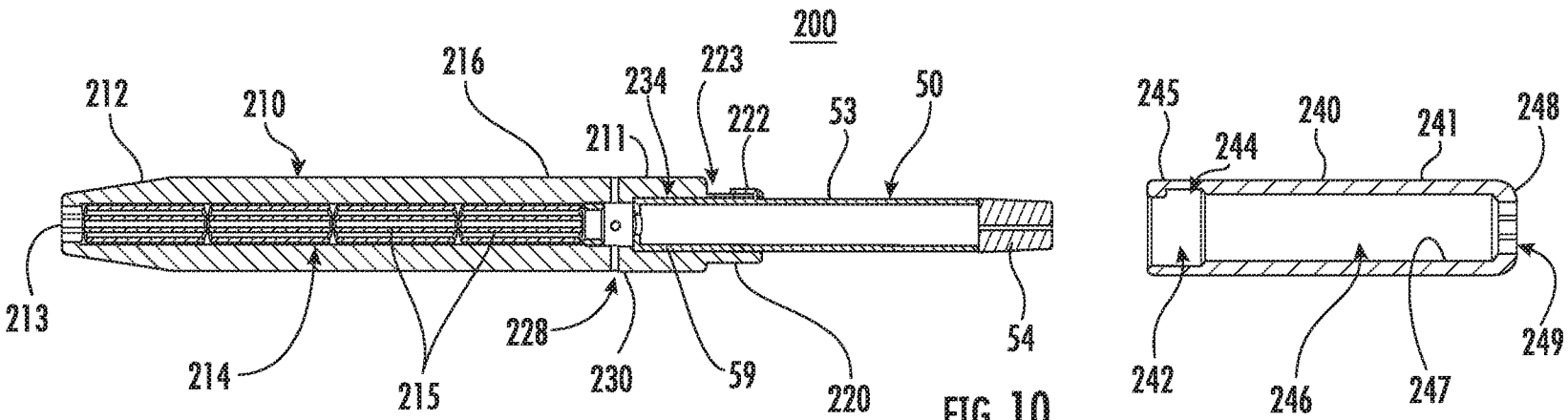
Figure 11:
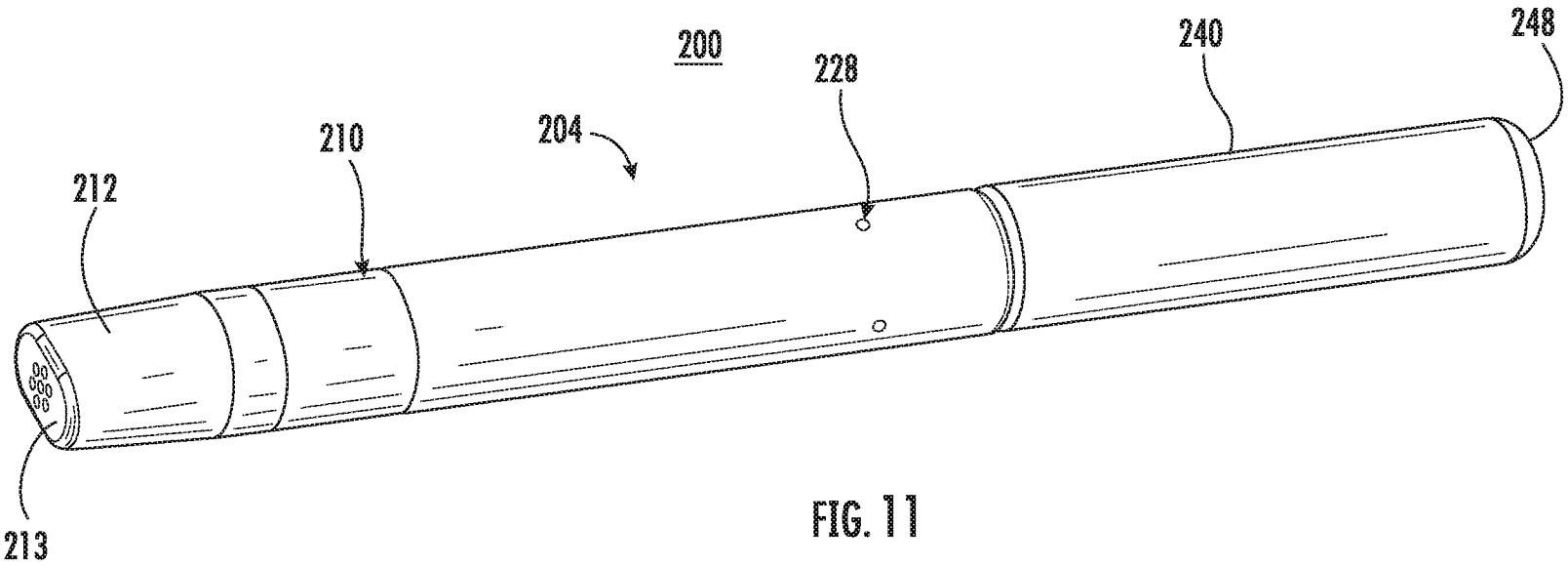
Figure 12:
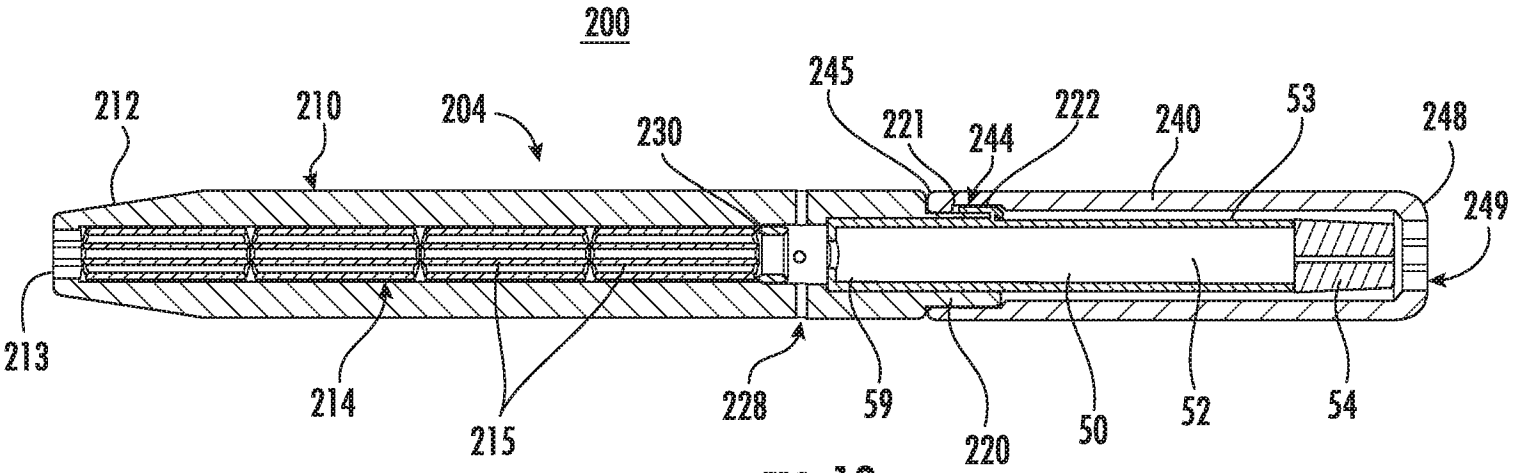
Figure 13:
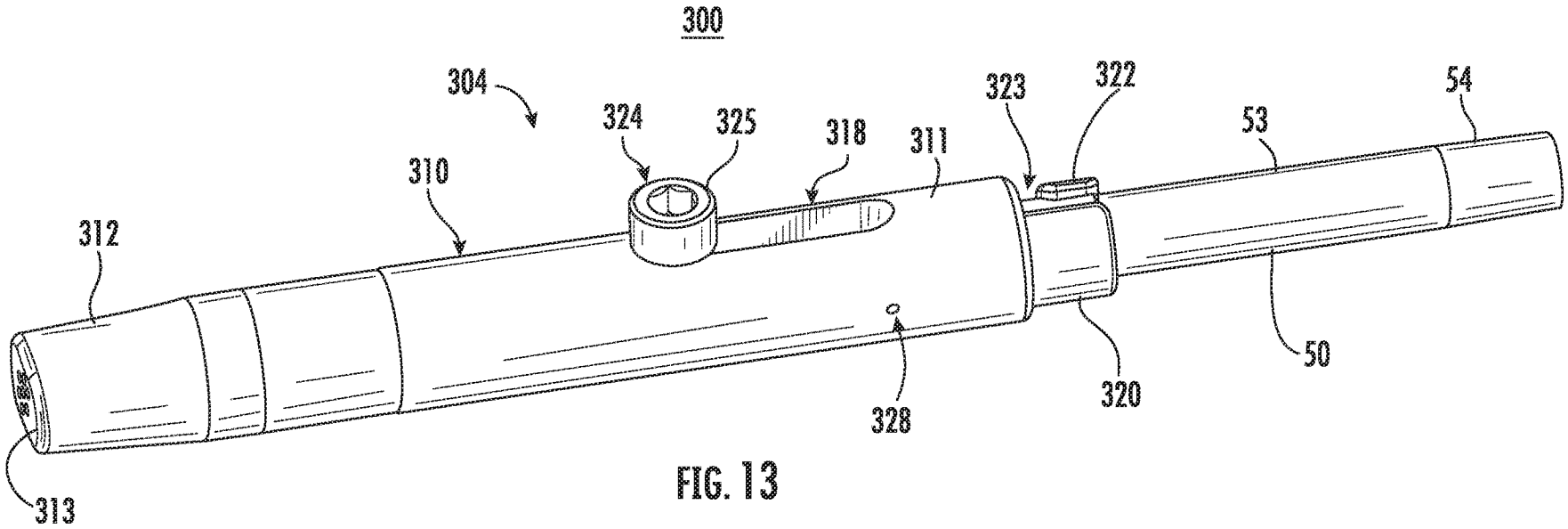
Figure 14:
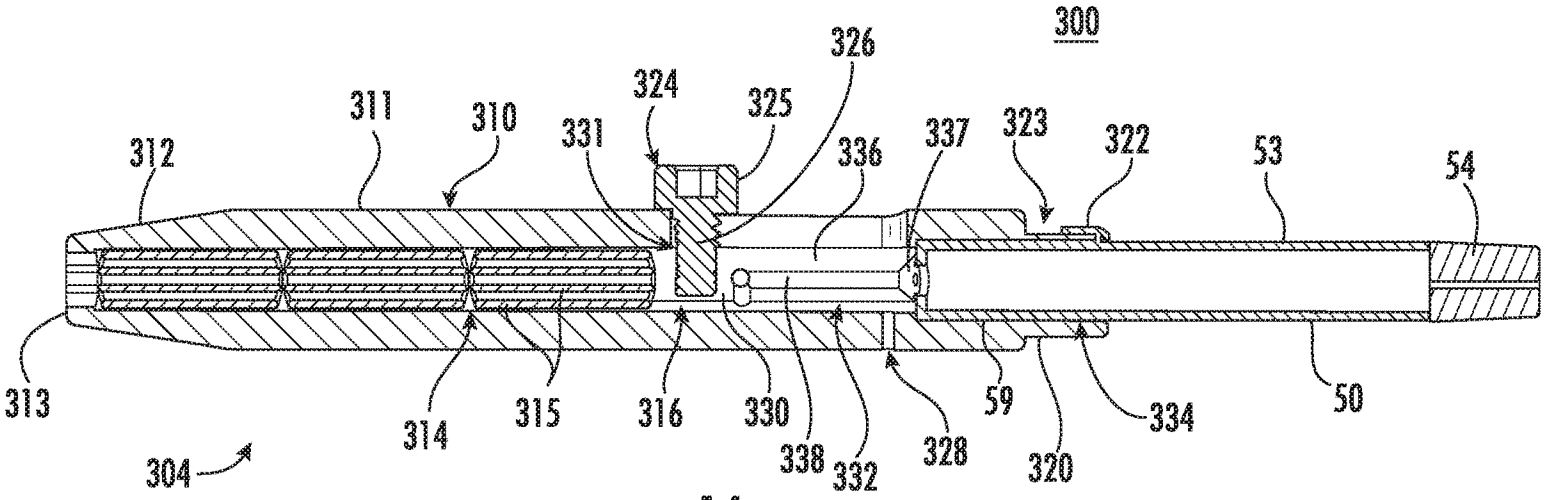
Figure 15:
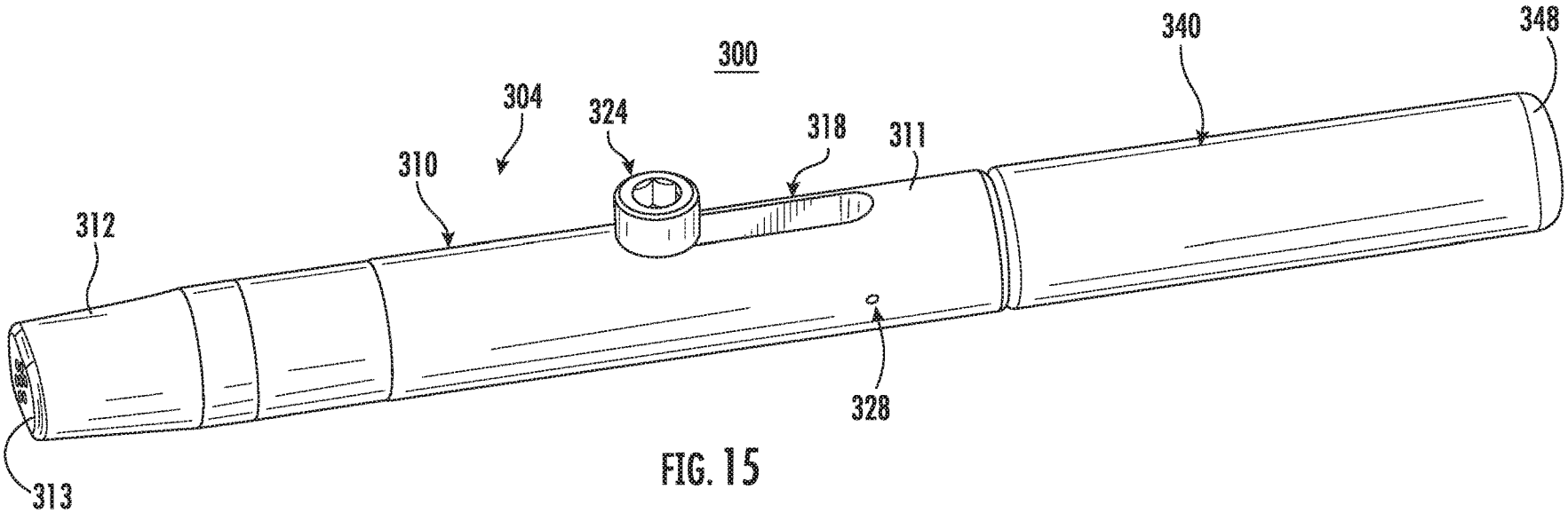
Figure 16:
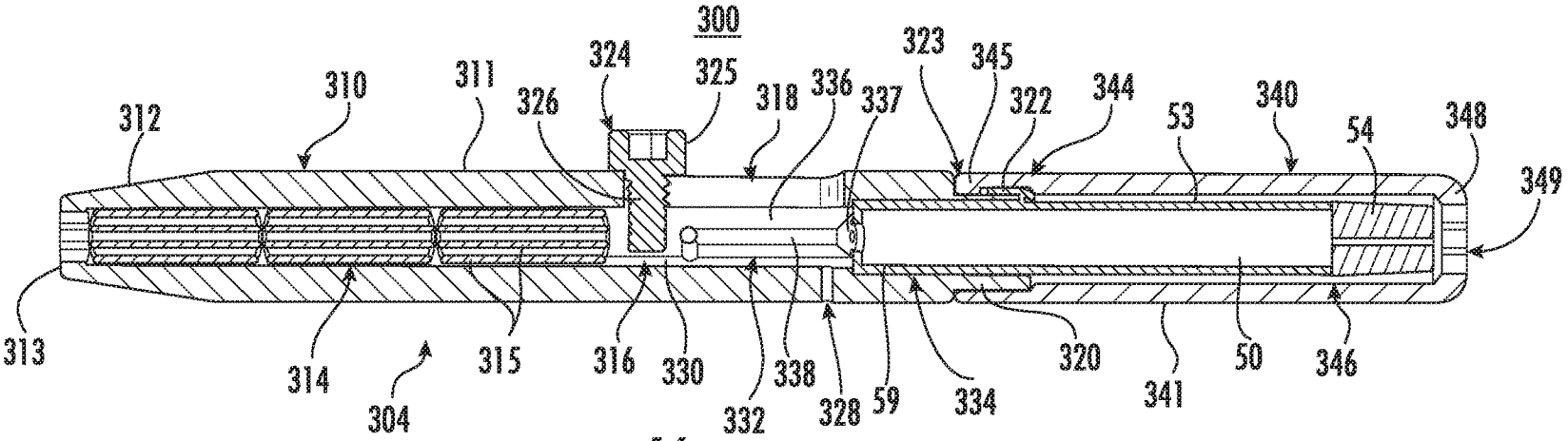
Figure 17:
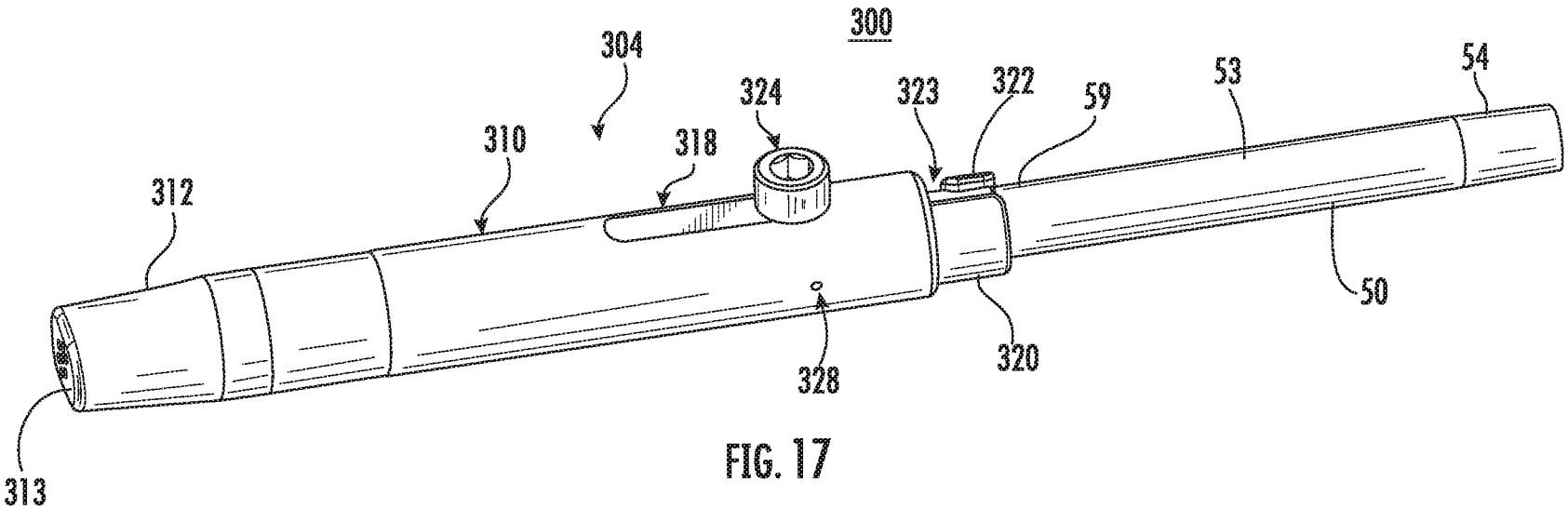
Figure 18:
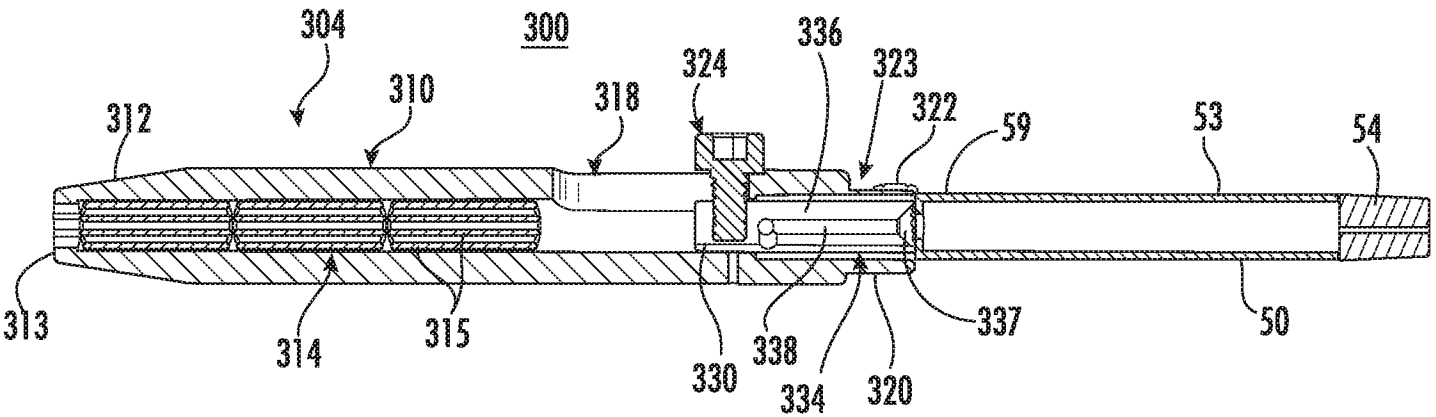
Figure 19:
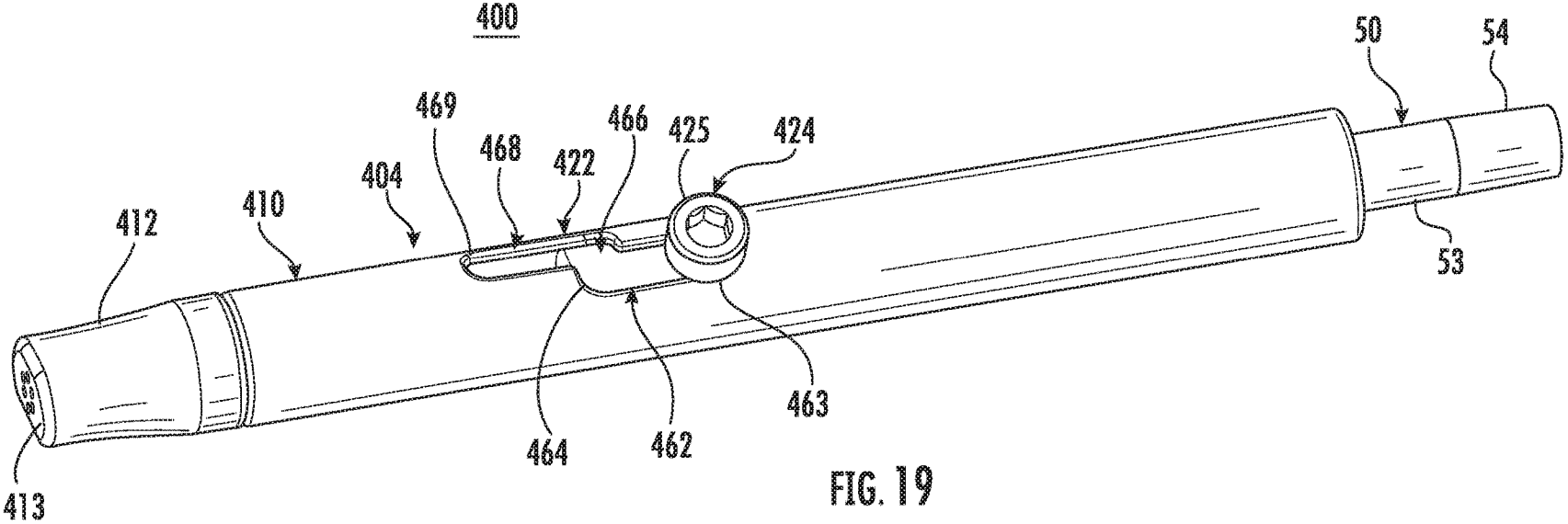
Figure 20:
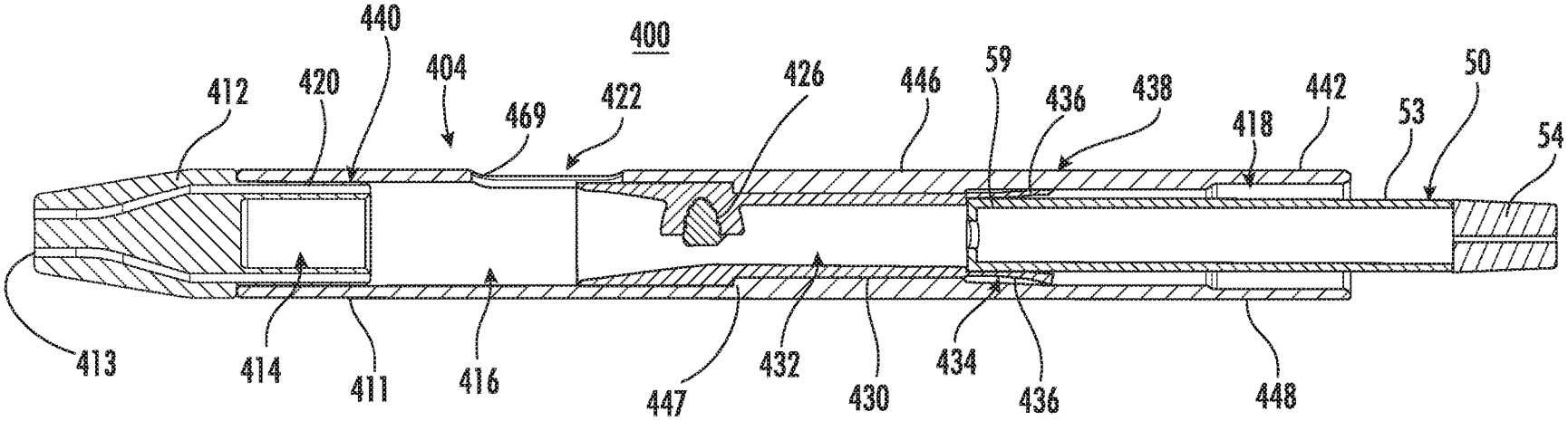
Figure 21:
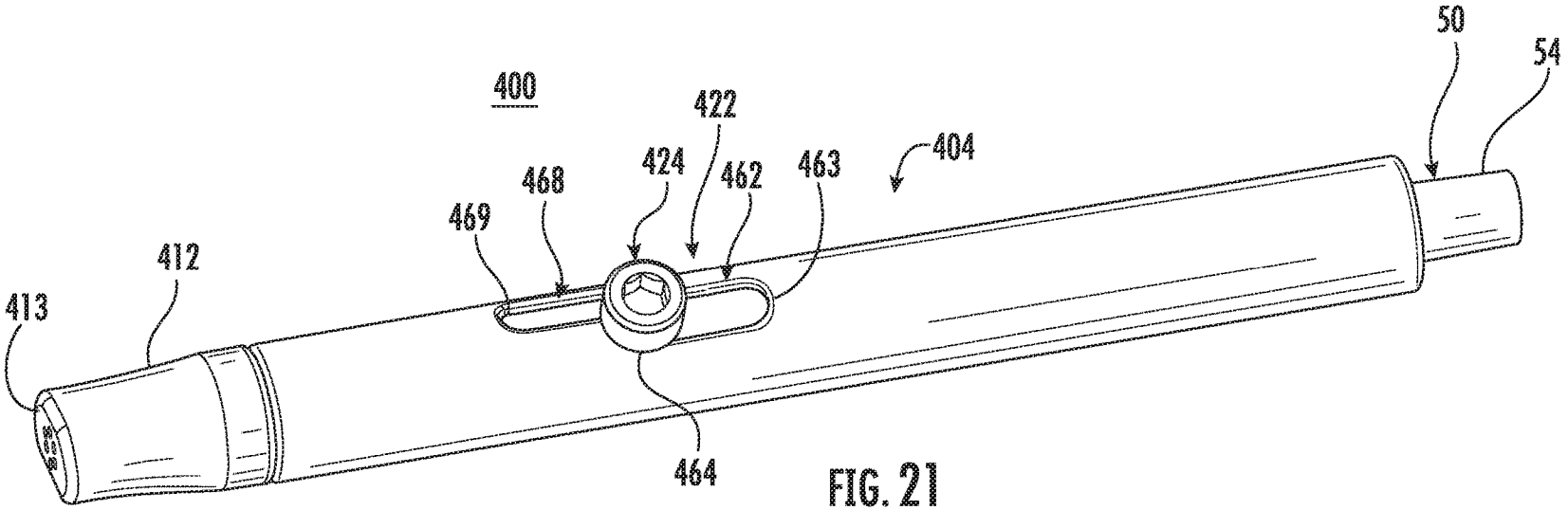
Figure 22:
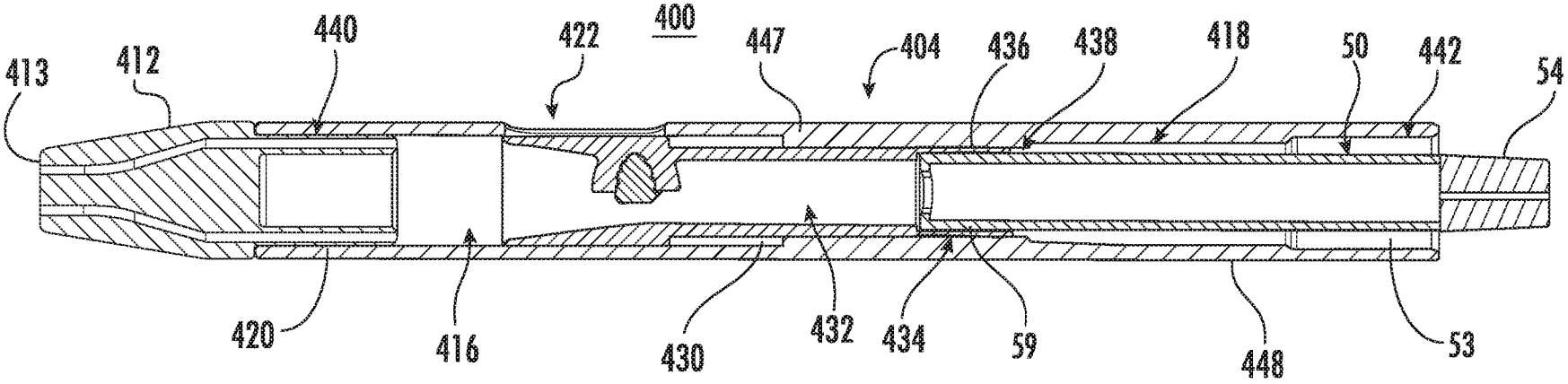
Figure 23:
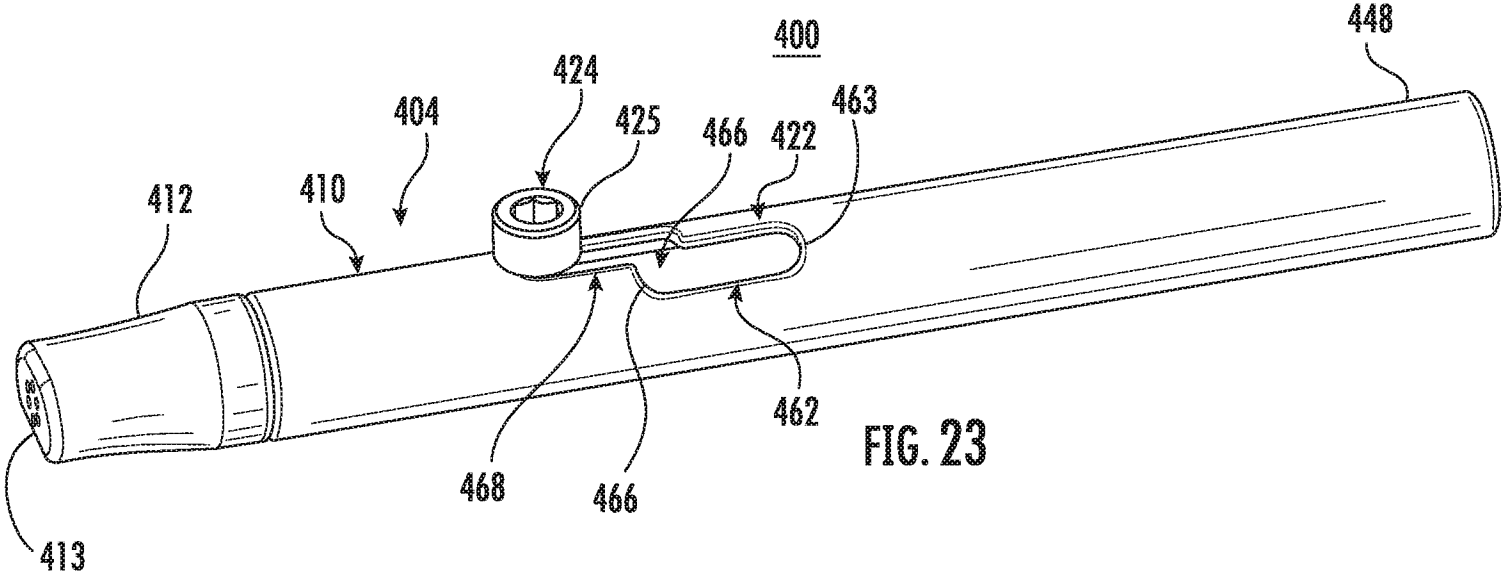
Figure 24:
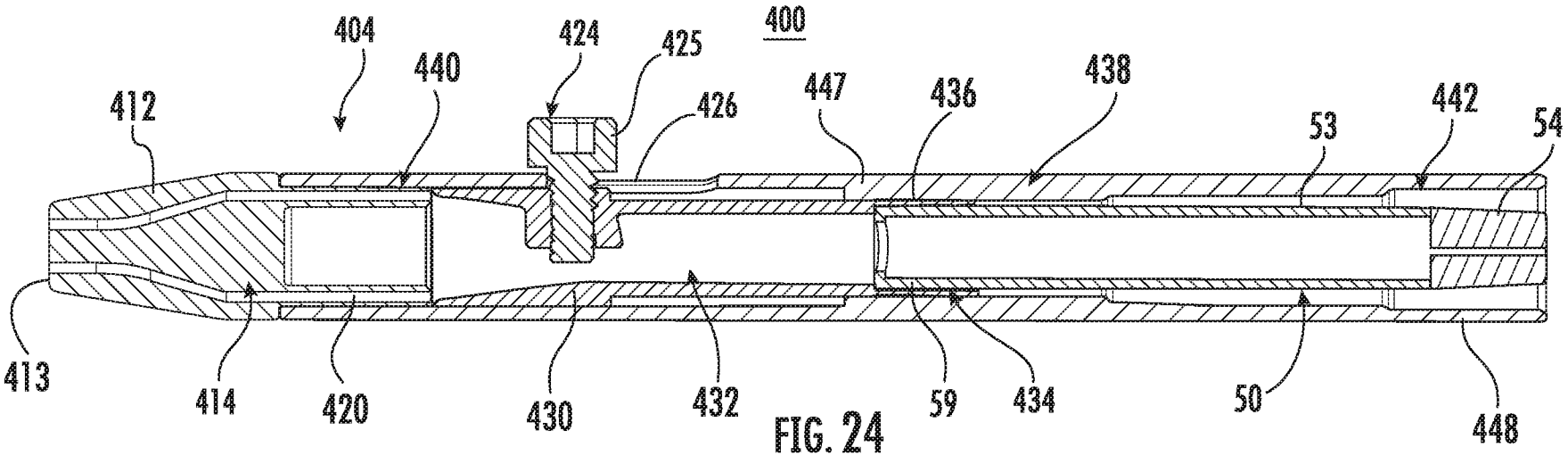
Figure 25:
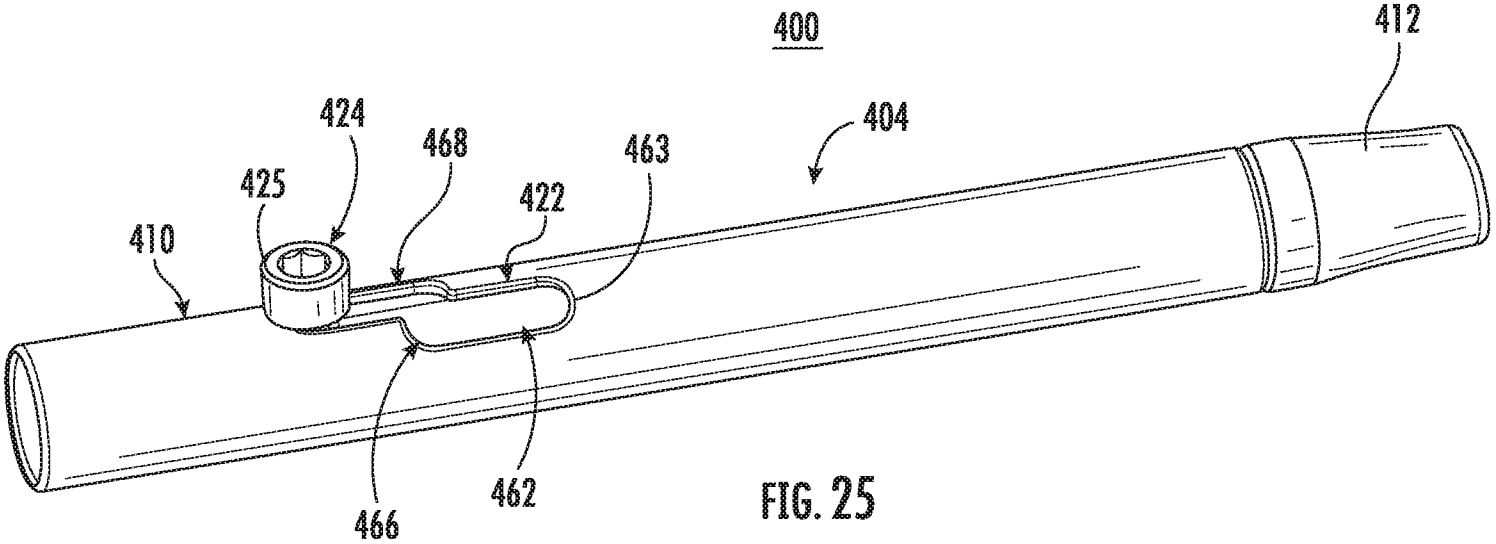
Figure 26:
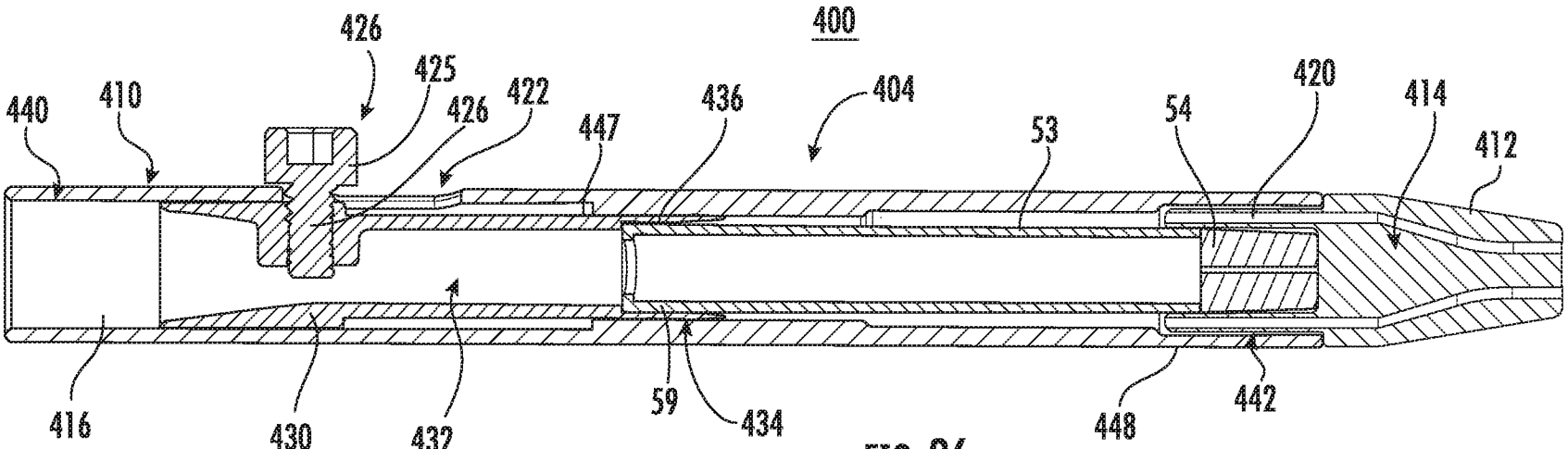
Figure 27:
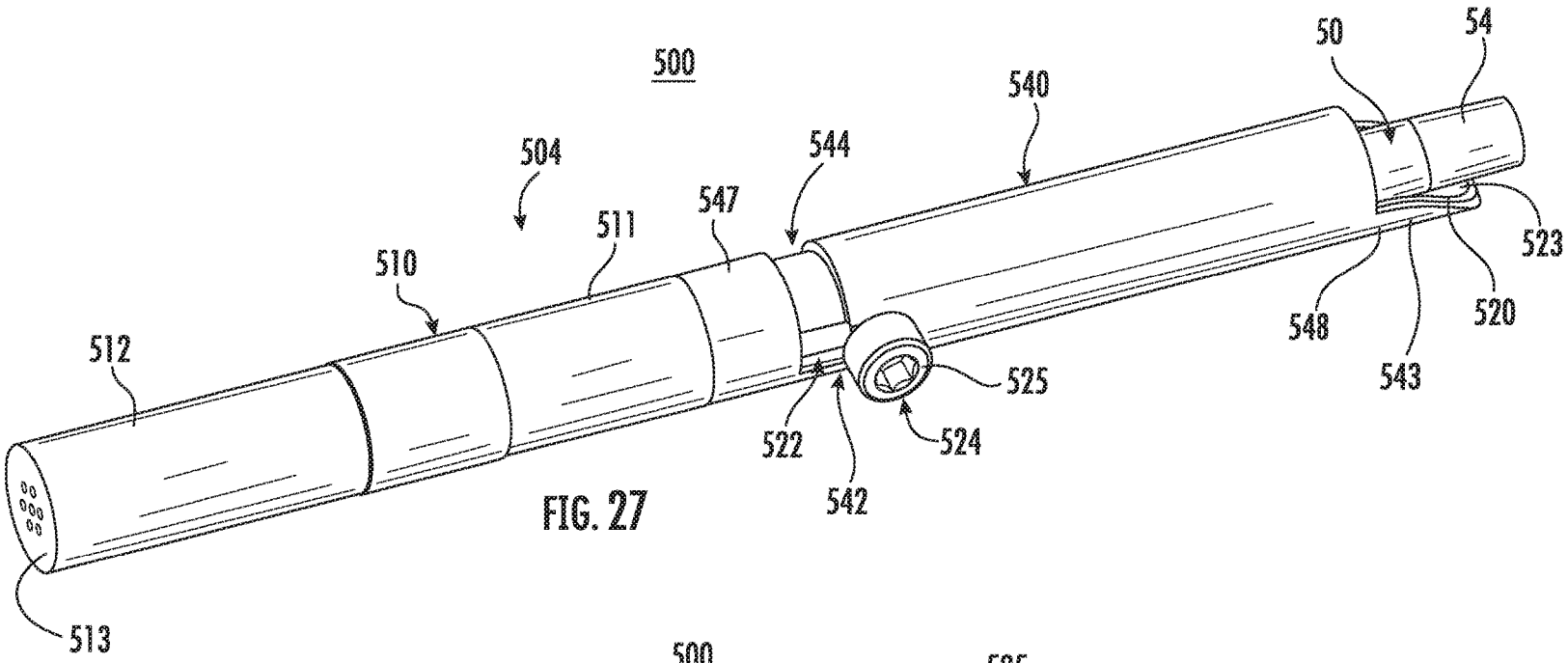
Figure 28:
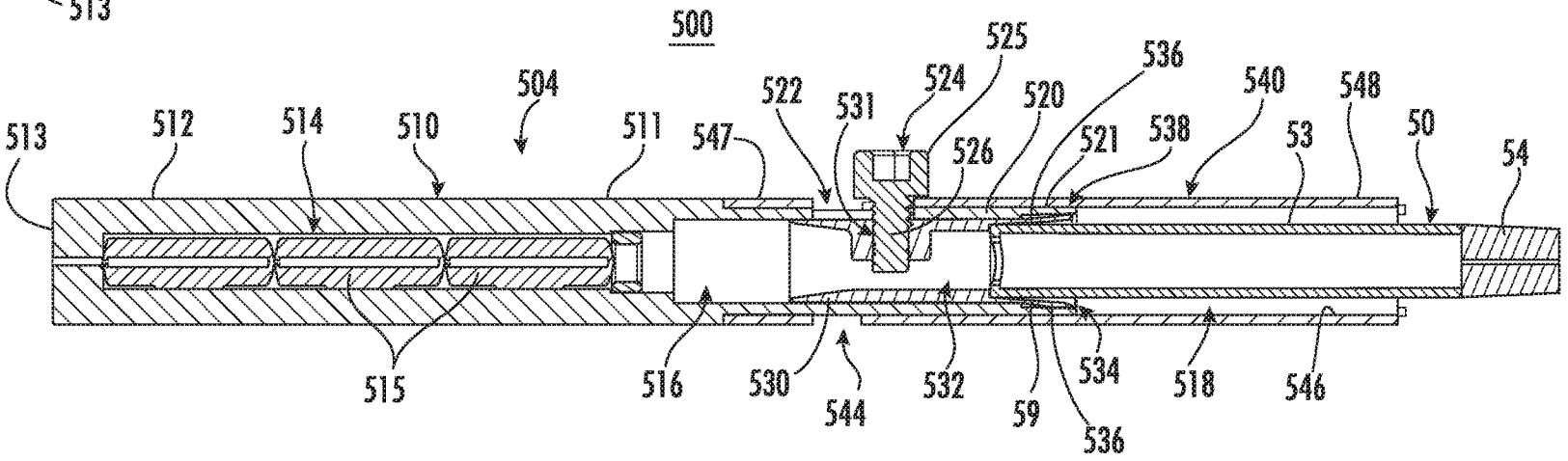
Figure 29:
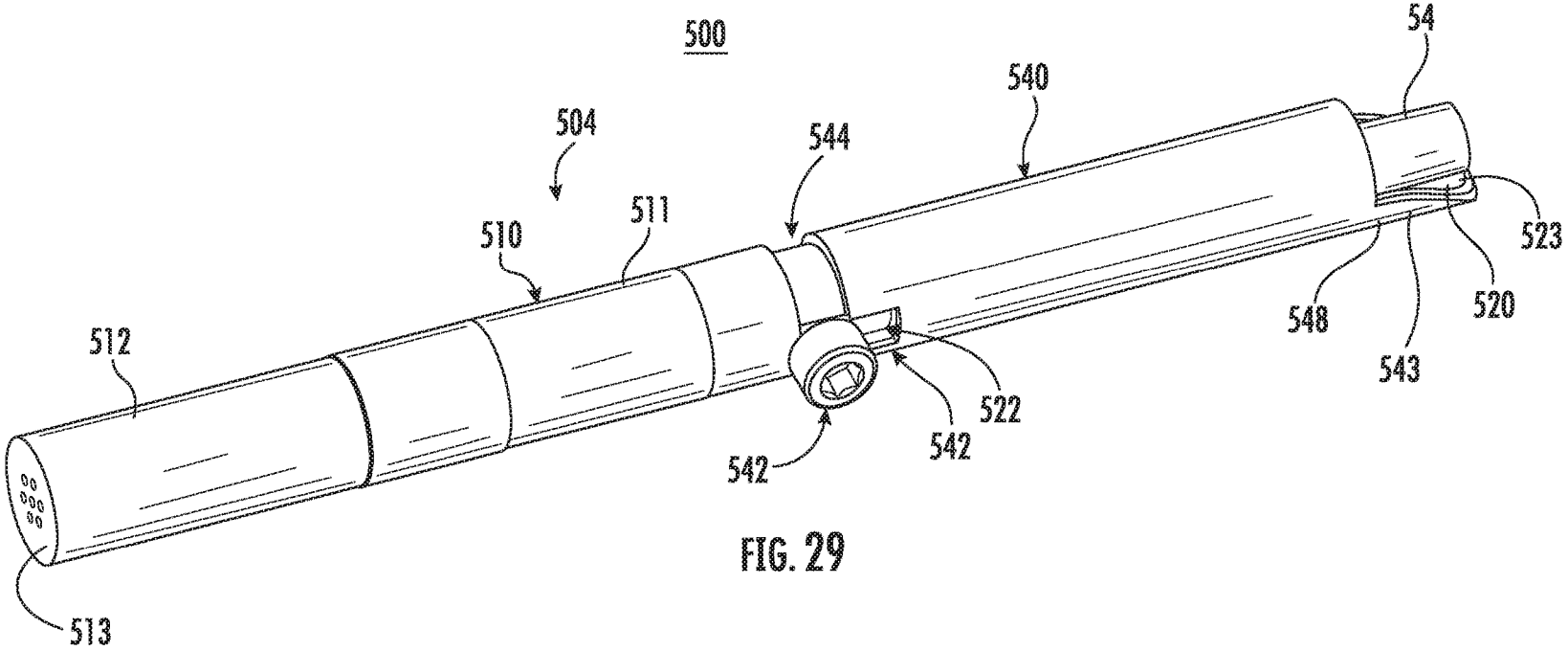
Figure 30:
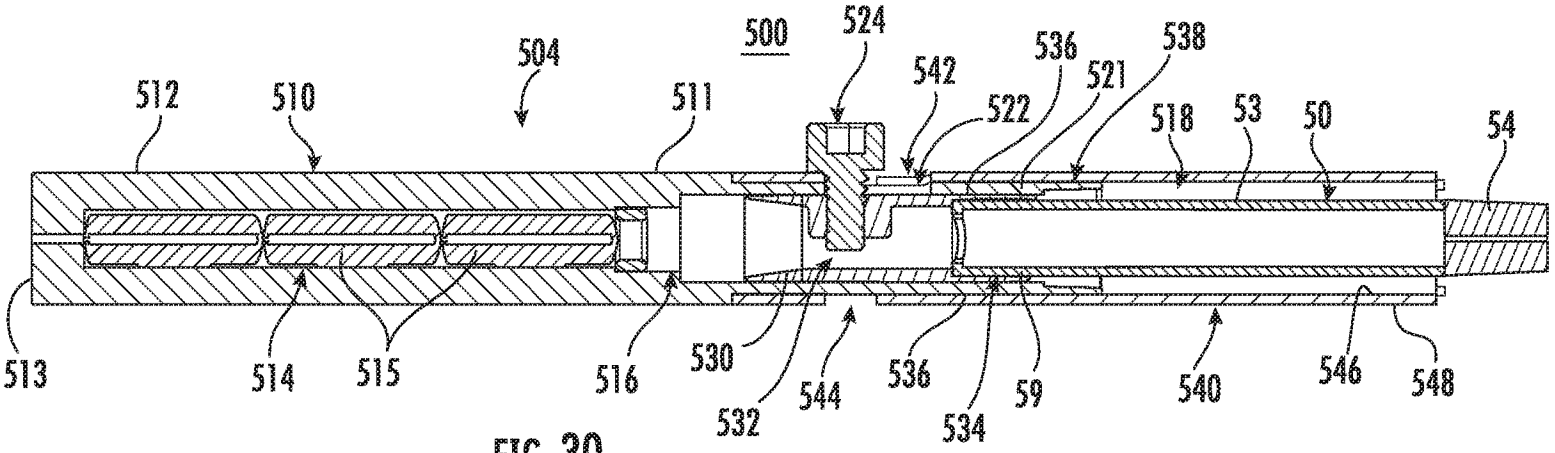
Figure 31:
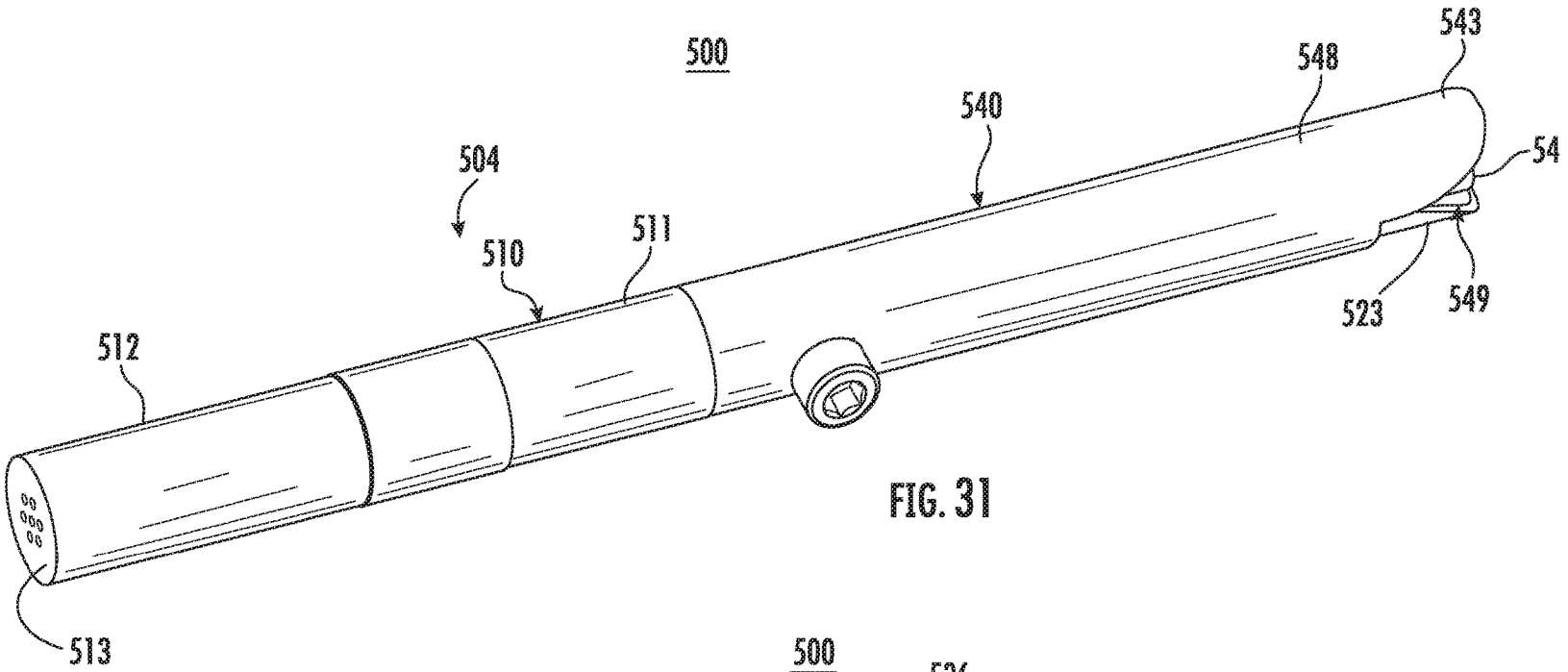
Figure 32:
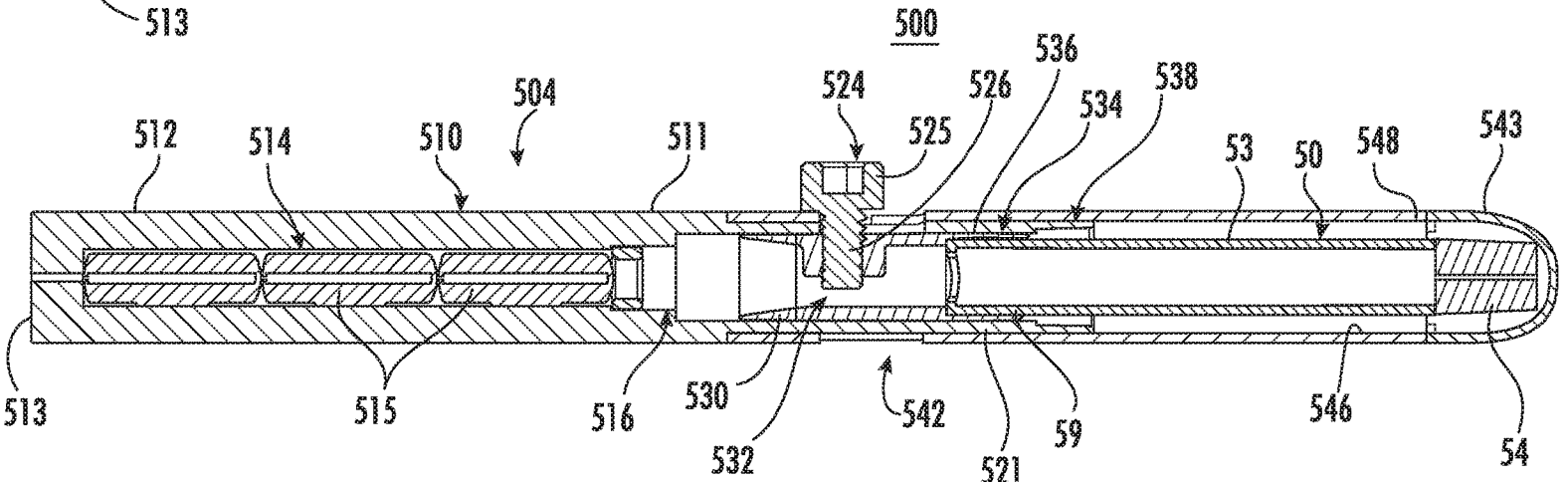
Figure 33:
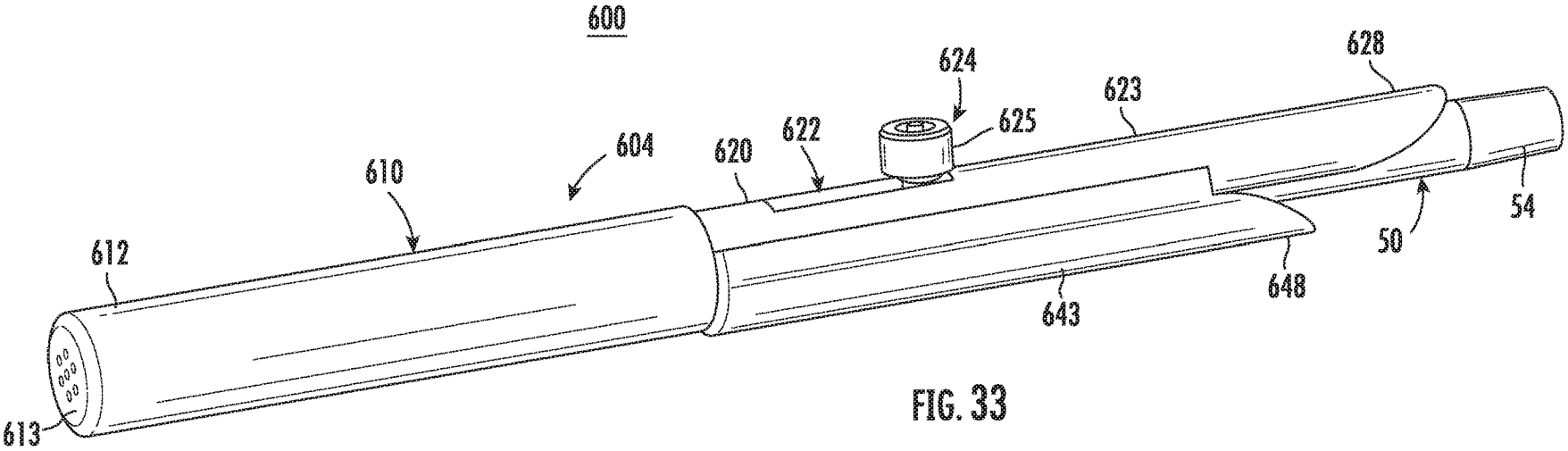
Figure 34:
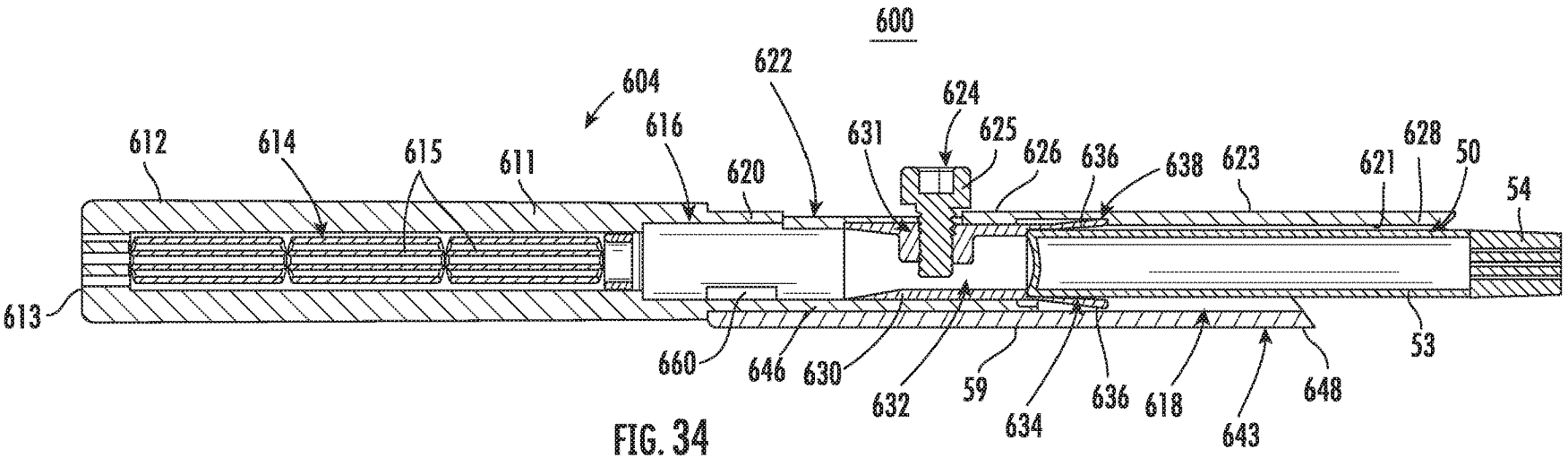
Figure 35:
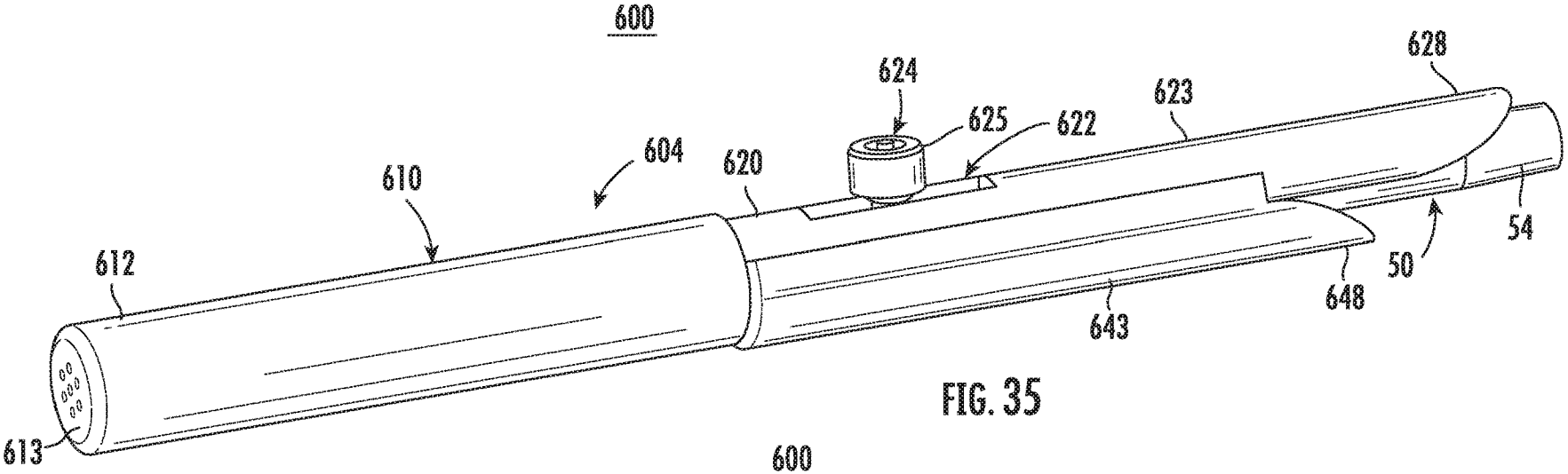
Figure 36:
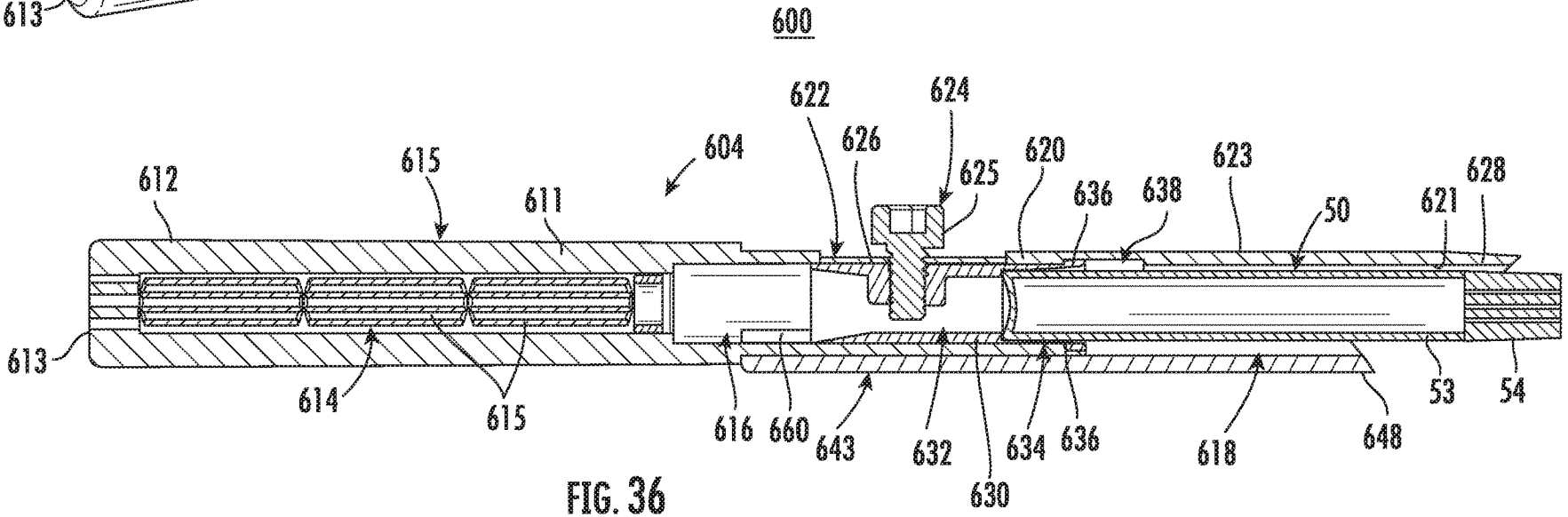
Figure 37:
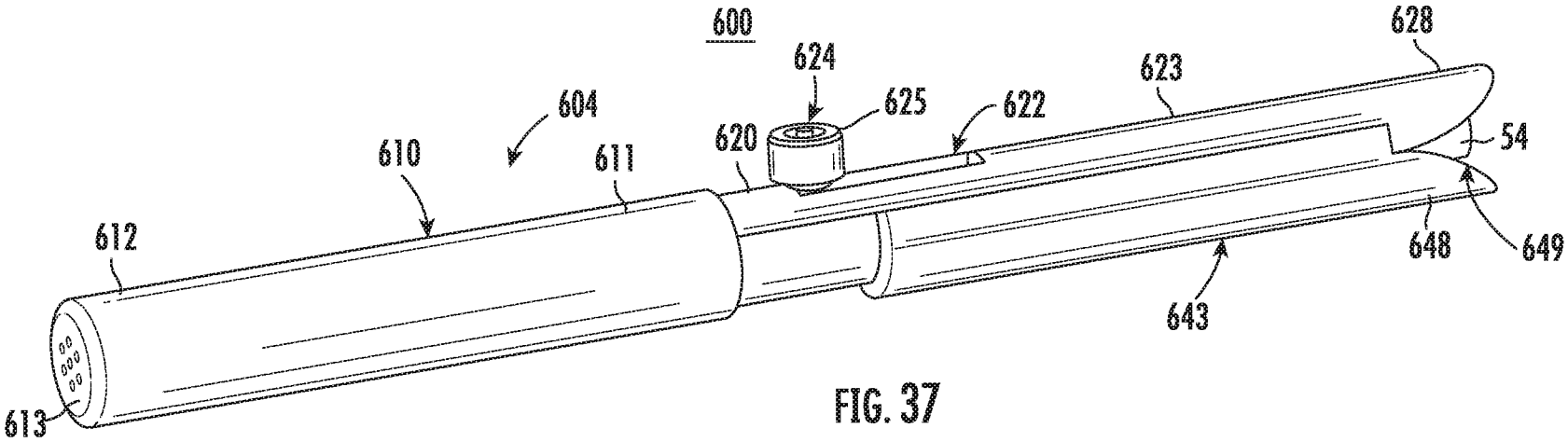
Figure 38:
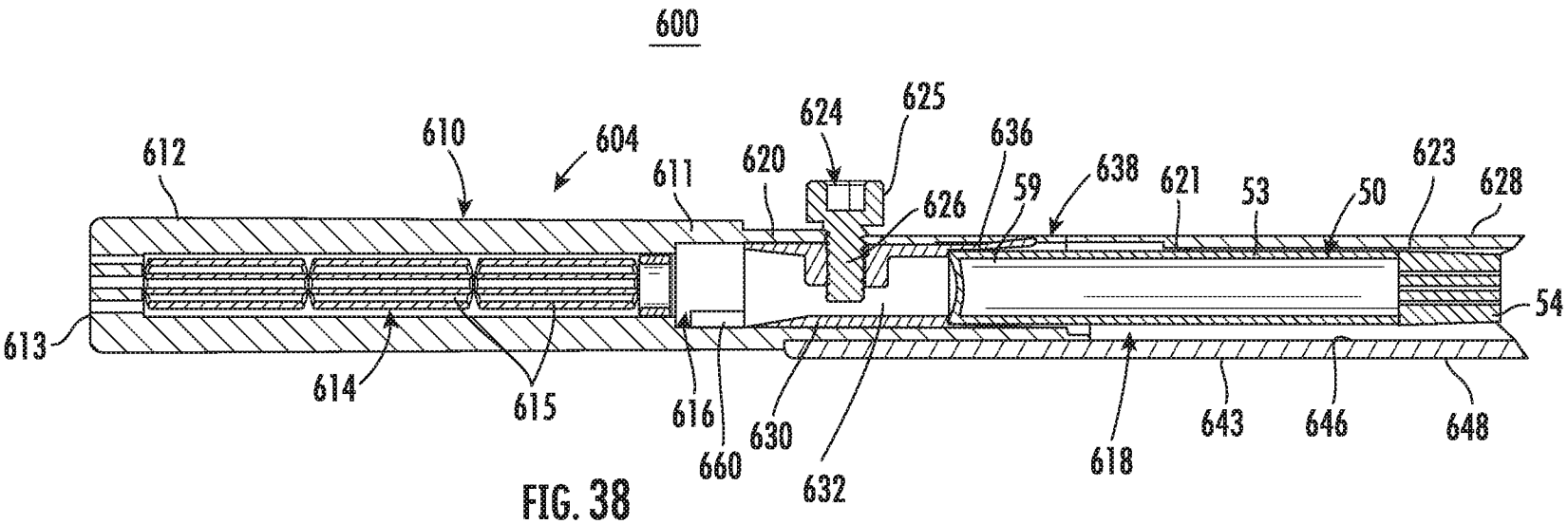

Having thus described the disclosure in the foregoing general terms, reference will now be made to the accompanying drawings, which are not necessarily drawn to scale, and wherein:

FIG. 1 illustrates a perspective view of a smoking article that includes a holder and a detachable cartridge, according to an implementation of the present disclosure with the holder in a loading configuration;

FIG. 2 illustrates a perspective view of the cartridge of FIG. 1, according to an implementation of the present disclosure;

FIG. 3 illustrates a longitudinal cross-sectional view of the cartridge of FIG. 2;

FIG. 4 illustrates a longitudinal cross-sectional view of the smoking article of FIG. 1;

FIG. 5 illustrates a perspective view of the smoking article of FIG. 1 in a lighting configuration;

FIG. 6 illustrates a longitudinal cross-sectional view of the smoking article of FIG. 5;

FIG. 7 illustrates a perspective view of the smoking article of FIG. 1 in a received configuration;

FIG. 8 illustrates a longitudinal cross-sectional view of the smoking article of FIG. 7;

FIG. 9 illustrates a perspective view of another smoking article that includes a holder and the detachable cartridge of FIG. 2, according to an implementation of the present disclosure with the holder in a loading configuration;

FIG. 10 illustrates a longitudinal cross-sectional view of the smoking article of FIG. 9;

FIG. 11 illustrates a perspective view of the smoking article of FIG. 9 in a received configuration;

FIG. 12 illustrates a longitudinal cross-sectional view of the smoking article of FIG. 11;

FIG. 13 illustrates a perspective view of another smoking article that includes a holder and the detachable cartridge of FIG. 2, according to an implementation of the present disclosure with the holder in a loading configuration;

FIG. 14 illustrates a longitudinal cross-sectional view of the smoking article of FIG. 13;

FIG. 15 illustrates a perspective view of the smoking article of FIG. 13 in a received configuration;

FIG. 16 illustrates a longitudinal cross-sectional view of the smoking article of FIG. 15;

FIG. 17 illustrates a perspective view of the smoking article of FIG. 13 in an ejecting configuration;

FIG. 18 illustrates a longitudinal cross-sectional view of the smoking article of FIG. 17;

FIG. 19 illustrates a perspective view of another smoking article that includes a holder and the detachable cartridge of FIG. 2, according to an implementation of the present disclosure with the holder in a loading configuration;

FIG. 20 illustrates a longitudinal cross-sectional view of the smoking article of FIG. 19;

FIG. 21 illustrates a perspective view of the smoking article of FIG. 19 in a lighting configuration;

FIG. 22 illustrates a longitudinal cross-sectional view of the smoking article of FIG. 21;

FIG. 23 illustrates a perspective view of the smoking article of FIG. 19 in a received configuration;

FIG. 24 illustrates a longitudinal cross-sectional view of the smoking article of FIG. 23;

FIG. 25 illustrates a perspective view of the smoking article of FIG. 19 in a snub configuration;

FIG. 26 illustrates a longitudinal cross-sectional view of the smoking article of FIG. 25;

FIG. 27 illustrates a perspective view of another smoking article that includes a holder and the detachable cartridge of FIG. 2, according to an implementation of the present disclosure with the holder in a loading configuration;

FIG. 28 illustrates a longitudinal cross-sectional view of the smoking article of FIG. 27;

FIG. 29 illustrates a perspective view of the smoking article of FIG. 27 in a lighting configuration;

FIG. 30 illustrates a longitudinal cross-sectional view of the smoking article of FIG. 29;

FIG. 31 illustrates a perspective view of the smoking article of FIG. 27 in a received configuration;

FIG. 32 illustrates a longitudinal cross-sectional view of the smoking article of FIG. 32;

FIG. 33 illustrates a perspective view of another smoking article that includes a holder and the detachable cartridge of FIG. 2, according to an implementation of the present disclosure with the holder in a loading configuration;

FIG. 34 illustrates a longitudinal cross-sectional view of the smoking article of FIG. 33;

FIG. 35 illustrates a perspective view of the smoking article of FIG. 33 in a lighting configuration;

FIG. 36 illustrates a longitudinal cross-sectional view of the smoking article of FIG. 35;

FIG. 37 illustrates a perspective view of the smoking article of FIG. 33 in a received configuration; and FIG. 38 illustrates a longitudinal cross-sectional view of the smoking article of FIG. 37.

DETAILED DESCRIPTION

The present disclosure will now be described more fully hereinafter with reference to example implementations thereof. These example implementations are described so that this disclosure will be thorough and complete, and will fully convey the scope of the disclosure to those skilled in the art. Indeed, the disclosure is embodied in many different forms and should not be construed as limited to the implementations set forth herein; rather, these implementations are provided so that this disclosure will satisfy applicable legal requirements. As used in the disclosure, and in the appended claims, the singular forms "a", "an", "the", include plural referents unless the context clearly dictates otherwise. As used in the disclosure, and in the appended claims, the term "proximal" refers to the portion of the device or component thereof that is closer to a user and the term "distal" refers to the portion of the device or component thereof that is farther from the user. Also, while reference may be made herein to quantitative measures, values, geometric relationships or the like, unless otherwise stated, any one or more if not all of these may be absolute or approximate to account for acceptable variations that may occur, such as those due to engineering tolerances or the like.

The present disclosure provides descriptions of articles (and the assembly and/or manufacture thereof) in which a material is heated (preferably without combusting the material to any significant degree) to form an aerosol and/or an inhalable substance; such articles may be sufficiently compact to be considered "hand-held" devices. In some aspects, the articles are characterized as smoking articles. As used herein, the term "smoking article" is intended to mean an article and/or device that provides many of the sensations (e.g., inhalation and exhalation rituals, types of tastes or flavors, organoleptic effects, physical feel, use rituals, visual cues such as those provided by visible aerosol, and the like) of smoking a cigarette, cigar, or pipe. As used herein, the term "smoking article" does not necessarily mean that, in operation, the article or device produces smoke in the sense of an aerosol resulting from by-products of combustion or pyrolysis of tobacco, but rather, that the article or device yields vapors (including vapors within aerosols that are considered to be visible aerosols that might be considered to be described as smoke-like) resulting from volatilization or vaporization of certain components, elements, and/or the like of the article and/or device. In certain aspects, articles or devices characterized as smoking articles incorporate tobacco and/or components derived from tobacco.

As noted, aerosol generating components of certain aerosol delivery devices may provide many of the sensations (e.g., inhalation and exhalation rituals, types of tastes or flavors, organoleptic effects, physical feel, use rituals, visual cues such as those provided by visible aerosol, and the like) of smoking a cigarette, cigar, or pipe that is employed by lighting and burning tobacco (and hence inhaling tobacco smoke), without any substantial degree of combustion of any component thereof. For example, the user of an aerosol delivery device in accordance with some example implementations of the present disclosure can hold and use that component much like a smoker employs a traditional type of smoking article, draw on one end of that piece for inhalation of aerosol produced by that piece, take, or draw puffs at selected intervals of time, and the like.

Articles or devices of the present disclosure are also characterized as being vapor-producing articles, aerosol delivery articles, or medicament delivery articles. Thus, such articles or devices are adaptable to provide one or more substances in an inhalable form or state. For example, inhalable substances are substantially in the form of a vapor (e.g., a substance that is in the gas phase at a temperature lower than its critical point). Alternatively, inhalable substances are in the form of an aerosol (e.g., a suspension of fine solid particles or liquid droplets in a gas). For purposes of simplicity, the term "aerosol" as used herein is meant to include vapors, gases, and aerosols of a form or type suitable for human inhalation, whether or not visible, and whether or not of a form that might be considered smoke-like. In some implementations, the terms "vapor" and "aerosol" may be interchangeable. Thus, for simplicity, the terms "vapor" and "aerosol" as used to describe the disclosure are understood to be interchangeable unless stated otherwise.

In use, smoking articles of the present disclosure are subjected to many of the physical actions of an individual in using a traditional type of smoking article (e.g., a cigarette, cigar, or pipe that is employed by lighting with a flame and used by inhaling tobacco that is subsequently burned and/or combusted). For example, the user of a smoking article of the present disclosure holds that article much like a traditional type of smoking article, draws on one end of that article for inhalation of an aerosol produced by that article, and takes puffs at selected intervals of time.

While the systems are generally described herein in terms of implementations associated with smoking articles such as so-called "tobacco heating products," it should be understood that the mechanisms, components, features, and methods may be embodied in many different forms and associated with a variety of articles. For example, the description provided herein may be employed in conjunction with implementations of traditional smoking articles (e.g., cigarettes, cigars, pipes, etc.), heat-not-burn cigarettes, and related packaging for any of the products disclosed herein. Accordingly, it should be understood that the description of the mechanisms, components, features, and methods disclosed herein are discussed in terms of implementations relating to aerosol delivery devices by way of example only, and may be embodied and used in various other products and methods.

Smoking articles of the present disclosure generally include a number of elements provided or contained within an enclosure of some sort, such as a housing, an outer wrap, or wrapping, a casing, a component, a module, a member, or the like. The overall design of the enclosure is variable, and the format or configuration of the enclosure that defines the overall size and shape of the smoking article is also variable. It is desirable, in some aspects, that the overall design, size, and/or shape of the enclosure resembles that of a conventional cigarette or cigar. Typically, an enclosure resembling the shape of a cigarette or cigar comprises separable components, members, or the like that are engaged to form the enclosure. For example, such a smoking article may comprise, in some aspects, three separable components that include a mouthpiece component, an aerosol delivery component (such as, for example, a substrate material), and a heat source component. In various aspects, the heat source may be capable of generating heat to aerosolize a substrate material that comprises, for example, an extruded structure and/or substrate, a substrate material associated with an aerosol precursor composition, tobacco and/or a tobacco related material, such as a material that is found naturally in tobacco that is isolated directly from the tobacco or synthetically prepared, in a solid or liquid form (e.g., beads, sheets, shreds, a wrap), or the like. In some implementations, an extruded structure may comprise tobacco products or a composite of tobacco with other materials such as, for example, ceramic powder. In other implementations, a tobacco extract/slurry may be loaded into porous ceramic beads. Other implementations may use non-tobacco products. In some implementations, aerosol precursor composition-loaded porous beads/powders (ceramics) may be used. In other implementations, rods/cylinders made of extruded slurry of ceramic powder and aerosol precursor composition may be used.

According to certain aspects of the present disclosure, it may be advantageous to provide a smoking article that is easy to use and that provides reusable components. FIG. 1 illustrates a perspective view of such a smoking article, according to one implementation of the present disclosure. In particular, FIG. 1 illustrates a perspective view of a smoking article 100 that includes a removable cartridge 50 and a holder 104. The holder 104 includes a main body portion 110 and a mouthpiece 112 located at a mouth end of the holder 104. As will be discussed in more detail below, in the depicted implementation the removable cartridge 50 is configured to be received into a channel 118 defined at a receiving end of the holder 104. FIG. 2 illustrates a perspective view of the removable cartridge 50 of FIG. 1. In the depicted implementation, the removable cartridge 50 includes a heat source 54, a substrate portion 52, and an outer housing 53 that is configured to circumscribe at least a portion of the heat source 54 and substrate portion 52. Other examples of cartridge configurations that may be applicable to the present disclosure can be found in U.S. patent application Ser. No. 16/515,637, filed on Jul. 18, 2019, and titled Aerosol Delivery Device with Consumable Cartridge, which is incorporated herein by reference in its entirety.

It should be noted that although in the depicted implementation the cartridge 50 and the holder 104 have substantially cylindrical shapes that imitate the shape of a traditional cigarette, in various other implementations, any one or both of these components (and/or any of their subcomponents, such as, for example, the main body portion 110 or the mouthpiece 112, and/or the heat source 54, the outer housing 53, or the substrate material 51 of the cartridge 50) may have a different shape. For example, in some implementations one or both of the holder 104 or the cartridge 50 (and/or any of their subcomponents) may have a substantially rectangular shape, such as a substantially rectangular cuboid shape. In other implementations, one or both of the holder 104 or the cartridge 50 (and/or any of their subcomponents) may have other hand-held shapes. For example, in some implementations, the holder 104 may have a small box shape, various pod mod shapes, or a fob-shape.

In various implementations, the heat source 54 may be configured to generate heat upon ignition thereof. In the depicted implementation, the heat source 54 comprises a combustible fuel element that has a generally cylindrical shape and that incorporates a combustible carbonaceous material. In other implementations, the heat source 54 may have a different shape, for example, a prism shape having a cubic or hexagonal cross-section. Carbonaceous materials generally have a high carbon content. Preferred carbonaceous materials are composed predominately of carbon, and/or typically have carbon contents of greater than 60 percent, generally greater than 70 percent, often greater than 80 percent, and frequently greater than 90 percent, on a dry weight basis.

In some instances, the heat source 54 may incorporate elements other than combustible carbonaceous materials (e.g., tobacco components, such as powdered tobaccos or tobacco extracts; flavoring agents; salts, such as sodium chloride, potassium chloride and sodium carbonate; heat stable graphite a hollow cylindrical (e.g., tube) fibers; iron oxide powder; glass filaments; powdered calcium carbonate; alumina granules; ammonia sources, such as ammonia salts; and/or binding agents, such as guar gum, ammonium alginate and sodium alginate). In other implementations, the heat source may comprise a plurality of ignitable objects, such as, for example, a plurality of ignitable beads. It should be noted that in other implementations, the heat source may differ in composition or relative content amounts from those listed above. For example, in some implementations different forms of carbon could be used as a heat source, such as graphite or graphene. In other implementations, the heat source may have increased levels of activated carbon, different porosities of carbon, different amounts of carbon, blends of any above mentioned components, etc. In still other implementations, the heat source may comprise a non-carbon heat source, such as, for example, a combustible liquefied gas configured to generate heat upon ignition thereof. For example, in some implementations, the liquefied gas may comprise one or more of petroleum gas (LPG or LP-gas), propane, propylene, butylenes, butane, isobutene, methyl propane, or n-butane. In still other implementations, the heat source may comprise a chemical reaction based heat source, wherein ignition of the heat source comprises the interaction of two or more individual components. For example, a chemical reaction based heat source may comprise metallic agents and an activating solution, wherein the heat source is activated when the metallic agents and the activating solution come in contact. Some examples of chemical based heat sources can be found in U.S. Pat. No. 7,290,549 to Banerjee et al., which is incorporated herein by reference in its entirety. Combinations of heat sources are also possible.

Although specific dimensions of an applicable heat source may vary, in the depicted implementation, the heat source 54 has a length in an inclusive range of 5 mm to 20 mm, and in some implementations may be 17 mm, and an overall diameter in an inclusive range of 3 mm to 8 mm, and in some implementations may be 6.8 mm (and in some implementations, 7 mm). Although in other implementations, the heat source may be constructed in a variety of ways, in the depicted implementation, the heat source 54 is extruded or compounded using a ground or powdered carbonaceous material, and has a density that is greater than 0.5 g/cm$^3$, often greater than 0.7 g/cm$^3$, and frequently greater than 1 g/cm$^3$, on a dry weight basis. See, for example, the types of fuel source components, formulations and designs set forth in U.S. Pat. No. 5,551,451 to Riggs et al. and U.S. Pat. No. 7,836,897 to Borschke et al., which are incorporated herein by reference in their entireties.

Although in various implementations the heat source 54 may have a variety of forms, including, for example, a substantially solid cylindrical shape or a hollow cylindrical (e.g., tube) shape, the heat source 54 of the depicted implementation comprises an extruded monolithic carbonaceous material that has a generally cylindrical shape that includes a plurality of internal passages 55 extending longitudinally from a first end of the heat source 54 to an opposing second end of the heat source 54. In the depicted implementation there are thirteen internal passages 55 comprising a single central internal passage 55*a*, six surrounding internal passages 55*b*, which are spaced from the central internal passages 55*a* and have a similar size (e.g., diameter) to that of the central internal passage 55*a*, and six peripheral internal passages 55*c*, which are spaced from an outer surface of the heat source 54 and are smaller in diameter than that of the central internal passage 55*a*. It should be noted that in other implementations, there need not be a plurality of internal passages and/or the plurality of internal passages may take other forms and/or sizes. For example, in some implementations, there may be as few as two internal passages, and still other implementations may include a single internal passage. Still other implementations may include no internal passages at all. Additional implementations may include multiple internal passages that may be of unequal diameter and/or shape and which may be unequally spaced and/or located within the heat source.

Although not depicted in the figures, some implementations may include one or more peripheral grooves that extend longitudinally from a first end of the heat source to an opposing second end. In some implementations, such grooves may be substantially equal in width and depth and may be substantially equally distributed about a circumference of the heat source. In such implementations, there may be as few as two grooves, and still other implementations may include a single groove. Still other implementations may include no grooves at all. Additional implementations may include multiple grooves that may be of unequal width and/or depth, and which may be unequally spaced around a circumference of the heat source. In still other implementations, the heat source may include flutes and/or slits extending longitudinally from a first end of the extruded monolithic carbonaceous material to an opposing second end thereof. In some implementations, the heat source may comprise a foamed carbon monolith formed in a foam process of the type disclosed in U.S. Pat. No. 7,615,184 to Lobovsky, which is incorporated herein by reference in its entirety. As such, some implementations may provide advantages with regard to reduced time taken to ignite the heat source. In some other implementations, the heat source may be co-extruded with a layer of insulation (not shown), thereby reducing manufacturing time and expense. Other implementations of fuel elements include carbon fibers of the type described in U.S. Pat. No. 6,922,901 to Brooks et al. or other heat source implementations such as is disclosed in U.S. Patent Publication No. 2009/0044818 to Takeuchi et al., each of which is incorporated herein by reference in its entirety. Further examples of heat sources including debossed heat source systems, methods, and smoking articles that include such heat sources are disclosed in U.S. patent application Ser. No. 15/902,665, filed on Feb. 22, 2018, and titled System for Debossing a Heat Generation Member, a Smoking Article Including the Debossed Heat Generation Member, and a Related Method, which is incorporated herein by reference in its entirety.

Generally, the heat source is positioned sufficiently near an aerosol delivery component (e.g., the substrate portion) having one or more aerosolizable components so that the aerosol formed/volatilized by the application of heat from the heat source to the aerosolizable components (as well as any flavorants, medicaments, and/or the like that are likewise provided for delivery to a user) is deliverable to the user by way of the mouthpiece. That is, when the heat source heats the substrate component, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof. Additionally, the selection of various smoking article elements are appreciated upon consideration of commercially available electronic smoking articles, such as those representative products listed in the background art section of the present disclosure.

FIG. 3 illustrates a longitudinal cross-sectional view of the cartridge 50 of FIG. 1. As shown in the figure, the substrate portion 52 has opposed first and second ends, with the heat source 54 disposed proximate the first end of the substrate portion 52. Although dimensions of the various components of the cartridge 50 may vary due to the needs of a particular application, in the depicted implementation the cartridge 50 may an overall length in an inclusive range of 10 mm to 50 mm and a diameter in an inclusive range of 3 mm to 10 mm. In addition, in the depicted implementation the housing 12 may have a thickness in the inclusive range of 0.05 mm to 0.5 mm. Furthermore, in the depicted implementation the substrate portion 52 may have a length in the inclusive range of 5 mm to 30 mm and a diameter slightly less than that of the overall cartridge in order to accommodate the thickness of the housing 12, such as, for example, a diameter in an inclusive range of 2.9 mm to 9.9 mm. In the depicted implementation, the substrate material comprises tobacco beads, which may have diameter sizes in range of approximately 0.5 mm to 2.0 mm, although in other implementations the size may differ. In other implementations, the substrate material may be a granulated tobacco material or cut filler tobacco. Although other implementations may differ, in the depicted implementation the outer housing of the cartridge is filled to about 80-90% capacity to allow for insertion of the heat source.

In the depicted implementation, the substrate portion 52 comprises a substrate material 51 having a single segment, although in other implementations the substrate portion 52 may include one or more additional substrate material segments. For example in some implementations, the smoking article 100 may further comprise a second substrate material segment (not shown) having opposed first and second ends. In various implementations, one or more of the substrate materials may include a tobacco or tobacco related material, with an aerosol precursor composition associated therewith. In other implementations, non-tobacco materials may be used, such as a cellulose pulp material. In other implementations, the non-tobacco substrate material may not be a plant-derived material. Other possible compositions, components, and/or additives for use in a substrate material (and/or substrate materials) are described in more detail below. It should be noted that the subsequent discussion should be applicable any substrate material usable in the smoking articles described herein (such as, for example, the substrate material 51 of the depicted implementation).

Referring also to FIG. 1, in various implementations ignition of the heat source 54 results in aerosolization of the aerosol precursor composition associated with the substrate material 51. In various implementations, the mouthpiece 112 is configured to receive the generated aerosol therethrough in response to a draw applied to the mouthpiece 112 by a user. As will be discussed in more detail below, in some implementations the mouthpiece 112 may comprise a filter 115 configured to receive the aerosol therethrough in response to the draw applied to the mouthpiece 112. In various implementations, the filter 115 is provided, in some aspects, as a circular disc radially and/or longitudinally disposed proximate the end of the holder 104 opposite the receiving end. In this manner, upon a draw on the mouthpiece 112, the filter 115 receives the aerosol flowing through holder 104 of the smoking article 100. In some implementations, the elements of the substrate material 51 do not experience thermal decomposition (e.g., charring, scorching, or burning) to any significant degree, and the aerosolized components are entrained in the air that is drawn through the smoking article 100, including a filter 115 (if present), and into the mouth of the user. In the smoking article 100 of the depicted implementation, the substrate material 51 comprises a plurality of tobacco beads formed into a substantially cylindrical portion. In some implementations, the filter 115 may comprise discrete segments. For example, some implementations may include a segment providing filtering, a segment providing draw resistance, a hollow segment providing a space for the aerosol to cool, other filter segments, and any one or any combination of the above. In some implementations, one or more filters may also provide a flavorant additive. In some implementations, a filter may include one or more filter segments that may be replaceable. For example, in some implementations one or more filter segments may be replaceable in order to customize a user's experience with the device, including, for example, filter segments that provide different draw resistances and/or different flavors. Some examples of flavor adding materials and/or components configured to add a flavorant can be found in U.S. patent application Ser. No. 16/408,942, filed on May 10, 2019 and titled Flavor Article for an Aerosol Delivery Device; U.S. patent application Ser. No. 15/935,105, filed on Mar. 26, 2018, and titled Aerosol Delivery Device Providing Flavor Control; and U.S. patent application Ser. No. 16/353,556, filed on Mar. 14, 2019, and titled Aerosol Delivery Device Providing Flavor Control, each of which is incorporated by reference herein in its entirety.

In particular implementations, the substrate material 51 may comprise a blend of flavorful and aromatic tobaccos in cut filler form. In some implementations, the substrate material 51 may comprise a reconstituted tobacco material, such as described in U.S. Pat. No. 6,807,809 to Pryor et al.; U.S. Pat. No. 6,889,143 to Pryor et al. and U.S. Pat. No. 5,025,814 to Raker, the disclosures of which are incorporated herein by reference in their entirety. Additionally, a reconstituted tobacco material may include a reconstituted tobacco paper for the type of cigarettes described in Chemical and Biological Studies on New Cigarette Prototypes that Heat Instead of Burn Tobacco, R. J. Reynolds Tobacco Company Monograph (1988), the contents of which are incorporated herein by reference in its entirety. For example, a reconstituted tobacco material may include a sheet-like material containing tobacco and/or tobacco-related materials. As such, in some implementations, the substrate material may be formed from a wound roll of a reconstituted tobacco material. In certain implementations, the substrate material may be formed from shreds, strips, and/or the like of a reconstituted tobacco material. In another implementation, the tobacco sheet may comprise overlapping layers (e.g., a gathered web), which may, or may not, include heat conducting constituents. Examples of substrate portions that include a series of overlapping layers (e.g., gathered webs) of an initial substrate sheet formed by the fibrous filler material, aerosol forming material, and plurality of heat conducting constituents are described in U.S. patent application Ser. No. 15/905,320, filed on Feb. 26, 2018, and titled Heat Conducting Substrate For Electrically Heated Aerosol Delivery Device, which is incorporated herein by reference in its entirety.

In some implementations, the substrate material 51 may include a plurality of microcapsules, beads, granules, and/or the like having a tobacco-related material. For example, a representative microcapsule may be generally spherical in shape, and may have an outer cover or shell that contains a liquid center region of a tobacco-derived extract and/or the like. In some implementations, one or more of the substrate materials may include a plurality of microcapsules each formed into a hollow cylindrical shape. In some implementations, one or more of the substrate materials may include a binder material configured to maintain the structural shape and/or integrity of the plurality of microcapsules formed into the hollow cylindrical shape.

Tobacco employed in one or more of the substrate materials may include, or may be derived from, tobaccos such as flue-cured tobacco, burley tobacco, Oriental tobacco, Maryland tobacco, dark tobacco, dark-fired tobacco and Rustica tobacco, as well as other rare or specialty tobaccos, or blends thereof. Various representative tobacco types, processed types of tobaccos, and types of tobacco blends are set forth in U.S. Pat. No. 6,836,224 to Lawson et al.; U.S. Pat. No. 6,924,888 to Perfetti et al.; U.S. Pat. No. 5,056,537 to Brown et al.; U.S. Pat. No. 5,159,942 to Brinkley et al.; U.S. Pat. No. 5,220,930 to Gentry; U.S. Pat. No. 5,360,023 to Blakley et al.; U.S. Pat. No. 6,701,936 to Shafer et al.; U.S. Pat. No. 6,730,832 to Dominguez et al.; U.S. Pat. No. 7,011,096 to Li et al.; U.S. Pat. No. 7,017,585 to Li et al.; U.S. Pat. No. 7,025,066 to Lawson et al.; U.S. Patent Publication No. 2004/0255965 to Perfetti et al.; PCT Publication No. WO 02/37990 to Bereman; and Bombick et al., *Fund. Appl. Toxicol.,* 39, p. 11-17 (1997); the disclosures of which are incorporated herein by reference in their entireties.

In some implementations of the present disclosure, the substrate material 51 may include an extruded structure that includes, or is essentially comprised of a tobacco, a tobacco related material, glycerin, water, and/or a binder material, although certain formulations may exclude the binder material. In various implementations, suitable binder materials may include alginates, such as ammonium alginate, propylene glycol alginate, potassium alginate, and sodium alginate. Alginates, and particularly high viscosity alginates, may be employed in conjunction with controlled levels of free calcium ions. Other suitable binder materials include hydroxypropylcellulose such as Klucel H from Aqualon Co.; hydroxypropylmethylcellulose such as Methocel K4MS from The Dow Chemical Co.; hydroxyethylcellulose such as Natrosol 250 MRCS from Aqualon Co.; microcrystalline cellulose such as Avicel from FMC; methylcellulose such as Methocel A4M from The Dow Chemical Co.; and sodium carboxymethyl cellulose such as CMC 7HF and CMC 7H4F from Hercules Inc. Still other possible binder materials include starches (e.g., cornstarch), guar gum, carrageenan, locust bean gum, pectins, and xanthan gum. In some implementations, combinations or blends of two or more binder materials may be employed. Other examples of binder materials are described, for example, in U.S. Pat. No. 5,101,839 to Jakob et al.; and U.S. Pat. No. 6,924,887 to Raker et al., each of which is incorporated herein by reference in its entirety. In some implementations, the aerosol forming material may be provided as a portion of the binder material (e.g., propylene glycol alginate). In addition, in some implementations, the binder material may comprise nanocellulose derived from a tobacco or other biomass.

In some implementations, the substrate material 51 may include an extruded material, as described in U.S. Patent Publication No. 2012/0042885 to Stone et al., which is incorporated herein by reference in its entirety. In yet another implementation, the substrate material may include an extruded structure and/or substrate formed from marumarized and/or non-marumarized tobacco. Marumarized tobacco is known, for example, from U.S. Pat. No. 5,105,831 to Banerjee, et al., which is incorporated by reference herein in its entirety. Marumarized tobacco includes 20 to 50 percent (by weight) tobacco blend in powder form, with glycerol (at 20 to 30 percent weight), calcium carbonate (generally at 10 to 60 percent by weight, often at 60 to 60 percent by weight), along with binder agents, as described herein, and/or flavoring agents. In various implementations, the extruded material may have one or more longitudinal openings.

In various implementations, the substrate material 51 may take on a variety of conformations based upon the various amounts of materials utilized therein. For example, a sample substrate material may comprise up to 98% by weight, up to 95% by weight, or up to 90% by weight of a tobacco and/or tobacco related material. A sample substrate material may also comprise up to 25% by weight, 20% by weight, or 15% by weight water—particularly 2% to 25%, 5% to 20%, or 7% to 15% by weight water. Flavors and the like (which include, for example, medicaments, such as nicotine) may comprise up to 10%, up to 8%, or up to 5% by weight of the aerosol delivery component.

Additionally or alternatively, the substrate material 51 may include an extruded structure and/or a substrate that includes or essentially is comprised of tobacco, glycerin, water, and/or binder material, and is further configured to substantially maintain its structure throughout the aerosol-generating process. That is, the substrate material may be configured to substantially maintain its shape (e.g., the substrate material does not continually deform under an applied shear stress) throughout the aerosol-generating process. Although such an example substrate material may include liquids and/or some moisture content, the substrate may remain substantially solid throughout the aerosol-generating process and may substantially maintain structural integrity throughout the aerosol-generating process. Example tobacco and/or tobacco related materials suitable for a substantially solid substrate material are described in U.S. Patent Publication No. 2015/0157052 to Ademe et al.; U.S. Patent Publication No. 2015/0335070 to Sears et al.; U.S. Pat. No. 6,204,287 to White; and U.S. Pat. No. 5,060,676 to Hearn et al., which are incorporated herein by reference in their entirety.

In some implementations, the amount of substrate material 51 that is used within the smoking article may be such that the article exhibits acceptable sensory and organoleptic properties, and desirable performance characteristics. For example, in some implementations an aerosol precursor composition such as, for example, glycerin and/or propylene glycol, may be employed within the substrate material in order to provide for the generation of a visible mainstream aerosol that in many regards resembles the appearance of tobacco smoke. For example, the amount of aerosol precursor composition incorporated into the substrate material of the smoking article may be in the range of 3.5 grams or less, 3 grams or less, 2.5 grams or less, 2 grams or less, 1.5 grams or less, 1 gram or less, or 0.5 gram or less.

According to some implementations, a smoking article according to the present disclosure may include a substrate material 51 comprising a porous, inert material such as, for example, a ceramic material. For example, in some implementations ceramics of various shapes and geometries (e.g., beads, rods, tubes, etc.) may be used, which have various pore morphology. In addition, in some implementations non-tobacco materials, such as an aerosol precursor composition, may be loaded into the ceramics. In another implementation, the substrate material may include a porous, inert material that does not substantially react, chemically and/or physically, with a tobacco-related material such as, for example, a tobacco-derived extract. In addition, an extruded tobacco, such as those described above, may be porous. For example, in some implementations an extruded tobacco material may have an inert gas, such as, for example, nitrogen, that acts as a blowing agent during the extrusion process.

As noted above, in various implementations one or more of the substrate materials may include a tobacco, a tobacco component, and/or a tobacco-derived material that has been treated, manufactured, produced, and/or processed to incorporate an aerosol precursor composition (e.g., humectants such as, for example, propylene glycol, glycerin, and/or the like) and/or at least one flavoring agent, as well as a flame/burn retardant (e.g., diammonium phosphate and/or another salt) configured to help prevent ignition, pyrolysis, combustion, and/or scorching of the substrate material by the heat source. Various manners and methods for incorporating tobacco into smoking articles, and particularly smoking articles that are designed so as to not purposefully burn virtually all of the tobacco within those smoking articles are set forth in U.S. Pat. No. 6,947,874 to Brooks et al.; U.S. Pat. No. 7,647,932 to Cantrell et al.; U.S. Pat. No. 8,079,371 to Robinson et al.; U.S. Pat. No. 7,290,549 to Banerjee et al.; and U.S. Patent Publication No. 2007/0215167 to Crooks et al.; the disclosures of which are incorporated herein by reference in their entireties.

As noted, in some implementations, flame/burn retardant materials and other additives that may be included within one or more of the substrate materials and may include organo-phosophorus compounds, borax, hydrated alumina, graphite, potassium tripolyphosphate, dipentaerythritol, pentaerythritol, and polyols. Others such as nitrogenous phosphonic acid salts, mono-ammonium phosphate, ammonium polyphosphate, ammonium bromide, ammonium borate, ethanolammonium borate, ammonium sulphamate, halogenated organic compounds, thiourea, and antimony oxides are suitable agents. In each aspect of flame-retardant, burn-retardant, and/or scorch-retardant materials used in the substrate material and/or other components (whether alone or in combination with each other and/or other materials), the desirable properties most preferably are provided without undesirable off-gassing or melting-type behavior.

According to other implementations of the present disclosure, the substrate material 51 may also incorporate tobacco additives of the type that are traditionally used for the manufacture of tobacco products. Those additives may include the types of materials used to enhance the flavor and aroma of tobaccos used for the production of cigars, cigarettes, pipes, and the like. For example, those additives may include various cigarette casing and/or top dressing components. See, for example, U.S. Pat. No. 3,419,015 to Wochnowski; U.S. Pat. No. 6,054,145 to Berndt et al.; U.S. Pat. No. 6,887,619 to Burcham, Jr. et al.; U.S. Pat. No. 5,022,416 to Watson; U.S. Pat. No. 5,103,842 to Strang et al.; and U.S. Pat. No. 5,711,320 to Martin; the disclosures of which are incorporated herein by reference in their entireties. Casing materials may include water, sugars and syrups (e.g., sucrose, glucose, and high fructose corn syrup), humectants (e.g. glycerin or propylene glycol), and flavoring agents (e.g., cocoa and licorice). Those added components may also include top dressing materials (e.g., flavoring materials, such as menthol). See, for example, U.S. Pat. No. 6,449,541 to Mays et al., the disclosure of which is incorporated herein by reference in its entirety. Further materials that may be added include those disclosed in U.S. Pat. No. 6,830,028 to Lawson et al. and U.S. Pat. No. 8,186,360 to Marshall et al., the disclosures of which are incorporated herein by reference in their entireties.

In some implementations, the substrate material may comprise a liquid including an aerosol precursor composition and/or a gel including an aerosol precursor composition. Some examples of liquid compositions can be found in U.S. patent application Ser. No. 16/171,920, filed on Oct. 26, 2018, and titled Aerosol Delivery Device with Visible Indicator, which is incorporated herein by reference in its entirety.

As noted above, in various implementations, one or more of the substrate materials may have an aerosol precursor composition associated therewith. For example, in some implementations the aerosol precursor composition may comprise one or more different components, such as polyhydric alcohol (e.g., glycerin, propylene glycol, or a mixture thereof). Representative types of further aerosol precursor compositions are set forth in U.S. Pat. No. 6,793,365 to Sensabaugh, Jr. et al.; U.S. Pat. No. 5,101,839 to Jakob et al.; PCT WO 98/57556 to Biggs et al.; and Chemical and Biological Studies on New Cigarette Prototypes that Heat Instead of Burn Tobacco, R. J. Reynolds Tobacco Company Monograph (1988); the disclosures of which are incorporated herein by reference. In some aspects, a substrate material may produce a visible aerosol upon the application of sufficient heat thereto (and cooling with air, if necessary), and the substrate material may produce an aerosol that is "smoke-like." In other aspects, the substrate material may produce an aerosol that is substantially non-visible but is recognized as present by other characteristics, such as flavor or texture. Thus, the nature of the produced aerosol may be variable depending upon the specific components of the aerosol delivery component. The substrate material may be chemically simple relative to the chemical nature of the smoke produced by burning tobacco.

In some implementations, the aerosol precursor composition may incorporate nicotine, which may be present in various concentrations. The source of nicotine may vary, and the nicotine incorporated in the aerosol precursor composition may derive from a single source or a combination of two or more sources. For example, in some implementations the aerosol precursor composition may include nicotine derived from tobacco. In other implementations, the aerosol precursor composition may include nicotine derived from other organic plant sources, such as, for example, non-tobacco plant sources including plants in the Solanaceae family. In other implementations, the aerosol precursor composition may include synthetic nicotine. In some implementations, nicotine incorporated in the aerosol precursor composition may be derived from non-tobacco plant sources, such as other members of the Solanaceae family. The aerosol precursor composition may additionally or alternatively include other active ingredients including, but not limited to, botanical ingredients (e.g., lavender, peppermint, chamomile, basil, rosemary, thyme, eucalyptus, ginger, cannabis, ginseng, maca, and tisanes), stimulants (e.g., caffeine and guarana), amino acids (e.g., taurine, theanine, phenylalanine, tyrosine, and tryptophan) and/or pharmaceutical, nutraceutical, and medicinal ingredients (e.g., vitamins, such as B6, B12, and C and cannabinoids, such as tetrahydrocannabinol (THC) and cannabidiol (CBD)).

A wide variety of types of flavoring agents, or materials that alter the sensory or organoleptic character or nature of the mainstream aerosol of the smoking article may be suitable to be employed. In some implementations, such flavoring agents may be provided from sources other than tobacco and may be natural or artificial in nature. For example, some flavoring agents may be applied to, or incorporated within, the substrate material and/or those regions of the smoking article where an aerosol is generated. In some implementations, such agents may be supplied directly to a heating cavity or region proximate to the heat source or are provided with the substrate material. Example flavoring agents may include, for example, vanillin, ethyl vanillin, cream, tea, coffee, fruit (e.g., apple, cherry, strawberry, peach and citrus flavors, including lime and lemon), maple, menthol, mint, peppermint, spearmint, wintergreen, nutmeg, clove, lavender, cardamom, ginger, honey, anise, sage, cinnamon, sandalwood, jasmine, cascarilla, cocoa, licorice, and flavorings and flavor packages of the type and character traditionally used for the flavoring of cigarette, cigar, and pipe tobaccos. Syrups, such as high fructose corn syrup, may also be suitable to be employed.

Flavoring agents may also include acidic or basic characteristics (e.g., organic acids, such as levulinic acid, succinic acid, pyruvic acid, and benzoic acid). In some implementations, flavoring agents may be combinable with the elements of the substrate material if desired. Example plant-derived compositions that may be suitable are disclosed in U.S. Pat. No. 9,107,453 and U.S. Patent Publication No. 2012/0152265 both to Dube et al., the disclosures of which are incorporated herein by reference in their entireties. Any of the materials, such as flavorings, casings, and the like that may be useful in combination with a tobacco material to affect sensory properties thereof, including organoleptic properties, such as described herein, may be combined with the substrate material. Organic acids particularly may be able to be incorporated into the substrate material to affect the flavor, sensation, or organoleptic properties of medicaments, such as nicotine, that may be able to be combined with the substrate material. For example, organic acids, such as levulinic acid, lactic acid, pyruvic acid, and benzoic acid may be included in the substrate material with nicotine in amounts up to being equimolar (based on total organic acid content) with the nicotine. Any combination of organic acids may be suitable. For example, in some implementations, the substrate material may include 0.1 to 0.5 moles of levulinic acid per one mole of nicotine, 0.1 to 0.5 moles of pyruvic acid per one mole of nicotine, 0.1 to 0.5 moles of lactic acid per one mole of nicotine, or combinations thereof, up to a concentration wherein the total amount of organic acid present is equimolar to the total amount of nicotine present in the substrate material. Various additional examples of organic acids employed to produce a substrate material are described in U.S. Patent Publication No. 2015/0344456 to Dull et al., which is incorporated herein by reference in its entirety.

The selection of such further components may be variable based upon factors such as the sensory characteristics that are desired for the smoking article, and the present disclosure is intended to encompass any such further components that are readily apparent to those skilled in the art of tobacco and tobacco-related or tobacco-derived products. See, Gutcho, Tobacco Flavoring Substances and Methods, Noyes Data Corp. (1972) and Leffingwell et al., Tobacco Flavoring for Smoking Products (1972), the disclosures of which are incorporated herein by reference in their entireties.

In other implementations, the substrate material 51 may include other materials having a variety of inherent characteristics or properties. For example, the substrate material may include a plasticized material or regenerated cellulose in the form of rayon. As another example, viscose (commercially available as VISIL®), which is a regenerated cellulose product incorporating silica, may be suitable. Some carbon fibers may include at least 95 percent carbon or more. Similarly, natural cellulose fibers such as cotton may be suitable, and may be infused or otherwise treated with silica, carbon, or metallic particles to enhance flame-retardant properties and minimize off gassing, particularly of any undesirable off-gassing components that would have a negative impact on flavor (and especially minimizing the likelihood of any toxic off-gassing products). Cotton may be treatable with, for example, boric acid or various organophosphate compounds to provide desirable flame-retardant properties by dipping, spraying, or other techniques known in the art. These fibers may also be treatable (coated, infused, or both by, e.g., dipping, spraying, or vapor-deposition) with organic or metallic nanoparticles to confer the desired property of flame-retardancy without undesirable off-gassing or melting-type behavior.

Continuing to refer to FIG. 3, the substrate material 51 may comprise a centrally defined longitudinally extending axis between the opposed first and second ends, and a cross-section of the substrate material 51 may be, in some implementations, symmetrical about the axis. For example, in some implementations a cross-section of the substrate material 51 may be substantially circular such that the substrate material 51 defines a substantially cylindrical shape extending between the opposed first and second ends thereof. However, in other implementations, the substrate material 51 may define a substantially non-circular cross-section such that the substrate material 51 may define a substantially non-cylindrical shape between the opposed first and second ends thereof. Otherwise, in other examples, the substrate material 51 may comprise an asymmetric cross-section about the axis. In various implementations, each end of the substrate material 51 may be in axial alignment with adjacent elements. For example, in some implementations a barrier may exist between the second end of the heat source 54 and the first end of the substrate material 51. In some implementations, such a barrier may comprise a disc that may include one or more apertures therethrough. In some implementations, the barrier may be constructed of a metal material (such as, for example, stainless steel, aluminum, brass, copper, silver, gold, and bronze), or a graphite material, or a ceramic material, or a plastic material, or any combinations thereof. In some implementations, a heat transfer component, which may or may not comprise a barrier, may exist between the heat source 54 and/or the substrate material 51. Some examples of heat transfer components are described in U.S. patent application Ser. No. 15/923,735, filed on Mar. 16, 2018, and titled Smoking Article with Heat Transfer Component, which is incorporated herein by reference in its entirety. In some implementations, a barrier or heat transfer component may prevent or inhibit combustion gasses from being drawn through the substrate material (and/or from being drawn through air passageways through which aerosol is drawn).

As shown in FIGS. 2 and 3, the cartridge 50 of the depicted implementation also includes an outer housing 53 that is configured to circumscribe at least a portion of the substrate portion 52, including the substrate material 51. In the depicted implementation, the outer housing 53 is also configured to circumscribe at least a portion of the heat source 54. The outer housing 53 of the depicted implementation is constructed of an aluminum material; however, in other implementations the outer housing 53 may be constructed of other materials, including other metal materials (such as, for example, stainless steel, aluminum, brass, copper, silver, gold, and bronze), or graphite materials, or ceramic materials, or plastic materials, or any combinations thereof. In some implementations, at least a portion of the heat source and/or at least a portion of the substrate material may be circumscribed by a paper foil laminate. In some implementations, the cartridge may comprise an enclosure comprising a laminate that contains a heat source and a beaded substrate material. Some examples of laminates and/or enclosures that may be applicable to the present disclosure can be found in U.S. patent application Ser. No. 16/174,846, filed on Oct. 30, 2018, and titled Smoking Article Cartridge, which is incorporated herein by reference in its entirety.

In the depicted implementation, the outer housing 53 is constructed as tube structure that encapsulates the substrate material 51; however, as noted above, in other implementations the outer housing 53 may have other shapes. Although the shape of the outer housing 53 may vary, in the depicted implementation the outer housing 53 comprises a tube structure having an open end and a closed end. The depicted implementation of the outer housing 53 also includes one or more end aperture 56 located on the closed end of the outer housing 53 that are configured to allow aerosolized vapor (herein alternatively referred to as a "vapor" or "aerosol") to pass therethrough. The end apertures 56 of the depicted implementation are in the form of a pair of elongate rounded slots; however, in other implementations the end aperture 56 may have any form that permits passage of the aerosol therethrough. As such, it will be appreciated that the end apertures 318 can comprise fewer or additional apertures and/or alternative shapes and sizes of apertures than those illustrated.

Referring briefly back to FIG. 1, although in other implementations the holder 104 may have other shapes, the holder 104 of the depicted implementation includes a main body portion 110 having a mouthpiece 112 and an inner barrel 128 (see FIG. 6), which together, at least in the depicted implementation, are configured to resemble the size, shape, and general appearance of a traditional cigarette. In particular, the main body portion 110 of the depicted implementation comprises a substantially cylindrical hollow tube. The mouthpiece 112 of the depicted implementation comprises a substantially cylindrical hollow tube with an overall diameter that is larger than that of the inner barrel 128. As will be discussed in more detail below, in the depicted implementation the outer diameter of the mouthpiece 112 may be slightly larger than an outer diameter of the inner barrel 128. It should be noted that in other implementations, the main body portion 110 may have any other configuration. In the depicted implementation, the mouthpiece 112 has an overall length in an inclusive range of 10 mm to 62 mm, the holder has an overall length in an inclusive range of 83 mm to 110 mm and a circumference in an inclusive range of 20 mm to 60 mm (e.g., a diameter in an inclusive range of 6 mm to 13 mm).

In various implementations, the main body portion 104 may be constructed of a metal material (such as, for example, stainless steel, aluminum, brass, copper, silver, gold, and bronze), or a graphite material, or a ceramic material, or a plastic material, or any combinations thereof. Other materials are also possible. The holder 104 of the depicted implementation may also include a plurality of end openings (not shown) that extend therethrough and are configured to align with at least a portion of the heat source 54 when the cartridge 50 is in the received configuration. In such a manner, the end openings are configured to provide the heat source 54 with sufficient airflow to keep the heat source 54 ignited when in the received configuration. While in various implementations, such openings may have many different configurations (including, for example, slots and/or rings instead of, or in addition to, holes), in the depicted implementation, the end openings comprise an alternating pattern of substantially circular holes that extend around a circumference of the receiving end of the holder 104. In particular, the alternating patterns of the depicted implementation include a first pattern of four longitudinally spaced holes repeated at 90° intervals around the circumference of the receiving end of the main body portion 110 of the holder 104, and a second pattern of three longitudinally spaced holes also repeated at 90° intervals, but shifted from the first pattern by 65° around the circumference of the end of the main body portion 110. For additional detail on suitable end openings, reference may be made to U.S. patent application Ser. No. 16/035,103 titled Smoking Article with Detachable Cartridge filed Jul. 13, 2018, the entire contents of which are hereby incorporated by reference.

FIG. 4 illustrates various internal components of the holder 104 in a loading configuration with the cartridge 50 received within the channel 118. In particular, the holder 104 of the depicted implementation includes various internal components that together move between a first or loading configuration (FIGS. 1 and 4); a second or lighting position (FIGS. 5 and 6); and a third, smoking, or received configuration (FIGS. 7 and 8) to receive and secure the cartridge 50 in one or more positions relative to the holder 104. Implementations may differ from one another. While in the loading configuration of the depicted implementation, at least a portion of the cartridge 50, e.g., the heat source 54, extends beyond the receiving end of the holder 104.

The holder 104 includes the main body portion 110 and an outer barrel 128 that is slidable over a portion of the main body portion 110. The main body portion 110 includes the mouthpiece 112 and an inner barrel 128. The mouthpiece 112 and the inner barrel 128 define a chamber 116 about a central longitudinal axis of the of the main body portion 110. The inner barrel 128 also defines a portion of the channel 118 about the central longitudinal axis of the main body 110. The chamber 116 and the channel 118 may be separated by a divider cavity 120 that is positioned within the inner barrel 128. In other implementations, the divider cavity may be replaced with a divider component, which may include one or more vapor passages disposed therethrough to allow air and/or aerosol to flow between the channel 118 and the chamber 116. The bore 114 may include one or more filters 115 disposed therein. As shown, four filters 115 are serially disposed with one another within the bore 114. The filters 115 may be permanent or replaceable. For example, the mouthpiece 112 may be separable from the inner barrel 128, e.g., by unscrewing the mouthpiece 112 from the inner barrel 128, such that the chamber 124 is opened and the filters 115 can be replaced. In some implementations, the mouthpiece 112 and the inner barrel 128 are inseparable from one another. In certain implementations, the mouthpiece 112 and the inner barrel 128 are integrally formed with one another. In various implementations, the filters 115 may comprise a packed rod or cylindrical disc constructed of a gas permeable material (such as, for example, cellulose acetate or polylactic acid (PLA), polyvinyl alcohol (PVOH), or polypropylene fibers such as paper or rayon, or polyester fibers, or various combinations thereof). The filters 115 may additionally or alternatively contain strands of tobacco containing material, such as described in U.S. Pat. No. 5,025,814 to Raker et al., which is incorporated herein by reference in its entirety. In various implementations, the size and shape of the filter may vary.

In some implementations, the smoking article 100 may also include an intermediate component between the cartridge 50 and the filter 115. It should be noted that in various implementations, the intermediate component or the filter, individually or together, may be considered a filter of the smoking article. In various implementations, neither the intermediate component nor the filter need be included. In some implementations, the intermediate component may comprise a substantially rigid member that is substantially inflexible along its longitudinal axis. In some implementations, the intermediate component may comprise a hollow tube structure and may be included to provide for cooling the produced aerosol. In some implementations, the intermediate component may be used as a container for collecting the aerosol. In various implementations, such a tube may be constructed from any of a variety of materials and may include one or more adhesives. Example materials include, but are not limited to, paper, paper layers, paperboard, plastic, cardboard, and/or composite materials. In some implementations, the intermediate component may comprise a hollow cylindrical element constructed of a paper or plastic material (such as, for example, ethyl vinyl acetate (EVA), or other polymeric materials such as poly ethylene, polyester, silicone, etc. or ceramics (e.g., silicon carbide, alumina, etc.), or other acetate fibers), and the filter comprises a packed rod or cylindrical disc constructed of a gas permeable material (such as, for example, cellulose acetate or fibers such as paper or rayon, or polyester fibers).

The inner barrel 128 includes an outer wall 129 having a diameter slightly less than the mouthpiece 112 such that a stop 126 is defined between the mouthpiece 112 and the outer wall 129. The mouthpiece 112 may include a step adjacent the stop 126 such that the stop 126 is slightly larger than the remainder of the mouthpiece 112. For example, the mouthpiece 112 may have a diameter of 9.9 mm and the outer wall 129 of the inner barrel 128 may have a diameter of 8 mm. In addition, the stop 126 may have a diameter of 10 mm. The difference between the diameter of inner barrel 128 and the stop 126 may be referred to as a recess 127 about the outer wall 129 of the inner barrel 128. In some implementations, the outer wall 129 is tapered outward from the stop 126 towards the receiving end of the holder 104.

The outer barrel 140 is slidably received over the inner barrel 128 and has a proximal section 142 and a distal section 148 with proximal being defined as closer to a mouth end 113 of the holder 104 and distal being closer to the receiving end of the holder 104. The outer barrel 140 includes an inner wall 141 that defines the channel 118. The inner wall 141 is disposed about the inner barrel 128 such that the inner barrel 128 is at least partially received within the channel 118. The inner wall 141 has a diameter substantially equal to or slightly less than the outer diameter of the inner barrel 128 such that the outer barrel 140 may slightly compress the inner barrel 128 inward as described in greater detail below. In the depicted implementation, the outer barrel 140 defines relief slits 149 in the distal section 136 thereof that allow the distal section 136 to expand as the outer barrel 140 approaches the load configuration. In some implementations, the inner wall 141 of the outer barrel 140 is tapered inward from a distal end towards a proximal end thereof. In particular implements, the tapers of the inner wall 141 of the outer barrel 140 and the outer wall 129 of the inner barrel 128 cooperate to compress the inner barrel 128 inward as the outer barrel 140 is translated distally.

With additional reference to FIGS. 5 and 6, the inner barrel 128 defines retention slot 122 in the outer wall 129 and the outer barrel 140 includes a retainer 144 slidably disposed within the retention slot 122. The retention slot 122 extends in a direction parallel to the longitudinal axis of the holder 104. The retention slot 122 may pass entirely through the outer wall 129 such that the retention slot 122 is in communication with the chamber 116. The retainer 144 extends inward from the inner wall 141 and is received within the retention slot 122 to limit translation of the outer barrel 140 over the inner barrel 128. In the depicted implementation, the inner barrel 128 defines two retention slots 122 separated 180 degrees about the outer wall 129; however, in some implementations, the inner barrel 128 may include less than two retention slots 122 or more than two retention slots 122 and the retention slots 122 may be equally spaced or unequally spaced about the outer wall 129. Likewise, the outer barrel 140 may include less than two retainers 144 or more than two retainers 144 with each retainer being received in a respective retention slot 122. In some implementations, the outer barrel 140 has less retainers 144 than retention slots of the inner barrel 128.

With reference to FIGS. 1 and 4-8, the use of the smoking article 100 and the interaction of the cartridge 50 and the holder 104 will be described in accordance with the present disclosure. During use of the smoking article 100, and other smoking articles detailed herein, loading, lighting, smoking, and ejecting of the smoking article 100 may be accomplished without physically contacting the heat source 54 of the cartridge 50. This may be advantageous to prevent damage to the heat source 54. In addition, contact with the heat source 54 may mark or discolor skin and or articles of clothing such that contact with the heat source 54 may not be desirable. In addition, after use, the heat source 54 may be hot, even after it is extinguished, such that contacting the heat source 54 may result in burns when skin is contacted or damage to other articles contacting the heat source 54.

Initially referring to FIG. 4, the cartridge 50 is inserted into the channel 118 of the holder 104 with the outer barrel 140 of the holder in the load configuration. Specifically, a proximal section 59 of the cartridge 50, which is opposite the heat source 54, is inserted through an opening in the distal section 148 of the outer barrel 140 until the proximal section 59 is received within a portion of the channel 118 defined by the inner barrel 128. In the depicted implementation, the cartridge 50 may be gravity fed into the channel 118 by tilting the holder 104 such that the distal section 148 is higher than the mouthpiece 112. In this orientation, gravity may slide the outer barrel 140 towards the load configuration. The proximal section 59 of the cartridge 50 is then positioned within or above the distal section 148 of the outer barrel 140 and released. When the cartridge 50 is released, the proximal section 59 of the cartridge 50 drops into the channel 118 until the proximal section 59 is adjacent to or abuts the divider cavity 120 and within a socket 134 of the channel 118. The holder 104 may be shaken to aid in the positioning of the proximal section 59 of the cartridge 50 adjacent to or in abutment with the divider cavity 120.

With the proximal section 59 of the cartridge 50 adjacent to or in abutment with the divider cavity 120, the outer barrel 140 is advanced distally over the cartridge 50 towards the received configuration until the outer barrel 140 reaches a lighting configuration as shown in FIGS. 5 and 6. As the outer barrel 140 is advanced distally over the cartridge 50, the inner wall 141 of the outer barrel 140 urges the inner barrel 128 inward such that the inner barrel 128 engages the outer housing 53 of the cartridge 50. The engagement of the inner barrel 128 with the outer housing 53 frictionally engages or "pinches" the cartridge 50 to secure the cartridge 50 within the channel 118. Frictional forces between the outer barrel 140 and the inner barrel 128 may prevent the outer barrel 140 from retracting towards the load configuration. With the outer barrel 140 in the lighting configuration the cartridge 50 is secured within the channel 118, the holder 104 can be manipulated, e.g., pointed downward, while retaining the cartridge 50 within the holder 104. In other implementations, the holder may retain a cartridge in a variety of different ways, such as, for example by including one or more retention features. For example, in some implementations one or both of the outer housing of the cartridge and an inner surface of the holder may include one or more protrusions and/or spring features and corresponding detent features configured to retain the cartridge. In other implementations, an inner surface of the holder may have a decreasing diameter, and/or one or more portions having a decreased diameter, that may be configured to retain the cartridge in the holder. In another implementation, the a portion of the holder may include retractable features configured to engage the cartridge to retain it in the holder. In still other implementations, one or more features of the cartridge and/or one or more features of the holder may create a releasable connection between the holder and the cartridge. For example, in some implementations the cartridge and the holder may have a releasable screw-type connection. In other implementations, the cartridge and the holder may have a releasable bayonet-type connection. In still other implementations, the cartridge may be retained in the holder via magnetic force. For example, in some implementations the outer housing of the cartridge may be made of a ferromagnetic material, and an inner portion of the holder may include one or more magnets.

In the lighting configuration, the distal section 148 of the outer barrel 140 is positioned proximal of the heat source 54 such that the heat source 54 extends distally from the distal section 148. In the lighting configuration, a flame, e.g., a lighter or a match, can be used to ignite the heat source 54. During ignition of the heat source 54, the distal section 148 of the outer barrel 140 may be exposed to the flame. The entire outer barrel 140 or at least the distal section 148 of the outer barrel 140 may be constructed of or coated with a heat resistant material to prevent ignition of the outer barrel 140 during ignition of the heat source 54. During ignition of the heat source 54, the mouthpiece 112 may be positioned in the mouth of a user and the user may draw through the mouthpiece 112 during ignition of the heat source 54. As detailed above, with the outer barrel 140 in the lighting configuration, the cartridge 50 is secured within the holder 104.

After the heat source 54 is ignited, the outer barrel 140 is advanced over the cartridge 50 towards the received configuration as shown in FIGS. 7 and 8. In the received configuration, the distal section 148 of the outer barrel 140 is positioned over heat source 54 such that the heat source 54 is positioned within the channel 118 of the outer barrel 140. As the outer barrel 140 is advanced from the lighting configuration towards the received configuration, the inner wall 141 may further urge the inner barrel 128 inward and into engagement with the outer housing 53 of the cartridge 50 to secure the cartridge 50 within the holder 104. In the received configuration, the inner wall 141 of the distal section 148 of the outer barrel 140 is positioned over and adjacent the heat source 54. The inner wall 141 may be formed of or coated with a flame or heat resistant material to prevent ignition or burning of the outer barrel 140. In some implementations, the entire outer barrel 140 or at least a portion of the distal section 148 may be constructed of a flame or heat resistant material. Frictional forces between the outer barrel 140 and the inner barrel 128 may prevent the outer barrel 140 from retracting towards the load configuration. With the outer barrel 140 in the received configuration, the cartridge 50 is secured within the channel 118 such that the holder 104 can be manipulated, e.g., pointed downward, while retaining the cartridge 50 within the holder 104.

In the received configuration, the smoking article 100 may be used in a manner similar to a traditional cigarette. For example, the mouthpiece 112 may be used to draw an aerosol through the substrate portion 52 and the filters 115. The relief slits 149 in the distal section 148 of the outer barrel 140 may allow outside air to be drawn through the substrate portion 52 without passing through the internal passages 55 of the heat source 54 (FIG. 3). In some implementations, the relief slits 149 allow additional oxygen to be delivered to the heat source 54 to prevent the heat source 54 from prematurely extinguishing, i.e., maintaining ignition of the heat source 54.

In some implementations, the heat source 54 may be sized to extinguish when the substrate material 51 within the substrate portion 52 is fully aerosolized. Full aerosolization of the substrate material 51 may be determined when all of the substrate material 51 is aerosolized or when a predetermined amount of the substrate material 51 is aerosolized. In some implementations, the smoking article of the present disclosure may include an extinguishment position. In such a manner, the extinguishment position may be configured such that the heat source is deprived of sufficient oxygen to sustain combustion. In some implementations, the extinguishment position may be obtained by further sliding the outer barrel distally. In other implementations, for example, one or more additional features may be included such that an extinguishment position may be achieved by actuating the one or more additional features. In particular, in one implementation the device may include a detachable feature, such as, for example an end cap, that may be used to achieve the extinguishment position. For example, in some implementations a separate end cap may be attachable over the distal end of the outer barrel such that, once attached, the heat source is deprived of sufficient oxygen to sustain combustion. Such an end cap could also be used to cover the end of the outer barrel when not in use, such as, for example, to prevent dirt and/or foreign objects from entering into the device.

When the heat source 54 is extinguished, the outer barrel 140 is retracted to the load position as shown in FIGS. 1 and 4. In the load position, the inner barrel 128 disengages or moves away from the outer housing 53 of the cartridge 50 such that the cartridge 50 is loose or not secured to the holder 104. With the cartridge 50 loose, the holder 104 may be tilted such that the distal section 148 is directed downward allowing the cartridge 50 to fall out of the channel 118. In some implementations, the holder 104 may be tapped to release the proximal section 59 of the cartridge 50 from the inner barrel 128 with the holder 104 tilted downward until the cartridge 50 falls out of the channel 118. When the cartridge 50 falls out of the channel 118, another cartridge 50 may be loaded into the holder 104 and ignited as detailed above.

Manipulation of the outer barrel 140, as detailed above, may be accomplished with one or two hands of a user. In addition, loading, lighting, and ejecting the cartridge 50 from the holder 104 may be accomplished without contacting the heat source 54.

With reference to FIGS. 9-12, another implementation of a smoking article 200 is disclosed in accordance with the present disclosure. The smoking article 200 includes a holder 204 and the cartridge 50. Similar to the holder 104 detailed above, the holder 204 is configured to receive and secure the cartridge 50 during lighting and smoking and to release the cartridge 50 and receive another cartridge 50 when the cartridge 50 is exhausted.

Referring initially to FIGS. 9 and 10, the holder 204 includes a main body portion 210 and a cap 240 that is releasably coupleable to the main body portion 210. The main body portion 210 includes a mouthpiece 212 having a proximal or mouth end 213 of the holder 204 and a connector 220 forming a distal section of the main body portion 210. The connector 220 may have a diameter slightly less than a diameter of an outer wall 211 of the main body portion 210. The main body portion 210 defines a bore 214 that receives one or more filters 215 therein. The filters 215 are similar to the filters 115 detailed above. The connector 220 defines a socket 234 therethrough. The socket 234 may be coaxially aligned with the bore 214 and may extend from the connector 220 towards the mouth end 213 into the remainder of the main body portion 210. The main body portion 210 may include a divider cavity 230 that is positioned between the bore 214 and the socket 234. In other implementations the divider cavity may be replaced with a divider component, which may include a vapor passage that interconnects the bore 214 and the socket 234. The vapor passage may be a single passage extending through the divider or may be a plurality of passages extending through the divider. The main body portion 210 may define one or more draw passages 228 that extend through the outer wall 211 and into communication with the divider cavity 230. The draw passages 228 may allow air surrounding the holder 204 to mix with aerosols being drawn from the channel 218 towards the mouthpiece 212.

The connector 220 includes a nub 222 that extends outward from an outer surface of the connector 220. The nub 222 extends from the outer surface of the connector 220 while remaining below the outer wall 211 of the main body portion 210. The nub 222 defines a gap 223 with the outer wall 211 of the main body portion 210. The nub 222 may extend in a direction parallel to a longitudinal axis of the holder 204. The connector 220 may include a single nub 222 or may include multiple nubs 222. For example, the connector 220 may include two nubs 222 offset 180 degrees from one another about the outer surface of the connector 220.

Continuing to refer to FIG. 10, the cap 240 is configured to releasably couple to the main body portion 210. The cap 240 includes a cap wall 241 forming an outer surface of the cap 240 and a distal wall 248. The distal wall 248 includes one or more vent holes 249 defined therethrough. The vent holes 249 are configured to allow air, and in particular oxygen, to pass through the cap 240 to provide the heat source 54 sufficient oxygen to prevent the heat source 54 from being extinguished. The cap 240 defines a channel 246 that extends from a proximal end of the cap 240 to the distal wall 248. The channel 246 is defined by an inner wall 247 and is sized to receive the outer housing 53 of the cartridge 50 therein. The cap 240 also defines a receiver 242 adjacent the proximal end thereof. The receiver 242 may have a diameter slightly larger than the channel 246 and is configured to receive the connector 220 therein. The receiver 242 further defines a groove 244 that is sized to receive the nub 222 therein and includes a retainer 245 that extends into the receiver 242 along a proximal edge of the cap 240. The groove 244 has a longitudinal segment that extends from the proximal edge of the cap 240 in a direction towards the distal wall 248 and parallel to a longitudinal axis of the cap 240 and a transverse segment that extends in a direction about the receiver 242 in a direction perpendicular to the longitudinal segment. The retainer 245 is aligned with the transverse segment of the groove 244 and is sized to be received within the gap 223 to prevent the nub 222 from withdrawing from the receiver 242.

With reference to FIGS. 9-12, the use of the smoking article 200 is detailed through the loading, lighting, smoking, and ejecting or unloading of the cartridge 50. Initially, as shown in FIGS. 9 and 10, the cap 240 is separated from the main body portion 210 such that the holder 204 is in a loading configuration. In the loading configuration, the cartridge 50 is loaded into the main body portion 210 of the holder 204 by inserting the proximal section 59 of the cartridge 50 into the socket 234 until the proximal section 59 abuts the divider cavity 230. The proximal section 59 of the cartridge 50 passes through the connector 220 as the proximal section 59 is loaded into the main body portion 210. The socket 234 may be sized to frictionally engage the proximal section 59 to secure the cartridge 50 to the main body portion 210 in a press-fit relationship. In some implementations, the socket 234 may be larger than the proximal section 59 such that the cartridge 50 is maintained within the socket 234 by gravity only. During loading, a user may grip the holder 204 along the main body portion 210 and grip the outer housing 53 of the cartridge 50. Thus, the cartridge 50 may be loaded without contacting the heat source 54.

Continuing to refer to FIGS. 9 and 10, with the cartridge 50 loaded into the main body portion 210 with the cap 240 separated from the main body portion 210, the holder 204 is in the lighting configuration. In the lighting configuration, the heat source 54 may be ignited by exposing the heat source 54 to a flame, e.g., using a lighter or a match. The heat source 54 may be ignited without exposing any portion of the holder 204 to a flame. During loading and lighting of the cartridge 50, the holder 204 is not exposed to a flame or heat.

Referring now to FIGS. 11 and 12, with the heat source 54 of the cartridge 50 ignited, the cap 240 is secured to the main body portion 210 over the cartridge 50 such that the cartridge 50 is encapsulated within the holder 204. When the cap 240 is secured to the main body portion 210, the distal wall 249 of the cap 240 defines the receiving end of the holder 204. To secure the cover to the main body portion 210, the proximal end of the cap 240 is moved over the cartridge 50 with the heat source 54 of the cartridge 50 passing through the receiver 242 and into the channel 246 of the cap 240. The entire cap 240 or a portion of the inner wall 247 of the cap 240 may be constructed of a metal or a heat resistant material to prevent damage from the ignited heat source 54. As the cap 240 is moved over the cartridge 50 towards the main body portion 210, the connector 220 is received within the receiver 242 of the cap 240. The cap 240 is then rotated or twisted about the connector 220 until the nub 222 of the connector 220 is aligned with the longitudinal segment of the groove 244. When the nub 22 is aligned with the longitudinal segment of the groove 244, the cap 240 is moved farther towards the main body portion 210 to slide the nub 222 into the longitudinal segment of the groove 244. When the nub 222 is fully moved into the longitudinal segment of the groove 244, interaction of the nub 22 within the groove 244 may prevent the cap 240 from additional movement towards the main body portion 210. Additionally or alternatively, the proximal edge of the cap 240 may abut the distal edge of the outer wall 211 of the main body portion 210 to prevent additional movement of the cap 240 towards the main body portion 210. When the cap 240 is prevented from additional movement towards the main body portion 210, the cap 240 is rotated or twisted relative to the main body portion 210 to move the nub 222 into the transverse segment of the grove 244. As the cap 240 is twisted, the retainer 245 of the cap 240 is received within the gap 223 between the nub 222 and the outer wall 211 of the main body portion 210. The retainer 245 prevents the nub 222 and thus, the main body portion 210 from separating from the cap 240. The retainer 245 may be larger than the gap 223 such that the retainer 245 frictionally engages the nub 222 to resist rotation of the cap 240 to slide the nub 222 through the transverse segment. The frictional engagement of the nub 222 and the retainer 245 may secure the cap 240 to the main body portion 210. The transverse segment of the groove 244 may include a detent or notch to receive the nub 222 when the cap 240 is twisted to maintain the nub 222 within the transverse segment and to resist unintentional rotation or twisting of the cap 240. The detent may prevent the cap 240 from unintentionally separating from the main body portion 210. When the cap 240 is secured to the main body portion 210 with the cartridge 50 received therein, the smoking article 200 is in a received configuration.

In the received configuration, the smoking article 200 may be used in a manner similar to a traditional cigarette. For example, the mouthpiece 212 may be used to draw an aerosol through the substrate portion 52. Further, in the received configuration, when the heat source 54 is ignited with the cap 240 encapsulating the cartridge 50, the cap 240 protects from unintentional contact with the heat source 54. The vent holes 249 provide airflow to the heat source 54 such that the heat source 54 remains ignited. In some implementations, the vent holes 249 may be covered or blocked to extinguish the heat source 54. For example, a user may block the vent holes 249 with a finger to extinguish the heat source 54. In other implementations, one or more additional features may be included such that an extinguishment position may be achieved by actuating the one or more additional features. In particular, in one implementation the device may include an air impermeable cover feature located proximate the vent holes 249 that may be mechanically or manually actuatable (e.g., by rotating the cover feature over the end of the cap 240 and/or by sliding the cover feature across the end of the cap 240) such that in the extinguishment position, the cover feature substantially covers the vent holes 249 and the heat source is deprived of sufficient oxygen to sustain combustion.

In the received configuration, a user may draw on the mouthpiece 212 such that air is drawn through vent holes 249, the heat source 54, and the substrate portion 52 to aerosolize the substrate material 51 (FIG. 3). The aerosol from the substrate material 51 is drawn through the divider cavity 230 and through the filters 215 disposed within the bore 214 before being drawn through the mouthpiece 212 and exiting the smoking article through the mouth end 213. As the aerosol passes through the divider cavity 230, air from outside of the holder 204 may be drawn into the cavity through the draw openings 228 and mix with the aerosol as the aerosol is drawn through the divider cavity 230.

In the received configuration, the smoking article 200 may be used in a manner similar to a traditional cigarette. For example, the mouthpiece 212 may be used to draw an aerosol through the substrate portion 52.

When the heat source 54 is extinguished, the cartridge 50 may be removed from the holder 204. The heat source 54 may be extinguished when the heat source 54 is exhausted or may be extinguished intentionally by covering the vent holes 249.

To remove the cap 240, the cap 240 is twisted relative to the main body portion 210 to move the nub 222 within the transverse segment of the groove 244 until the nub 222 is within the longitudinal segment of the groove 244. With the nub 222 in the longitudinal segment of the groove 244, the cap 240 may be pulled away from the main body portion 210 to remove the cap 240 from over the cartridge 50. With the cap 240 removed from over the cartridge 50, the proximal section 59 of the cartridge 50 may remain frictionally secured within the socket 234 of the main body portion 210. When the heat source 54 is extinguished, the cap 240 may be removed and the heat source 54 reignited in a similar manner as detailed above and the holder 204 returned to the received configuration by resecuring the cap 240 to the main body portion 210.

When the heat source 54 is exhausted, the user may eject or remove the cartridge 50 from the main body portion 210 and may replace the cartridge 50 with another cartridge 50. To remove the cartridge 50 from the main body portion 210, the user grasps the cartridge 50 to separate the cartridge 50 from the main body portion 210. Specifically, the user may grasp the outer housing 53 of the cartridge 50 and pull the cartridge 50 away from the main body portion 210 while holding the main body portion 210. With the cap 240 removed from over the cartridge 50, a significant portion of the outer housing 53 is exposed such that the user may grasp the outer housing 53 without contacting the heat source 54. In some implementations where the proximal portion 59 of the cartridge 50 is loose within the socket 234, the main body portion 210 may be tilted such that the connector 220 is oriented downward such that the cartridge 50 falls out of the socket 234 without grasping the outer housing 53 of the cartridge 50. With the cartridge 50 removed from within the socket 234, another cartridge 50 may be loaded into the socket 234, ignited, and the cap 240 replaced, i.e., secured to the main body portion 210, over the new cartridge 50. In some implementations, another cartridge 50 may be loaded into the socket 234 and the cap 240 replaced without the new cartridge 50 being ignited. In other implementations, the cap 240 may be replaced without a new cartridge 50 being loaded or ignited.

The holder 204 allows for the loading, lighting, smoking, and unloading of a cartridge 50 without contacting the heat source 54 of the cartridge 50. The holder 204 also encapsulates the cartridge 50 in the received configuration such that the heat source 54 is prevented from unintentionally contacting the user or other objects when the heat source 54 is ignited. In the received configuration, the holder 204 encapsulates the cartridge 50 such that the cartridge 50 is fully retained within the holder 204.

With reference to FIGS. 13-18, another implementation of a smoking article 300 is disclosed in accordance with the present disclosure. The smoking article 300 includes a holder 304 and the cartridge 50. Similar to the holder 204 detailed above, the holder 304 is configured to receive and secure the cartridge 50 during lighting and smoking and to release the cartridge 50 and receive another cartridge 50 when the cartridge 50 is exhausted.

Referring initially to FIGS. 13-16, the holder 304 includes a main body portion 310 and a cap 340 that is releasably coupleable to the main body portion 310. The main body portion 310 includes a mouthpiece 312 having a proximal or mouth end 313 of the holder 304 and a connector 320 forming a distal section of the main body portion 310. The connector 320 may have a diameter slightly less than a diameter of an outer wall 311 of the main body portion 310. The main body portion 310 defines a bore 314 that receives one or more filters 315 therein. The filters 315 are similar to the filters 115 detailed above. The connector 320 defines a socket 334 therethrough. The socket 334 may be coaxially aligned with the bore 314 and may extend from the connector 320 towards the mouth end 313 into the remainder of the main body portion 310. The main body portion 310 also defines a chamber 316 positioned between the bore 314 and the socket 334 and a slot 318 through the outer wall 311 and in communication with the chamber 316. The holder 304 includes a sleeve 330 slidably disposed within the chamber 316 between a loading position in which the sleeve 330 is disposed towards the mouth end 313 and an ejecting position in which the sleeve 330 is disposed towards the connector 320. The sleeve 330 is coupled to a slide 324 that extends through the slot 318 and is configured to translate the sleeve 330 between the loading and ejecting positions. The slide 324 includes a head 325 that is disposed on an external side of the outer wall 311 and a shank 326 that extends from the head 325, through the slot 318, and into a shank hole 331 defined in the sleeve 330. The shank 326 and the shank hole 331 may be threaded such that the shank 326 is threadably coupled with the sleeve 330. The sleeve 330 includes a shaft 336 that extends from the shank 326 towards the socket 334. The shaft 336 terminates in a shaft end 337 that is positioned adjacent a proximal end of the socket 334 when the sleeve 330 is in the loading position and is positioned adjacent a distal end of the socket 334 when the sleeve 330 is in the ejecting position to eject the cartridge 50 from the socket 334 as detailed below. The shaft 336 of the sleeve 330 further includes one or more aerosol passages 338 that extend through the shaft 336.

The sleeve 330 defines a vapor passage 332 therethrough that interconnects the bore 314 and the socket 334 through the chamber 316. The vapor passage 332 may be a single passage extending through the sleeve 330 or may be a plurality of passages extending through the sleeve 330. The slot 318 may be in communication with the vapor passage 332 or the sleeve 330 may separate the vapor passage 332 and the slot 318. The aerosol passages 338 of the shaft 336 are configured to communicate with the vapor passage 332 on one end and the end apertures 56 of the cartridge on the other end. The main body portion 310 may define one or more draw passages 328 that extend through the outer wall 311 and into communication with the vapor passage 332. The draw passages 328 may allow air surrounding the holder 304 to mix with aerosols being drawn from the socket 334 towards the mouthpiece 312.

The connector 320 includes a nub 322 that extends outward from an outer surface of the connector 320. The nub 322 extends from the outer surface of the connector 320 while remaining below the outer wall 311 of the main body portion 310. The nub 322 defines a gap 323 with the outer wall 311 of the main body portion 310. The nub 322 may extend in a direction parallel to a longitudinal axis of the holder 304. The connector 320 may include a single nub 322 or may include multiple nubs 322. For example, the connector 320 may include two nubs 322 offset 180 degrees from one another about the outer surface of the connector 320.

With particular to reference to FIG. 16, the cap 340 is configured to releasably couple to the main body portion 310. The cap 340 includes a cap wall 341 forming an outer surface of the cap 340 and a distal wall 348. The distal wall 348 includes one or more vent holes 349 defined therethrough. The vent holes 349 are configured to allow air, and in particular oxygen, to pass through the cap 340 to provide the heat source 54 sufficient oxygen to prevent the heat source 54 from being extinguished. The cap 340 defines a channel 346 that extends from a proximal end of the cap 340 to the distal wall 348. The channel 346 is defined by an inner wall 347 and is sized to receive the outer housing 53 of the cartridge 50 therein. The cap 340 also defines a receiver 342 adjacent the proximal end thereof. The receiver 342 may have a diameter slightly larger than the channel 346 and is configured to receive the connector 320 therein. The receiver 342 further defines a groove 344 that is sized to receive the nub 322 therein and includes a retainer 345 that extends into the receiver 342 along a proximal edge of the cap 340. The groove 344 has a longitudinal segment that extends from the proximal edge of the cap 340 in a direction towards the distal wall 348 and parallel to a longitudinal axis of the cap 340 and a transverse segment that extends in a direction about the receiver 342 in a direction perpendicular to the longitudinal segment. The retainer 345 is aligned with the transverse segment of the groove 344 and is sized to be received within the gap 323 to prevent the nub 322 from withdrawing from the receiver 342.

With reference to FIGS. 13-18, the use of the smoking article 300 is detailed through the loading, lighting, smoking, and ejecting or unloading of the cartridge 50. Initially, as shown in FIGS. 13 and 14, the cap 340 is separated from the main body portion 310 such that the smoking article 300 is in a loading configuration. In the loading configuration, the cartridge 50 is loaded into the main body portion 310 of the holder 304 by inserting the proximal section 59 of the cartridge 50 into the socket 334 until the proximal section 59 is prevented from further proximal movement towards the mouth end 313 of the main body portion 310. The socket 334 may frictionally engage the proximal section 59 to prevent the proximal section 59 from further proximal movement. In some implementations, the proximal section 59 may abut the end of the shaft 336 and translate the sleeve 330 to the loading position until the slide 324 engages a proximal end of the slot 318 preventing the proximal section 59 from additional proximal movement. The proximal section 59 of the cartridge 50 passes through the connector 320 as the proximal section 59 is loaded into the main body portion 310. The socket 334 may be sized to frictionally engage the proximal section 59 to secure the cartridge 50 to the main body portion 310 in a press-fit relationship. In some implementations, the socket 334 may be larger than the proximal section 59 such that the cartridge 50 is maintained within the socket 334 by gravity only. During loading, a user may grip the holder 304 along the main body portion 310 and grip the outer housing 53 of the cartridge 50. Thus, the cartridge 50 may be loaded without contacting the heat source 54.

Continuing to refer to FIGS. 13 and 14, with the cartridge 50 loaded into the main body portion 310 with the cap 340 separated from the main body portion 310, the holder 304 is in the lighting configuration. In the lighting configuration, the heat source 54 may be ignited by exposing the heat source 54 to a flame, e.g., using a lighter or a match. The heat source 54 may be ignited without exposing any portion of the holder 304 to a flame. During loading and lighting of the cartridge 50, the holder 304 is not exposed to a flame or heat.

Referring now to FIGS. 15 and 16, with the heat source 54 of the cartridge 50 ignited, the cap 340 is secured to the main body portion 310 over the cartridge 50 such that the cartridge 50 is encapsulated within the holder 304. When the cap 340 is secured to the main body portion 310, the distal wall 349 of the cap 340 defines the receiving end of the holder 304. To secure the cover to the main body portion 310, the proximal end of the cap 340 is moved over the cartridge 50 with the heat source 54 of the cartridge 50 passing through the receiver 342 and into the channel 346 of the cap 340. The entire cap 340 or a portion of the inner wall 347 of the cap 340 may be constructed of a metal or a heat resistant material to prevent damage from the ignited heat source 54. As the cap 340 is moved over the cartridge 50 towards the main body portion 310, the connector 320 is received within the receiver 342 of the cap 340. The cap 340 is then rotated or twisted about the connector 320 until the nub 322 of the connector 320 is aligned with the longitudinal segment of the groove 344. When the nub 32 is aligned with the longitudinal segment of the groove 344, the cap 340 is moved farther towards the main body portion 310 to slide the nub 322 into the longitudinal segment of the groove 344. When the nub 322 is fully drawn into the longitudinal segment of the groove 344, interaction of the nub 32 within the groove 344 may prevent the cap 340 from additional movement towards the main body portion 310. Additionally or alternatively, the proximal edge of the cap 340 may abut the distal edge of the outer wall 311 of the main body portion 310 to prevent additional movement of the cap 340 towards the main body portion 310. When the cap 340 is prevented from additional movement towards the main body portion 310, the cap 340 is rotated or twisted relative to the main body portion 310 to move the nub 322 into the transverse segment of the grove 344. As the cap 340 is twisted, the retainer 345 of the cap 340 is received within the gap 323 between the nub 322 and the outer wall 311 of the main body portion 310. The retainer 345 prevents the nub 322 and thus, the main body portion 310 from separating from the cap 340. The retainer 345 may be larger than the gap 323 such that the retainer 345 frictionally engages the nub 322 to resist rotation of the cap 340 to slide the nub 322 through the transverse segment. The frictional engagement of the nub 322 and the retainer 345 may secure the cap 340 to the main body portion 310. The transverse segment of the groove 344 may include a detent or notch to receive the nub 322 when the cap 340 is twisted to maintain the nub 322 within the transverse segment and to resist unintentional rotation or twisting of the cap 340. The detent may prevent the cap 340 from unintentionally separating from the main body portion 310. When the cap 340 is secured to the main body portion 310 with the cartridge 50 received therein, the holder 304 is in a received configuration.

In the received configuration, the smoking article 300 may be used in a manner similar to a traditional cigarette. For example, the mouthpiece 312 may be used to draw an aerosol through the substrate portion 52. Further, in the received configuration, when the heat source 54 is ignited with the cap 340 encapsulating the cartridge 50, the cap 340 protects from unintentional contact with the heat source 54. The vent holes 349 provide airflow to the heat source 54 such that the heat source 54 remains ignited. In some implementations, the vent holes 349 may be covered or blocked to extinguish the heat source 54. For example, a user may block the vent holes 349 with a finger to extinguish the heat source 54. In other implementations, one or more additional features may be included such that an extinguishment position may be achieved by actuating the one or more additional features. In particular, in one implementation the device may include an air impermeable cover feature located proximate the vent holes 349 that may be mechanically or manually actuatable (e.g., by rotating the cover feature over the end of the cap 340 and/or by sliding the cover feature across the end of the cap 340) such that in the extinguishment position, the cover feature substantially covers the vent holes 349 and the heat source is deprived of sufficient oxygen to sustain combustion.

In the received configuration, a user may draw on the mouthpiece 312 such that air is drawn through vent holes 349, the heat source 54, and the substrate portion 52 to aerosolize the substrate material 51 (FIG. 3). The aerosol from the substrate material 51 is drawn through the vapor passage 332 defined through the chamber 316 and through the filters 315 disposed within the bore 314 before being drawn through the mouthpiece 312 and exiting the smoking article through the mouth end 313. As the aerosol passes through the vapor passage 332, air from outside of the holder 304 may be drawn into the vapor passage 332 through the draw openings 328 and mix with the aerosol as the aerosol is drawn through the vapor passage 332. When the heat source 54 is extinguished, the cartridge 50 may be removed from the holder 304. The heat source 54 may be extinguished when the heat source 54 is exhausted or may be extinguished intentionally by covering the vent holes 349.

To remove the cap 340, the cap 340 is twisted relative to the main body portion 310 to move the nub 322 within the transverse segment of the groove 344 until the nub 322 is within the longitudinal segment of the groove 344. With the nub 322 in the longitudinal segment of the groove 344, the cap 340 may be pulled away from the main body portion 310 to remove the cap 340 from over the cartridge 50. With the cap 340 removed from over the cartridge 50, the proximal section 59 of the cartridge 50 may remain frictionally secured within the socket 334 of the main body portion 310. When the heat source 54 is intentionally or unintentionally extinguished, the cap 340 may be removed and the heat source 54 reignited in a similar manner as detailed above and the smoking article 300 returned to the received configuration by resecuring the cap 340 to the main body portion 310.

Referring to FIGS. 17 and 18, when the heat source 54 is exhausted, the user may eject or remove the cartridge 50 from the main body portion 310 and may replace the cartridge 50 with another cartridge 50. To remove the cartridge 50 from the main body portion 310, the slide 324 is actuated distally within the slot 318. As the slide 324 is actuated distally, the slide 324 translates the sleeve 330 distally within the chamber 316. As the sleeve 330 translates distally, the sleeve 330 translates the shaft 336 distally. As the shaft 336 translates distally, the end of the shaft 336 engages the proximal portion 59 of the cartridge 50 to push or eject the cartridge 50 from within the socket 334. The slide 324 allows the cartridge 50 to be ejected from the main body portion 310 without physical contact between the user and the cartridge 50. With the cartridge 50 removed from within the socket 334, another cartridge 50 may be loaded into the socket 334, ignited, and the cap 340 replaced, i.e., secured to the main body portion 310, over the new cartridge 50 and smoked. In some implementations, another cartridge 50 may be loaded into the socket 334 and the cap 340 replaced without the new cartridge 50 being ignited. In other implementations, the cap 340 may be replaced without a new cartridge 50 being loaded or ignited.

Additionally or alternatively, to remove the cartridge 50 from the main body portion 310, the user may grasp the cartridge 50 to separate the cartridge 50 from the main body portion 310. Specifically, the user may grasp the outer housing 53 of the cartridge 50 and pull the cartridge 50 away from the main body portion 310 while holding the main body portion 310. With the cap 340 removed from over the cartridge 50, a significant portion of the outer housing 53 is exposed such that the user may grasp the outer housing 53 without contacting the heat source 54. In some implementations where the proximal portion 59 of the cartridge 50 is loose within the socket 334, the main body portion 310 may be tilted such that the connector 320 is oriented downward such that the cartridge 50 falls out of the socket 334 without grasping the outer housing 53 of the cartridge 50.

The holder 304 allows for the loading, lighting, smoking, and unloading of a cartridge 50 without contacting the heat source 54 of the cartridge 50. In addition, the holder 304 allows for the unloading or ejecting of the cartridge 50 from the holder 304 without physically contacting, e.g., touching, the cartridge 50. The holder 304 also encapsulates the cartridge 50 in the received configuration such that the heat source 54 is prevented from unintentionally contacting the user or other objects when the heat source 54 is ignited. In the received configuration, the holder 304 encapsulates the cartridge 50 such that the cartridge 50 is fully retained within the holder 304.

With reference to FIGS. 19-26, another implementation of a smoking article 400 is disclosed in accordance with the present disclosure. The smoking article 400 includes a holder 404 and the cartridge 50. Similar to the holder 104 detailed above, the holder 404 is configured to receive and secure the cartridge 50 during lighting and smoking and to release the cartridge 50 and receive another cartridge 50 when the cartridge 50 is exhausted.

Referring initially to FIGS. 19 and 20, the holder 404 includes a main body portion 410 and a mouthpiece 412 that is releasably coupled to the main body portion 410. The mouthpiece 412 has a proximal or mouth end 413 of the holder 404 and a connector 420 forming a distal section of the mouthpiece 412. The connector 420 may have a diameter slightly less than a diameter of an outer wall 411 of the main body portion 410. The mouthpiece 412 defines a bore 414 therethrough. The connector 420 may frictionally engage the main body portion 410 to secure the mouthpiece 412 to the main body portion 410.

The main body portion 410 defines a chamber 416 and a channel 418. A proximal portion of the chamber 416 receives the connector 420 of the mouthpiece 412 and receives a sleeve 430. The sleeve 430 is slidably received within the chamber 416 and is configured to translate between a first or distal loading position (FIG. 20), a second or intermediate lighting position (FIG. 22), and a third or proximal received position (FIG. 24). The sleeve 430 includes two or more fingers 436 that extend distally from the sleeve 430. The fingers 436 define a socket 434 therebetween and are biased radially outward. Specifically, the fingers 436 may be self-biased radially outward. In the loading position, the fingers 436 may extend into the channel 418 and into a groove 438 defined in an inner wall 446 defining the channel 418. In the loading position, the socket 434 defined between the fingers 436 may be in an expanded configuration. The sleeve 430 defines a vapor passage 432 that interconnects the chamber 416, the channel 418, and the bore 414 to allow aerosol from the cartridge 50 to be drawn through the mouthpiece 412.

The main body portion 410 also defines a slot 422 defined through the outer wall 411 in communication with the chamber 416. The slot 422 includes a distal first leg 462, a proximal second leg 468, and a transverse leg 466 interconnecting the first and second legs 462, 468. The first and second legs 462, 468 are substantially parallel to a longitudinal axis of the main body portion 410 and radially offset from one another about the outer wall 411. The transverse leg 466 is substantially perpendicular to the first and second legs 462, 468 and interconnects a proximal end of the first leg 462 with a distal end of the second leg 468. The first leg 462 includes a distal loading end 463 of the slot 422 and the second leg 468 includes a proximal received end 469 of the slot 422. The proximal end of the first leg 462 and the distal end of the second leg 468 each include a lighting stop 464. The slot 422 may also allow air surrounding the holder 404 to mix with aerosols being drawn towards the mouthpiece 412 in the vapor passage 432 and/or the chamber 416 in a manner similar to the draw passages 228 detailed above.

The holder 404 includes a slide 424 having a head 425 and a shank 426. The head 425 is positioned along the outer wall 411 of the main body portion 410 and the shank 426 extends through the slot 422 and is coupled to the sleeve 430 such that the sleeve 430 cooperates with movement of the slide 424. The shank 426 and the sleeve 430 may be threadably coupled with one another. The slide 424 is movable within the slot 422 to translate the sleeve 430 between the loading, lighting, and received positions.

With reference to FIGS. 19-26, the use of the smoking article 400 is detailed through the loading, lighting, smoking, and ejecting or unloading of the cartridge 50. Initially, as shown in FIGS. 19 and 20, the holder 404 is in a loading configuration with the connector 420 received within the chamber 416 to secure the mouthpiece 412 to the main body portion 410 and the slide 424 at the loading end 463 of the slot 422 such that the sleeve 430 is in the loading position. In the loading configuration, the fingers 436 of the sleeve 430 extend into the chamber 418 and are received within the groove 438 such that the socket 434 is in the expanded configuration. In the loading configuration, the cartridge 50 is loaded into the channel 418 by passing the proximal section 59 of the cartridge 50 through a distal section 448 of the main body portion 410 until the proximal section 59 is positioned in the socket 434 between the fingers 436. In the loading configuration, the socket 434 has a diameter larger than the proximal section 59 of the cartridge 50 to allow the proximal section 59 to freely slide into the socket 434. The holder 404 may be held with the distal section 448 oriented upward such that the cartridge 50 is gravity fed into the socket 434. In the loading configuration, the distal section 448 of the main body portion 410 defines the receiving end of the holder 404.

Referring now to FIGS. 21 and 22, with the proximal section 59 of the cartridge 50 received within the socket 434, the slide 424 is translated proximally through the first leg 462 of the slot 422 towards the mouth end 413 until the slide 424 reaches the lighting stop 464 (FIG. 19). As the slide 424 is translated proximally, the fingers 436 slide proximally into the chamber 416. As the fingers 436 slide proximally, interaction with the inner wall 446 defining the chamber 416 urges the fingers 436 inward to reduce the socket 434 such that the fingers 436 transition to a compressed configuration and engage the outer housing 53 of the proximal section 59 of the cartridge 50. The engagement of the fingers 436 with the proximal section 59 draws the cartridge 50 proximally into the channel 418. The engagement of the fingers 436 with the outer housing 53 may be frictional engagement. In some implementations, the fingers 436 may include barbs (not shown) that engage the outer housing 53 of the cartridge 50. When the slide 424 reaches the lighting stop 464, the cartridge 50 is disposed substantially within the channel 418 with the heat source 54 remaining outside or beyond a distal section 448 of the main body portion 411 such that the holder 404 is in the lighting configuration. In the lighting configuration, the proximal section 59 of the cartridge 50 may be disposed within the chamber 416 beyond a distal end of the sleeve 430. The holder 404 may be oriented upward during loading and transitioning of the holder 404 to the lighting configuration to prevent the cartridge 50 from inadvertently separating from the holder 404.

In the lighting configuration, the cartridge 50 is secured within the holder 404 such that the orientation of the holder 404 may vary without the cartridge 50 inadvertently separating from the holder 404. With the holder 404 in the lighting configuration, the heat source 54 may be ignited. Specifically, a lighter or match (not shown) may be used to expose the heat source 54 to a flame. During ignition of the heat source 54, the distal section 448 of the main body portion 410 may be exposed to heat and/or flame. The distal section 448 may be constructed of a heat or flame resistant material to prevent ignition or deformation of the distal section 448 during ignition of the heat source 54. During ignition of the heat source 54, the slide 424 may remain in the first leg 462 at the lighting stop 464, may be moved through the transverse leg 466 to the lighting stop 464 of the second leg 468, or may be moved to a point in the transverse leg 466 between the first and second legs 462, 468. As the slide 424 moves through the transvers leg 466, the slide 424 rotates the sleeve 430 within the chamber 416.

With the heat source 54 ignited, the slide 424 is moved proximally through the second leg 468 to the received end 469 of the slot 422 to translate the sleeve 430 within the chamber 416 to the received position as shown in FIGS. 23 and 24. As the sleeve 430 translates to the received position, the fingers 436 engage the outer housing 53 of the cartridge 50 to draw the cartridge 50 proximally through the chamber 416 such that the heat source 54 is disposed entirely within the channel 418 such that the holder 404 is in the received configuration. In the received configuration, the heat source 54 is within the distal section 448 of the main body portion 410. The distal section 448 remains open to allow airflow into the heat source 54 while protecting the heat source 54 from inadvertent contact therewith. Airflow to the heat source 54 enables the heat source 54 to remain ignited. As the sleeve 430 translates to the received position, the fingers 436 may be moved further inward to compress the proximal section 59 of the cartridge 50 within the socket 434 to further secure the cartridge 50 to the holder 404. As the distal section 448 is adjacent the heat source 54 while the heat source 54 is ignited, the distal section 448 is constructed of a heat resistant material suitable to resist deformation or ignition when exposed to the ignited heat source 54. Friction between the fingers 436 and the inner wall 446 defining the chamber 416 may resist distal movement of the slide 424 to maintain the slide 424 in at the received end 469 of the slot 422. In the received configuration, the sleeve 430 may abut the connector 420 of the mouthpiece 412. It should be noted that in some implementations, the heat source may merely be proximate the receiving end of the holder in the received configuration.

In the received configuration, the smoking article 400 may be used in a manner similar to a traditional cigarette. For example, the mouthpiece 412 may be used to draw an aerosol through the substrate portion 52. Specifically, the aerosol from the cartridge 50 is drawn through the vapor passage 432 defined through the chamber 416 before being drawn through the mouthpiece 412 and exiting the smoking article through the mouth end 413. As the aerosol passes through the vapor passage 432, air from outside of the holder 404 may be drawn into the vapor passage 432 through the slot 422 and mix with the aerosol as the aerosol is drawn through the vapor passage 432. The mixing of air from outside of the holder 404 may enhance a flavor or taste of the aerosol.

Referring to FIGS. 25 and 26, the holder 404 has an extinguishment configuration in which the mouthpiece 412 is secured to the distal section 448 of the main body portion 410 over the heat source 54 to allow the user to extinguish the heat source 54. Specifically, the mouthpiece 412 may be pulled apart from the main body portion 410 to remove the connector 420 from the chamber 416. The connector 420 is then inserted into the distal section 448 of the main body portion 410. The distal section 448 may define a receiver 442 that is sized to receive the connector 420 therewithin. The connector 420 may frictionally engage the inner wall 446 to secure the mouthpiece 412 to the distal section 448. With the mouthpiece 412 secured to the distal section 448, the mouthpiece 412 may restrict airflow to the heat source 54 to extinguish the heat source 54. In some implementations, the user may cover the end of the mouthpiece 412 opposite the heat source 54 to restrict airflow to the heat source 54 to extinguish the heat source 54.

When the heat source 54 is extinguished, the mouthpiece 412 may be returned to the mouth end 413 of the holder 404 such that the holder 404 is in the received configuration. The slide 424 may be translated distally through the second leg 468 to the lighting stop 466 of the second leg 468 such that the heat source 54 extends from the distal section 448 of the main body portion 410. The heat source 54 may be reignited in a manner similar to ignition of the heat source 54 detailed above. When the heat source 54 is ignited, the holder 404 may be returned to the received configuration until the heat source 54 is exhausted.

When the heat source 54 is exhausted, the cartridge 50 may be ejected or removed from the holder 404 by advancing the slide 424 distally through the second leg 468, moving the slide 424 through the transverse leg, and advancing the slide 424 distally through the first leg 462 until the slide 424 reaches the loading end 463 of the slot 422. When the slide 424 reaches the loading end 463, the sleeve 430 is translated to the loading position shown in FIG. 20 in which the fingers 436 bias into the groove 438 such that the socket 434 is expanded to a dimension greater than the proximal section 59 of the cartridge 50 such that the holder 404 is in the loading configuration. In the loading configuration, the holder 404 may be oriented with the distal section 448 downward such that gravity draws the cartridge 50 out of the channel 418. In some implementations, the movement of the slide 424 to the loading end 463 of the slot 422 may eject or launch the cartridge 50 from the holder 404. With the cartridge 50 unloaded from the holder 404, another cartridge 50 may be loaded and ignited as detailed above.

The holder 404 allows for the loading, lighting, smoking, and unloading of a cartridge 50 without contacting the heat source 54 of the cartridge 50. In addition, the holder 404 allows for the unloading or ejecting of the cartridge 50 from the holder 404 without physically contacting, e.g., touching, the cartridge 50. The holder 404 also encapsulates the cartridge 50 in the received configuration such that the heat source 54 is prevented from unintentionally contacting the user or other objects when the heat source 54 is ignited. In the received configuration, the holder 404 encapsulates the cartridge 50 such that the cartridge 50 is fully retained within the holder 404.

With reference to FIGS. 27-32, another implementation of a smoking article 500 is disclosed in accordance with the present disclosure. The smoking article 500 includes a holder 504 and the cartridge 50. Similar to the holder 104 detailed above, the holder 504 is configured to receive and secure the cartridge 50 during lighting and smoking and to release the cartridge 50 and receive another cartridge 50 when the cartridge 50 is exhausted.

Referring initially to FIGS. 27 and 28, the holder 504 includes a main body portion 510 and an outer barrel 540 that is rotatable about the main body portion 510. The main body portion 510 includes a mouthpiece 512 having a proximal or mouth end 513 of the holder 504. The main body portion 510 includes an inner barrel 520 that forms a distal section of the main body portion 510 and includes an inner cover 523 at a distal end thereof. The inner barrel 520 may have a diameter slightly less than a diameter of an outer wall 511 of the main body portion 510. The main body portion 510 defines a bore 514 that receives one or more filters 515 therein. The filters 515 are similar to the filters 115 detailed above. The main body portion 510 also defines a chamber 516 distal of the bore 514. In addition, the main body portion 510 and the outer barrel 540 define a channel 518 distal of the chamber 516.

The chamber 516 slidably receives a sleeve 530 therein. The sleeve 530 is configured to translate between a first or distal loading position (FIG. 28) and a second or proximal received position (FIG. 30). The sleeve 530 includes two or more fingers 536 that extend distally from the sleeve 530. The fingers 536 define a socket 534 therebetween and are biased radially outward. Specifically, the fingers 536 may be self-biased radially outward. In the loading position, the fingers 536 may extend into the channel 518 and into a groove 538 defined in an inner wall 521 defining a portion of the channel 518. In the loading position, the socket 534 defined between the fingers 536 may be in an expanded configuration. The sleeve 530 defines a vapor passage 532 that interconnects the chamber 516, the channel 518, and the bore 514 to allow aerosol from the cartridge 50 to be drawn through the mouthpiece 512. The main body portion 510 also defines a slot 522 defined through the inner barrel 520 and in communication with the chamber 516. The slot 522 is parallel to a longitudinal axis of the holder 504.

The outer barrel 540 is rotatably received over the inner barrel 520 and includes an outer wall 547 that is contiguous or flush with the outer wall 511 of the main body portion 510. The outer barrel 540 is substantially tubular and defines a portion of the channel 518 therewithin. A distal section 548 of the outer barrel 540 includes an outer cover 543 that surrounds the inner cover 523 when the outer barrel 540 is in an open position as shown in FIG. 27. In the open position, the inner cover 523 may be nested within the outer cover 543. The inner and outer covers 523, 543 define the receiving end of the holder 504.

The outer barrel 540 also includes a longitudinal chase 542 and a transverse chase 544 defined through a proximal section thereof. The longitudinal chase 542 is substantially parallel to the longitudinal axis of the holder 504 and is aligned, i.e., radially aligned, with the slot 522 in the loading configuration of the holder 504. The transverse chase 544 extends from a proximal end of the longitudinal chase 542 in a direction substantially perpendicular to the longitudinal chase 542. The slot 522 and the chases 542, 544 may also allow air surrounding the holder 504 to mix with aerosols being drawn towards the mouthpiece 512 in the vapor passage 532 and/or the chamber 516 in a manner similar to the draw passages 228 detailed above.

The sleeve 530 is coupled to a slide 524 that extends through the slot 522 and the chases 542, 544 and is configured to translate the sleeve 530 between the loading position and the received position and to guide rotation of the outer barrel 540 between an open position (FIG. 27) and a closed position (FIG. 31) as detailed below. The slide 524 includes a head 525 that is disposed on an external side of the outer walls 511, 547 and a shank 526 that extends from the head 525, through the slot 522 and chases 542, 544, and into a shank hole 531 defined in the sleeve 530. The shank 526 and the shank hole 531 may be threaded such that the shank 526 is threadably coupled with the sleeve 530.

With reference to FIGS. 27-32, the use of the smoking article 500 is detailed through the loading, lighting, smoking, and ejecting or unloading of the cartridge 50. Initially, as shown in FIGS. 27 and 28, the holder 504 is in a loading configuration with the slide 524 positioned at a distal end of the slot 522 and the longitudinal chase 542 such that the sleeve 530 is in the loading position and the outer barrel 540 in the open position. In the loading configuration, the fingers 536 of the sleeve 530 extend into the chamber 518 and are received within the groove 538 such that the socket 534 is in the expanded configuration. In the loading configuration, the cartridge 50 is loaded into the channel 518 by passing the proximal section 59 of the cartridge 50 through a distal section 548 of the main body portion 510 until the proximal section 59 is positioned in the socket 534 between the fingers 536. In the loading configuration, the socket 534 has a diameter larger than the proximal section 59 of the cartridge 50 to allow the proximal section 59 to freely slide into the socket 534. The holder 504 may be held with the distal section 548 oriented upward such that the cartridge 50 is gravity fed into the socket 534.

Referring now to FIGS. 29 and 30, with the proximal section 59 of the cartridge 50 received within the socket 534, the slide 524 is translated proximally through the slot 522 and the longitudinal chase 542 to slide the sleeve 530 within the chamber 516 from the loading position to the received position. As the sleeve 530 slides proximally, the fingers 536 slide proximally and interact with the inner wall 521 defining the chamber 516 to urge the fingers 536 inward to reduce the diameter of the socket 534 such that the fingers 536 are in a compressed configuration and engage the outer housing 53 of the proximal section 59 of the cartridge 50. The engagement of the fingers 536 with the proximal section 59 draws the cartridge 50 proximally into the chamber 516. The engagement of the fingers 536 with the outer housing 53 may be frictional engagement. In some implementations, the fingers 536 may include barbs (not shown) that engage the outer housing 53 of the cartridge 50. When the slide 524 reaches the proximal end of the slot 522 and the longitudinal chase 542, the cartridge 50 is disposed substantially within the channel 518 with the heat source 54 remaining outside or beyond a distal section 548 of the outer barrel 540 adjacent the inner and outer covers 523, 543 such that the holder 504 is in the lighting configuration. In the lighting configuration, the proximal section 59 of the cartridge 50 may be disposed within the chamber 516 beyond a distal end of the sleeve 530. The holder 504 may be oriented upward during loading and transitioning of the holder 504 to the lighting configuration to prevent the cartridge 50 from inadvertently separating from the holder 504.

In the lighting configuration, the cartridge 50 is secured within the holder 504 such that the orientation of the holder 504 may vary without the cartridge 50 inadvertently separating from the holder 504. With the holder 504 in the lighting configuration, the heat source 54 may be ignited. Specifically, a lighter or match (not shown) may be used to expose the heat source 54 to a flame. During ignition of the heat source 54, the distal section 548 of the outer barrel 540 and the covers 523, 543 may be exposed to heat and/or flame. The distal section 548 and the covers 523, 543 may be constructed of a heat or flame resistant material to prevent ignition or deformation of the distal section 548 and the covers 523, 543 during ignition of the heat source 54. During ignition of the heat source 54, the slide 524 remains at the proximal end of the slot 522 and the transverse chase 542. In some implementations, friction between the fingers 536 and the inner wall 521 of the inner barrel 520 maintain the sleeve 530 in the received position during ignition of the heat source 54. In particular implementations, friction between the inner barrel 520 and the outer barrel 540 maintains the position of the outer barrel 540 relative to the inner barrel 520.

With the heat source 54 ignited and the slide 524 at the proximal end of the slot 522 and the transverse chase 542, the outer barrel 540 is rotated about the inner barrel 520 to the closed position with the shank 546 of the slide 524 passing through the transverse chase 544 as the holder 504 is transitioned into the received configuration as shown in FIGS. 31 and 32. As the outer barrel 540 rotates about the inner barrel 520, the outer cover 543 of the outer barrel 540 rotates about the heat source 54 of the cartridge 50 from around the inner cover 523 of the inner barrel 520 to enclose the heat source 54 between the inner and outer covers 523, 543. The outer barrel 540 may rotate 180 degrees about the inner barrel 520 between the lighting configuration and the received configuration. In the received configuration, a distal end of the holder 504 remains open to allow airflow into the heat source 54 while protecting the heat source 54 from inadvertent contact therewith. In some implementations, the inner and outer covers 523, 543 define relieve slits 549 therebetween which allow additional airflow to the heat source 54. The airflow to the heat source 54 enables the heat source 54 to remain ignited. In the received configuration, the covers 523, 543 are adjacent the ignited and burning heat source 54. In some implementations, the distal section 548 is also adjacent the ignited and burning heat source 54. Friction between the head 525 of the slide 524 and the walls defining the transverse chase 544 may maintain the position of the outer barrel 540 relative to the inner barrel 520.

In the received configuration, the smoking article 500 may be used in a manner similar to a traditional cigarette. For example, the mouthpiece 512 may be used to draw an aerosol through the substrate portion 52. Specifically, the aerosol from the cartridge 50 is drawn through the vapor passage 532 defined through sleeve 530 and through the chamber 516 before being drawn through the mouthpiece 512 and exiting the smoking article through the mouth end 513. As the aerosol passes through the vapor passage 532, air from outside of the holder 504 may be drawn into the vapor passage 532 through the slot 522 and mix with the aerosol as the aerosol is drawn through the vapor passage 532. The mixing of air from outside of the holder 504 may enhance a flavor or taste of the aerosol. In some implementations, one or more existing features and/or one or more additional features may be included such that an extinguishment position may be achieved by actuating the one or more features. For example, in some implementations the mouthpiece may be used to extinguish the heat source, as similarly described above.

If the heat source 54 is extinguished before being exhausted, the outer barrel 540 may be rotated about the inner barrel 520 to return the lighting configuration to allow the user to reignite the heat source 54. After the heat source 54 is reignited, the outer barrel 540 may be rotated back to the received configuration until the heat source 54 is exhausted.

When the heat source 54 is exhausted, the cartridge 50 may be ejected or removed from the holder 504 by rotating the outer barrel 540 about the inner barrel 520 to return the holder 504 to the lighting configuration as shown in FIGS. 29 and 30 and then advancing the slide 524 distally through the slot 522 and the longitudinal chase 542 to return the holder 504 to the loading configuration. When the slide 524 reaches the distal end of the slot 522 and the longitudinal chase 542, the sleeve 530 is translated to the loading position shown in FIG. 28 in which the fingers 536 bias into the groove 538 such that the socket 534 is expanded to a dimension greater than the proximal section 59 of the cartridge 50 transitioning the holder 504 to the loading configuration. In the loading configuration, the holder 504 may be oriented with the distal section 548 downward such that gravity draws the cartridge 50 out of the channel 518. In some implementations, the movement of the slide 524 to the distal end of the slot 522 and the longitudinal chase 542 may eject or launch the cartridge 50 from the holder 504 to unload the cartridge 50. With the cartridge 50 unloaded from the holder 504, another cartridge 50 may be loaded and ignited as detailed above.

The holder 504 allows for the loading, lighting, smoking, and unloading of a cartridge 50 without contacting the heat source 54 of the cartridge 50. In addition, the holder 504 allows for the unloading or ejecting of the cartridge 50 from the holder 504 without physically contacting, e.g., touching, the cartridge 50. The holder 504 also substantially covers or encapsulates the cartridge 50 in the received configuration such that the heat source 54 is prevented from unintentionally contacting the user or other objects when the heat source 54 is ignited. Additionally, in the lighting configuration and the received configuration, the holder 504 secures the cartridge 50 thereto to prevent the cartridge 50 from unintentionally separating from the holder 504.

With reference to FIGS. 33-38, another implementation of a smoking article 600 is disclosed in accordance with the present disclosure. The smoking article 600 includes a holder 604 and the cartridge 50. Similar to the holder 104 detailed above, the holder 604 is configured to receive and secure the cartridge 50 during lighting and smoking, to release the cartridge 50, and receive another cartridge 50 when the cartridge 50 is exhausted.

Referring initially to FIGS. 33 and 34, the holder 604 includes a main body portion 610 and a movable cover 643 that is slidable relative to the main body portion 610. The main body portion 610 includes a mouthpiece 612, an inner barrel 620, and a fixed cover 623. The mouthpiece 612 defines a proximal or mouth end 613 of the holder 604. The inner barrel 620 is distal of the mouthpiece 612 extends distally from the main body portion 610. The inner barrel 620 may have a diameter slightly less than a diameter of an outer wall 611 of the main body portion 610. The fixed cover 623 extends distally from the inner barrel 620 and includes a distal section 628. The main body portion 610 defines a bore 614 that receives one or more filters 615 therein. The filters 615 are similar to the filters 115 detailed above. The main body portion 610 also defines a chamber 616 distal of the bore 614. In addition, the main body portion 610 and the movable cover 643 define a channel 618 distal of the chamber 616. The fixed and movable covers 623, 643 defining a receiving end of the holder 604.

The chamber 616 slidably receives a sleeve 630 therein. The sleeve 630 is configured to translate between a first or distal loading position (FIG. 34), a second or intermediate lighting position (FIG. 36), and a third or proximal received position (FIG. 38). The sleeve 630 includes two or more fingers 636 that extend distally from the sleeve 630. The fingers 636 define a socket 634 therebetween and are biased radially outward. Specifically, the fingers 636 may be self-biased radially outward. In the loading position, the fingers 636 may extend into the channel 618 and into a groove 638 defined in an inner wall 621 of the fixed cover 623 defining a portion of the channel 618. In the loading position, the socket 634 defined between the fingers 636 may be in an expanded configuration. The sleeve 630 defines a vapor passage 632 that interconnects the chamber 616, the channel 618, and the bore 614 to allow aerosol from the cartridge 50 to be drawn through the mouthpiece 612. The inner barrel 620 also defines a slot 622 defined through the inner barrel 620 and in communication with the chamber 616. The slot 622 is parallel to a longitudinal axis of the holder 604. The slot 622 may also allow air surrounding the holder 604 to mix with aerosols being drawn towards the mouthpiece 612 in the vapor passage 632 and/or the chamber 616 in a manner similar to the draw passages 228 detailed above.

The movable cover 643 is slidably received over the inner barrel 620 and is movable between a retracted position (FIG. 34) and a deployed or extended position (FIG. 38). The movable cover 643 has arcuate inner and outer surfaces and surrounds a radial portion of the inner barrel 620. As shown, the fixed cover 623 encloses 180 degrees of the channel 618 and the movable cover 643 encloses the remaining 180 degrees of the channel 618 and a radial portion of the fixed cover 623 such that the movable cover 643 and the fixed cover 623 together fully enclose or surround the channel 618. In some implementations, the fixed cover 623 may enclose an inclusive range of 45 degrees to 315 degrees of the channel 618 with the movable cover 643 enclosing the remainder of the channel 618. In certain implementations, the movable cover 643 is disposed within the fixed cover 623.

The inner barrel 620 includes a slide mechanism 660 that is configured to slide the movable cover 643 between the retracted position and the extended position. The slide mechanism 660 is engaged by the sleeve 630 as the sleeve 630 slides between the intermediate and received positions to slide the movable cover 643 between the retracted and extended positions.

The holder 604 includes a slide 624 having a head 625 and a shank 626. The head 625 is positioned along an outer surface of the inner barrel 620 and the shank 626 extends through the slot 622 to couple to the sleeve 630 such that the sleeve 630 cooperates with movement of the slide 624. The shank 626 and the sleeve 630 may be threadably coupled with one another. The slide 624 is movable within the slot 622 to translate the sleeve 630 between the loading, lighting, and received positions.

With reference to FIGS. 33-38, the use of the smoking article 600 is detailed through the loading, lighting, smoking, and ejecting or unloading of the cartridge 50. Initially, as shown in FIGS. 33 and 34, the holder 604 is in a loading configuration with the slide 624 at a distal end of the slot 622 such that the sleeve 630 is in the loading position. In the loading configuration, the fingers 636 of the sleeve 630 extend into the chamber 618 and are received within the groove 638 such that the socket 634 is in an expanded configuration. In the loading configuration, the cartridge 50 is loaded into the channel 618 by passing the proximal section 59 of the cartridge 50 through the channel 618 until the proximal section 59 is positioned in the socket 634 between the fingers 636. In the expanded configuration, the socket 634 has a diameter larger than the proximal section 59 of the cartridge 50 to allow the proximal section 59 to freely slide into the socket 634. The holder 604 may be held with the fixed cover 623 oriented upward such that the cartridge 50 is gravity fed into the socket 634.

Referring now to FIGS. 35 and 36, with the proximal section 59 of the cartridge 50 received within the socket 634, the slide 624 is translated proximally within the slot 622 to slide the sleeve 630 to the intermediate position. In some implementations, the sleeve 630 may engage the slide mechanism 660 when the sleeve 630 reaches the intermediate position. The slide mechanism 660 may provide tactile feedback to the user when the sleeve 630 reaches the intermediate position. As the slide 624 is translated proximally to the intermediate position, the fingers 636 slide proximally into the chamber 616. As the fingers 636 slide proximally, interaction with the inner wall 621 defining the chamber urges the fingers 636 inward to reduce the socket 634 such that the fingers 636 are in a compressed configuration and engage the outer housing 53 of the proximal section 59 of the cartridge 50. The engagement of the fingers 636 with the proximal section 59 draws the cartridge 50 proximally into the chamber 616. The engagement of the fingers 636 with the outer housing 53 may be frictional engagement. In some implementations, the fingers 636 may include barbs (not shown) that engage the outer housing 53 of the cartridge. When the sleeve 630 reaches the intermediate position, the cartridge 50 is disposed substantially within the channel 618 with the heat source 54 positioned adjacent a distal section 628 of the fixed cover 623 such that the holder 604 is in the lighting configuration. In the lighting configuration, the proximal section 59 of the cartridge 50 may be disposed within the chamber 616 beyond a distal end of the sleeve 630. The holder 604 may be oriented upward during loading and transitioning of the holder 604 to the lighting configuration to prevent the cartridge 50 from inadvertently separating from the holder 604.

In the lighting configuration, the cartridge 50 is secured within the holder 604 such that the orientation of the holder 604 may vary without the cartridge 50 unintentionally separating from the holder 604. With the holder 604 in the lighting configuration, the heat source 54 may be ignited. Specifically, a lighter or match (not shown) may be used to expose the heat source 54 to a flame. During ignition of the heat source 54, the distal section 628 of the fixed cover 623 may be exposed to heat and/or flame. The distal section 628 may be constructed of a heat or flame resistant material to prevent ignition or deformation of the distal section 628 during ignition of the heat source 54. During ignition of the heat source 54, the slide 624 may remain in the intermediate position by engagement with the slide mechanism 660 and/or frictional engagement between the fingers 636 and the inner wall 621.

With the heat source 54 ignited, the slide 624 is moved proximally through the slot 622 to the proximal end of the slot 622 to translate the sleeve 630 within the chamber 616 to the received position as shown in FIGS. 37 and 38. As the sleeve 630 translates to the received position, the fingers 636 engage the outer housing 53 of the cartridge 50 to draw the cartridge 50 proximally through the chamber 616 such that the heat source 54 is disposed entirely within the channel 618. As the sleeve 630 translates from the intermediate position to the received position, the sleeve 60 engages the slide mechanism 660 to slide the movable cover 643 distally from the retracted position to the extended position. In the extended position, the distal section 648 of the movable cover 643 is substantially aligned with the distal section 628 of the fixed cover 623 with the heat source 54 disposed therebetween. In the received configuration, a distal end of the channel 618 remains open to allow airflow into the heat source 54 while the distal sections 628, 648 extend beyond the heat source 54 to protect the heat source 54 from inadvertent contact therewith. Airflow to the heat source 54 enables the heat source 54 to remain ignited. In some implementations, the distal sections 628, 648 define relief slots therebetween that allow additional airflow into or around the heat source 54. As the distal section 648 is adjacent the heat source 54 while the heat source 54 is ignited, the distal section 648 is constructed of a heat resistant material suitable to resist deformation or ignition when exposed to the ignited heat source 54. Friction between the fingers 636 and the inner wall 621 defining the chamber 616 may resist distal movement of the slide 624 to maintain the slide 624 in at the distal end of the slot 622 in the received configuration. In some implementations, the slide mechanism 660 may maintain the sleeve 630, and thus the slide 624, in the received configuration. In certain implementations, the slide mechanism 660 may bias the movable cover 643 towards the retracted position when the sleeve 630 is between the loading position and the received position and maintain the movable cover 643 in the extended position when the sleeve 330 reaches the received configuration.

In the received configuration, the smoking article 600 may be used in a manner similar to a traditional cigarette. For example, the mouthpiece 612 may be used to draw an aerosol through the substrate portion 52. Specifically, the aerosol from the cartridge 50 is drawn through the vapor passage 632 defined through the sleeve 630 before being drawn through the mouthpiece 612 and exiting the smoking article through the mouth end 613. As the aerosol passes through the vapor passage 632, air from outside of the holder 604 may be drawn into the vapor passage 632 through the slot 622 and mix with the aerosol as the aerosol is drawn through the vapor passage 632. The mixing of air from outside of the holder 604 may enhance a flavor or taste of the aerosol. In some implementations, one or more existing features and/or one or more additional features may be included such that an extinguishment position may be achieved by actuating the one or more additional features. For example, in some implementations the mouthpiece may be used to extinguish the heat source, as similarly described above.

If the heat source 54 is extinguished before being exhausted, the slide 624 may be advanced proximally through the slot 622 to the intermediate position to slide the sleeve 630 to the lighting position. As the sleeve 630 returns to the lighting position, the slide mechanism 660 retracts the movable cover 643 to expose the heat source 54 and return the holder 604 to the lighting configuration to allow the user to reignite the heat source 54. After the heat source 54 is reignited, the slide 624 may be returned to the proximal end of the slot 622 to return the holder 604 to the received configuration until the heat source 54 is exhausted.

When the heat source 54 is exhausted, the cartridge 50 may be ejected or removed from the holder 604 advancing the slide 624 to the distal end of the slot 622 to return the holder 604 to the loading configuration shown in FIGS. 33 and 34. When the slide 624 reaches the distal end of the slot 622, the sleeve 630 is translated to the loading position shown in FIG. 33 in which the fingers 636 bias into the groove 638 to expand the socket 634 to a dimension greater than the proximal section 59 of the cartridge. In the loading configuration, the holder 604 may be oriented with the distal section 628 downward such that gravity draws the cartridge 50 out of the channel 618. In some implementations, the movement of the slide 624 to the distal end of the slot 622 may eject or launch the cartridge 50 from the holder 604 to unload the cartridge 50. With the cartridge 50 unloaded from the holder 604, another cartridge 50 may be loaded and ignited as detailed above.

The holder 604 allows for the loading, lighting, smoking, and unloading of a cartridge 50 without contacting the heat source 54 of the cartridge 50. In addition, the holder 604 allows for the unloading or ejecting of the cartridge 50 from the holder 604 without physically contacting, e.g., touching, the cartridge 50. The holder 604 also substantially covers or encapsulates the cartridge 50 in the received configuration such that the heat source 54 is prevented from unintentionally contacting the user or other objects when the heat source 54 is ignited. Additionally, in the lighting configuration and the received configuration, the holder 604 secures the cartridge 50 thereto to prevent the cartridge 50 from unintentionally separating from the holder 604.

As detailed above, portions of the holders 104, 204, 304, 404, 504, 604 may be constructed of a flame or heat resistant material. Suitable flame or heat resistant materials may include, but are not limited to, a metal material such as, stainless steel, aluminum, brass, copper, silver, gold, and bronze; a graphite material; a ceramic material; or any combinations thereof. Although not shown in the depicted implementations, in some implementations the holder may include one or more openings that may correspond to one or more openings in the outer housing of the cartridge. Additionally or alternatively, other implementations may include one or more air inlet openings that extend through the holder downstream from the receiving compartment. In such a manner, drawn air may mix with the generated aerosol before being delivered to the user.

Some implementations may include an igniting mechanism, which may be activated by a user or may be automatic. In one example, the igniting mechanism may include an integrated flint lighter that may be independently activated by a user, or may be automatically activated when the holder, e.g., holders 104, 204, 304, 404, 504, 604, is advanced to the lighting configuration. Other implementations may include a fuel source, such as a fuel tank, that, in conjunction with an igniter, may produce a flame that ignites the heat source 54. In various implementations, activation of the igniting mechanism may occur via a mouthpiece of a holder or another component and/or may be integrated with the holder.

In some implementations, the smoking article, e.g., smoking article 100, 200, 300, 400, 500, 600, may further include an indicator configured to indicate a status of the cartridge 50. For example, in some implementations the indicator may provide a "fuel gage" that approximates how much substrate material in the cartridge may be available for aerosolization and/or how much substrate material has already been aerosolized. Another example of such an indicator may include thermochromatic visual indication of the substrate portion through its consumption cycle. Other examples may include a timer, clock, or progressive visual indicator that provides visual representation of the state of the substrate material. For example, some implementations may provide visual representation in the way of digital indicators, one or more components that change color, one or more lights (e.g., green, yellow, and red), or other progressive indicators. In some implementations, an indicator may provide indication to a user that the substrate portion has heated sufficiently for the user to begin smoking.

In various implementations, the present disclosure may be directed to kits that provide a variety of components as described herein. For example, a kit may comprise a holder with one or more cartridges. In another implementation, a kit may comprise a plurality of holders. In further implementations, a kit may comprise a plurality of cartridges. In yet another implementation, a kit may comprise a plurality of holders and a plurality of cartridges. The inventive kits may further include a case (or other packaging, carrying, or storage component) that accommodates one or more of the further kit components. The case could be a reusable hard or soft container. Further, the case could be simply a box or other packaging structure. In some implementations, a brush or other cleanout accessory may be included in a kit. The cleanout accessory may be configured to be inserted in a receiving chamber of the holder, or, in other implementations, inserted in a separate aperture that enables a user to remove debris from the receiving chamber.

Although a smoking article according to the disclosure may take on a variety of implementations, as discussed in detail herein, the use of the smoking article by a consumer will be similar in scope. The foregoing description of use of the smoking article is applicable to the various implementations described through minor modifications, which are apparent to the person of skill in the art in light of the further disclosure provided herein. The description of use, however, is not intended to limit the use of the inventive article but is provided to comply with all necessary requirements of disclosure herein.

Many modifications and other embodiments of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

What is claimed:

1. A holder for use with a removable and replaceable cartridge, the holder comprising:

a receiving end and a mouth end opposite the receiving end, the holder defining a socket configured to receive a proximal section of a cartridge, the holder having at least two configurations:

a lighting configuration in which the holder is configured to secure the proximal section of the cartridge within the socket with a heat source of the cartridge opposite the proximal section disposed beyond the receiving end of the holder, and a received configuration in which the holder is configured to secure the proximal section of the cartridge in the socket with the heat source disposed proximate the receiving end of the holder, wherein the receiving end comprises a solid peripheral wall, and further comprising a mouthpiece defining a portion of a bore, a main body portion defining a chamber, and a sleeve slidably disposed within the chamber, the sleeve including fingers extending towards the receiving end, the fingers defining the socket therebetween, the fingers having an expanded configuration in which the socket is configured to accept the proximal section of the cartridge and a compressed configuration in which the fingers are configured to engage the proximal section of the cartridge to secure the cartridge to the holder.

2. The holder according to claim 1, further comprising a filter disposed within the bore.

3. The holder according to claim 1, wherein the receiving end comprises a cap configured to releasably couple to the main body portion, the cap and the main body portion configured to encapsulate a cartridge received within the socket.

4. The holder according to claim 1, wherein the sleeve has a loading position in which the fingers are in the expanded configuration and a lighting position proximal of the loading position in which the fingers are in the compressed configuration.

5. The holder according to claim 4, wherein in the loading position of the sleeve, the fingers extend distally from the chamber and in the lighting position of the sleeve, the fingers are disposed at least partially within the chamber with a wall defining the chamber urging the fingers inward from the expanded configuration.

6. The holder according to claim 4, wherein the fingers are configured to draw the cartridge proximally as the sleeve slides from the loading position to the lighting position.

7. The holder according to claim 4, wherein in the lighting position of the sleeve, the fingers are configured to secure the cartridge to the holder with a heat source of the cartridge extending beyond a receiving end of the holder.

8. The holder according to claim 1, wherein the main body portion defines a slot extending through an outer wall and in communication with the chamber, the slot having a first leg, a second leg, and a transverse leg, the first and second legs extending in a direction parallel to one another and a longitudinal axis of the holder, the first and second legs radially offset relative to one another about the outer wall of the main body portion, the second leg longitudinally offset proximal of the first leg, the transverse leg extending in a direction about the outer wall perpendicular to the first and second legs to interconnect the first and second legs.

9. The holder according to claim 8, further comprising a slide extending through the slot and coupled to the sleeve, the sleeve configured to slide and rotate within the chamber in cooperation with the slide.

10. The holder according to claim 9, wherein in the loading configuration of the holder, the slide is at a distal end of the first leg and the sleeve is in a distal loading position with the fingers in the expanded configuration; wherein in the lighting configuration of the holder, the slide is longitudinally aligned with a proximal end of the first leg or a distal end of the second leg and the sleeve is in a lighting position proximal of the loading position with the fingers in the compressed configuration; wherein in a received configuration of the holder, the slide is at a proximal end of the second leg and the sleeve is in a received position proximal of the lighting position with the fingers in the compressed configuration.

11. The holder according to claim 10, wherein the sleeve is rotated about the longitudinal axis of the holder between the loading and received positions thereof.

12. The holder according to claim 10, wherein in the lighting configuration, the slide is positioned within the transverse leg.

13. The holder according to claim 1, wherein the mouthpiece is releasably coupled to the main body portion.

14. The holder according to claim 13, wherein the holder has a snub configuration in which the mouthpiece is secured to a distal section of the main body portion; wherein in the snub configuration, the mouthpiece is configured to be disposed over a heat source of a cartridge secured within the socket.

15. The holder according to claim 1, wherein the main body portion includes an inner barrel forming a distal section thereof.

16. The holder according to 15, further comprising an outer barrel rotatably disposed over the inner barrel.

17. The holder according to claim 16, wherein the main body portion defines a slot extending through the inner barrel in communication with the chamber, the slot extending in a direction parallel a longitudinal axis of the holder, wherein the outer barrel defines a longitudinal chase extending therethrough and in a direction parallel to the longitudinal axis of the holder, outer barrel also defines a transverse chase extending therethrough from a proximal end of the longitudinal chase in a direction about the outer barrel perpendicular to the longitudinal chase.

18. The holder according to claim 17, further comprising a slide secured to the sleeve, the slide extending through the slot and the longitudinal or transverse chase.

19. The holder according to claim 18, wherein in the lighting configuration of the holder, the longitudinal chase and the slot are radially aligned within one another and in the received configuration of the holder, the longitudinal chase and the slot are radially offset from one another.

20. The holder according to claim 18, wherein in a loading configuration of the holder, the slide is positioned at a distal end of the slot and a distal end of the longitudinal chase with the sleeve in a distal position such that the fingers are in the expanded configuration; wherein in the lighting configuration of the holder, the slide is positioned at a proximal end of the slot and a proximal end of the longitudinal chase with the sleeve in a proximal position such that the fingers are in the compressed configuration; and wherein in the received configuration of the holder, the slide is positioned at the proximal end of the slot and within the transverse chase radially spaced apart from the longitudinal chase with the sleeve in the proximal position such that the fingers are in the compressed configuration.

21. The holder according to claim 18, wherein the inner barrel includes an inner cover at a distal end thereof and the outer barrel includes an outer cover at a distal end thereof, the inner cover enclosing a portion of a channel configured to receive a cartridge, the outer cover enclosing a portion of the channel, and wherein one or more of the inner cover or the outer cover comprises the receiving end.

22. The holder according to claim 21, wherein in the lighting configuration of the holder, the inner cover is nested within the outer cover such that a radial portion of the channel is enclosed by the inner and outer covers and a radial portion of the channel opposite the inner and outer covers is open; and wherein in the received configuration of the holder, the inner and outer covers oppose one another to radially enclose the channel.

23. The holder according to claim 17, wherein in the lighting and received configuration, an outer wall of the outer barrel is flush with an outer wall of the main body portion.

24. The holder according to claim 1, wherein the main body portion includes an inner barrel and a fixed cover, the inner barrel defining a distal portion of a channel positioned distal of the chamber, the fixed cover extending distally from the inner barrel and enclosing a radial portion of a channel, the channel configured to receive a cartridge therein.

25. The holder according to claim 24, wherein the fixed cover radially encloses between 45 degrees and 315 degrees of the channel.

26. The holder according to claim 24, further comprising a movable cover opposed to the fixed cover, the movable cover enclosing a radial portion of the channel, the movable cover having an extended position in which the movable cover and the fixed cover radially enclose the channel therebetween, and wherein one or more of the fixed cover or the movable cover comprises the receiving end.

27. The holder according to claim 26, wherein the movable cover has a retracted position proximal of the extended position in which a portion of the channel opposite the fixed cover and beyond a distal end of the movable cover is open.

28. The holder according to claim 27, further comprising a slide mechanism configured to translate the movable cover between the retracted position and the extended position.

29. The holder according to claim 28, wherein in a loading configuration of the holder, the sleeve is in a loading position with the fingers in the expanded configuration and the movable cover is in the retracted position; wherein in the lighting configuration of the holder, the sleeve is in a lighting position proximal of the loading position with the fingers in the compressed configuration and the movable cover in the retracted position; and wherein in the received configuration of the holder, the sleeve is in a received position proximal of the lighting position with the fingers in the compressed configuration and the movable cover in the extended position.

30. The holder according to claim 29, wherein the sleeve engages the slide mechanism between the lighting position and the received position to transition the movable cover between the retracted position and the extended position.

31. The holder according to claim 28, wherein the slide mechanism is configured to bias the movable cover to the retracted position when the movable cover is between the retracted position and the extended position and to maintain the movable cover in the extended position.

* * * * *